US012662831B2

(12) United States Patent
Jiang et al.

(10) Patent No.: US 12,662,831 B2
(45) Date of Patent: Jun. 23, 2026

(54) PREFAB MODULAR SHED

(71) Applicant: YIXIANG BLOW MOLDING FURNITURE CO., LTD., Yuyao (CN)

(72) Inventors: Yixiang Jiang, Yuyao (CN); Jinglei Jiang, Yuyao (CN); Shangxi Jiang, Yuyao (CN)

(73) Assignee: YIXIANG BLOW MOLDING FURNITURE CO., LTD., Yuyao (CN)

( * ) Notice: Subject to any disclaimer, the term of this patent is extended or adjusted under 35 U.S.C. 154(b) by 132 days.

(21) Appl. No.: 18/912,486

(22) Filed: Oct. 10, 2024

(65) Prior Publication Data

US 2025/0034891 A1 Jan. 30, 2025

Related U.S. Application Data

(63) Continuation-in-part of application No. 18/362,818, filed on Jul. 31, 2023, now Pat. No. 12,480,303.

(60) Provisional application No. 63/369,970, filed on Jul. 31, 2022.

(30) Foreign Application Priority Data

Apr. 25, 2024 (CN) ..... 202410505327.8

(51) Int. Cl.
*E04H 1/12* (2006.01)
*E04H 1/00* (2006.01)

(52) U.S. Cl.
CPC ..... *E04H 1/1205* (2013.01); *E04H 1/005* (2013.01)

(58) Field of Classification Search
CPC ..... E04B 1/34321; E04B 1/34317; E04B 1/34384; E04B 1/6116; E04B 1/6137; E04B 1/6162; E04B 2001/6195; E04B 2103/04; E04B 1/12; E04B 1/6141; E04H 1/1205; E04H 1/005
See application file for complete search history.

(56) References Cited

U.S. PATENT DOCUMENTS 3,731,449 A * 5/1973 Kephart, Jr. ..... B32B 27/065 52/309.7
5,357,728 A * 10/1994 Duncanson ..... E04C 2/526 52/592.4
7,377,077 B2 * 5/2008 Rebeck ..... E04H 1/1205 52/DIG. 14
7,685,676 B2 * 3/2010 Mc Clellan ..... E05D 1/02 16/221

(Continued)

*Primary Examiner* — Rodney Mintz
(74) *Attorney, Agent, or Firm* — Platinum Intellectual Property PC

(57) ABSTRACT

The present subject matter discloses a prefabricated modular shed constructed from modular plastic components or panels. The modular storage shed can be installed onsite with pre-constructed modular panels. The shed features embedded seamless folding grooves such as in the door panels and the central roof panel. Furthermore, a pivotable frame bracket can encase the edge of the rotating panels, enhancing both strength and durability. The wall and floor panels are secured with T-shaped connectors to further improve stability. The structural integrity of the shed's walls is reinforced by support columns with built-in reinforcement ribs, which are designed for simple installation. In addition, the modular storage shed can be expandable depending on the preferred size.

20 Claims, 63 Drawing Sheets

(56) References Cited

U.S. PATENT DOCUMENTS 8,707,631 B2 * 4/2014 Scouten ..... E04H 9/14 52/68
10,422,169 B2 * 9/2019 Christenson ..... E05D 1/02
10,697,171 B2 * 6/2020 Melo Pereira ..... E04C 2/384
11,020,681 B2 * 6/2021 Rieber ..... F16C 11/04
11,135,525 B2 * 10/2021 Rieber ..... E04B 1/3445
11,274,431 B2 * 3/2022 McCall ..... E04F 13/0871
11,846,130 B2 * 12/2023 Jiang ..... E05D 1/02
11,927,008 B2 * 3/2024 Giacomini ..... E04B 1/345
12,116,773 B2 * 10/2024 Keller ..... E04C 2/46
12,291,859 B2 * 5/2025 Keller ..... E04B 5/02
12,480,303 B2 * 11/2025 Jiang ..... E04B 1/34317
12,486,659 B2 * 12/2025 Jiang ..... E04B 1/34317
12,560,011 B2 * 2/2026 Jiang ..... E05D 1/02
12,584,313 B2 * 3/2026 Weng ..... E04C 2/40
2003/0005660 A1 * 1/2003 Stibolt ..... E04F 13/06 52/582.1
2005/0126083 A1 * 6/2005 Rebeck ..... E04H 1/1205 52/79.1
2007/0199176 A1 * 8/2007 Mc Clellan ..... E05D 1/02 16/224
2008/0216426 A1 * 9/2008 Bunker ..... E04B 1/34315 52/285.3
2012/0180404 A1 * 7/2012 Scouten ..... E04H 9/028 52/79.5
2015/0067983 A1 * 3/2015 Carey ..... B29C 48/0017 16/225
2016/0138258 A1 * 5/2016 Schaffert ..... E04B 1/3445 52/79.5
2017/0051497 A1 * 2/2017 Kolbe ..... E04H 1/1205
2018/0283065 A1 * 10/2018 Christenson ..... B32B 5/24
2019/0055728 A1 * 2/2019 Melo Pereira ..... E04C 2/22
2019/0136506 A1 * 5/2019 McCall ..... E04C 2/365
2020/0049462 A1 * 2/2020 Jones ..... E04H 1/1205
2020/0215448 A1 * 7/2020 Rieber ..... A63H 33/008
2020/0215449 A1 * 7/2020 Rieber ..... E04B 1/345
2022/0127840 A1 * 4/2022 Giacomini ..... E04B 1/34384
2022/0298783 A1 * 9/2022 Shi ..... E04B 1/3445
2023/0061113 A1 * 3/2023 Keller ..... E04B 2/56
2023/0068992 A1 * 3/2023 Streeter ..... E04H 1/005
2023/0120248 A1 * 4/2023 Jiang ..... E05D 1/02 16/254
2023/0167636 A1 * 6/2023 Keller ..... E04B 1/14 52/91.3
2024/0035271 A1 * 2/2024 Jiang ..... E04B 1/34317
2024/0035272 A1 * 2/2024 Jiang ..... E04B 1/34317
2024/0068285 A1 * 2/2024 Jiang ..... E05D 1/02
2025/0027314 A1 * 1/2025 Lin ..... E04H 1/1205
2025/0163695 A1 * 5/2025 Rais-Rohani ..... E04B 1/3445
2025/0188740 A1 * 6/2025 Weng ..... E04C 2/40
2025/0333951 A1 * 10/2025 Jiang ..... E04H 1/1205
2025/0333960 A1 * 10/2025 Jiang ..... E04H 1/1205
2025/0333988 A1 * 10/2025 Jiang ..... E05D 3/02
2026/0055596 A1 * 2/2026 Jiang ..... E04B 1/34317
2026/0055597 A1 * 2/2026 Jiang ..... E04B 1/34317

* cited by examiner

PREFAB MODULAR SHED

CROSS-REFERENCES TO RELATED APPLICATIONS

This application is a continuation-in-part of U.S. application Ser. No. 18/362,818, filed Jul. 31, 2023 and further claims the priority of Chinese Application No. 202410505327.8, entitled "Modular Shed," filed Apr. 25, 2024, which is incorporated herein by reference for all purposes.

TECHNICAL FIELD

The present subject matter is in the field of plastic assembly. More particularly, embodiments of the present subject matter relate to a storage shed comprising modular molded plastic panels.

BACKGROUND

Molded plastic has a wide variety of benefits as a furniture material and component. For example, it is highly resistant to impact, moisture, and chemicals, which makes it more durable compared to other materials like wood or glass; it is also lighter than many other materials, rendering it advantageous for transportation cost. Furthermore, molded plastics can be shaped into virtually any form, allowing for a great deal of design flexibility. This allows for more creative and complex designs than other materials. An example of such a design is a prefab modular shed that is economical to manufacture, easy to transport and install while providing many novel and beneficial design features.

SUMMARY OF THE INVENTION

The present subject matter is directed to improved designs for a modular storage shed that is convenient to assemble and dissemble using prefabbed plastic components or panels. Embodiments of the present subject matter are discussed below with reference to FIGS. 1-55.

In the following description, for purposes of explanation, numerous specific details are set forth in order to provide a thorough understanding of the present subject matter. It will be apparent, however, to one skilled in the art that the present subject matter may be practiced without some of these specific details. In addition, the following description provides examples, and the accompanying drawings show various examples for the purposes of illustration. Moreover, these examples should not be construed in a limiting sense as they are merely intended to provide examples of embodiments of the subject matter rather than to provide an exhaustive list of all possible implementations. In other instances, well-known structures and devices are shown in block diagram form in order to avoid obscuring the details of the disclosed features of various described embodiments.

The present subject matter is directed to a modular storage shed with optimized structural stability and durability. The shed can be installed easily onsite with pre-constructed modular panels. The shed features embedded seamless folding grooves such as in the door panels and the central roof panel. Furthermore, a pivotable frame bracket can encase the edge of the rotating panels, enhancing both strength and durability. The wall and floor panels are secured with T-shaped connectors to further improve stability. The structural integrity of the shed's walls is reinforced by support columns with built-in reinforcement ribs, which are designed for simple installation. Furthermore, based on the preferred space, the modular storage shed can be expanded with prefabricated floor panels and wall panels.

According to some embodiments, the present subject matter is directed to a prefab modular shed structure made of molded plastic panels, the shed structure comprises: a floor, wall panels, door panels, a door lintel, and a roof with beam support frames. The floor, wall panels, door panels, door lintel, and roof can be blow-molded panels and assembled using modular overlapping mechanism. The bottom of the wall panels can be detachably connected to the floor. The door lintel can be detachably installed on the wall panels or between the wall panels and door panels. The beam support frames in the roof can be detachably installed on the wall panels and door lintel or between the door panels and door lintel. The roof can be detachably installed on the beam support frames.

According to some embodiments, to fix the wall panels to the floor, the edge of the floor has an upward-facing slot. Inside the slot, there can be T-shaped installation holes spaced along the length of the slot. The wall panels can be inserted into the slot and secured using specially designed T-shaped connectors and screws. The vertical part of the T-shaped connector can pass through the T-shaped installation hole and extend above the slot, where it can be fixed to the wall panels with screws. The horizontal part of the T-shaped connector can be positioned at the bottom of the T-shaped installation hole to increase the connection between the wall and floor panels.

To render the connection between the wall panels and the floor more secure, the lower part of the inner side of the wall panels has a notch, and the vertical part of the T-shaped connector extends into the notch and rests against the inner sidewall of the wall panel. The vertical part of the connector extending above the slot has an installation hole through which a screw passes and is fixed to the wall panel.

To connect and secure the wall panels on adjacent sides, the shed structure can include support columns that connect the wall panels on adjacent sides. The support columns consist of an outer support plate and an inner support plate connected by reinforcing ribs between them. Between these plates can locate a socket opening towards the corresponding side wall panel, into which the wall panels are inserted.

According to some embodiments, a door panel can include a door side panel and a door body, which are integrally formed in one blow-molding process. The door body can be connected to the door side panel through an embedded folding groove that is integrally formed with both the door side panels and the door body, allowing the door body to rotate relative to the door side panel. This design can eliminate the need for conventional hinge structures that creates a seam in the structure. The groove enables the door body and side panel to be connected using flexible blow-molded materials. This also enables the door body and side panel to be formed together using a single mold, thus improving the manufacture efficiency.

To prevent the door panels from sagging due to repeated usages, and to avoid twisting caused by asynchronous movements, a pivotable frame bracket can encase the edge of the rotating panels to increase its strength and durability. Specifically, the bottom of the door side panel adjacent to the door body can be equipped with a first support member, and the bottom of the door body adjacent to the door side panel can have a second support member. These support members can be rotationally connected or hinged to form a pivotable frame bracket. The embedded folding groove can be positioned below the rotational connection of the first and second support members. Additionally, the top of the door side panel adjacent to the door body can have a third support member, and the top of the door body adjacent to the door side panel can have a fourth support member. These support members can be rotationally connected to form another pivotable frame bracket, with the embedded groove positioned below the rotational connection of the third and fourth support members.

To secure the support members to the door side panels and the door body, the first, second, third, and fourth support members can all have U-shaped slots, within which the door side panel and door body can be positioned. The U-shaped slots can have through-holes on their opposite sidewalls, and corresponding mounting holes can be provided at the respective positions of the door side panel and door body. Connectors can pass through these mounting holes and through-holes to secure the respective support members to the door side panels and the door body.

To ensure the roof fits securely with the triangular door lintel and prevent it from sliding down, the door lintel can be in a triangular shape. The bottom of the roof can be formed with a downward-facing slot corresponding to the upper edge of the triangular door lintel. The upper edge of the triangular door lintel can fit into this slot, and a limiting protrusion can be provided on top of the triangular door lintel. The slot can extend deeper to form a limiting groove into which the limiting protrusion is embedded.

In the roof, the beam support frame can have various structures to enhance its strength and durability. According to some embodiments, it can include a central beam column, central crossbars, and side crossbars. The central beam column can be arranged parallel to the triangular door lintel, with the central crossbars and side crossbars spaced along the central beam column. The ends of the central crossbars can be fixed to the triangular door lintel, while the side crossbars can be fixed to the roof. This structure can provide a more stable overall framework.

The roof panel can include a central roof panel and side roof panels. The central roof panel can be bent in the middle to form a roof peak coupled with the triangular door lintel and can be fixed to the beam support frame. The two side roof panels can be positioned on either side of the central roof panel, and they can be connected and secured to the side crossbars adjacent to the central crossbars of the beam support frame. The top surfaces of the central and side roof panels can form a stepped structure that can gradually descend from the center to the sides. The roof can incorporate flexible materials to form an embedding folding groove in the middle of the central roof panel, allowing it to fold downward during installation and resulting in a secure installation of the central and side roof panels while preventing rainwater from entering the shed structure through the roof.

Compared to conventional designs, the advantageous features of the present subject matter include at least the following: First, the present roof assembly can provide optimized features because the inter-crossed beam columns and crossbars can increase the strength and durability of the roof, the foldable central roof panel is more compact and easier to install, and each main component, e.g., the roof, the beam support frame, the door lintels are all detachable and can engage with each other via fixation elements, rendering convenient assembly and disassembly of the modular shed. Furthermore, the foldable central roof panel creates a seamless roof peak that prevent water to enter the shed.

Second, the structure stability between two perpendicular panels, such as the wall panels and the floor, are improved through the T-shaped connectors. The T-shaped connectors can provide additional contact surface and connection force via screws. The adoption of the T-shaped connectors also reduces the need of a large number of screws or other fasteners, which are time consuming and labor intensive to handle. Furthermore, the corners of the wall panels are further reinforced by support columns with reinforcement ribs. Such support columns can further simplify the installation via providing socket opening to receive and secure the wall panels.

Third, the door assembly comprises a door panel comprising a door side panel and a door body that are integrally formed by blow molding. The door body can be connected to the door side panel through a seamless, embedded folding groove that have thinner plastic material than remaining of the panel. Furthermore, the door assembly can adopt a pivotable frame bracket can encase the edge of the joint rotating panels to increase its strength and durability.

According to some embodiments, the floor, wall panels, door panels, triangular door lintel, and roof of this modular shed structure can be made of blow-molded panels and assembled onsite using modular overlapping mechanism. The bottom of the wall panels can be detachably connected to the floor, and the triangular door lintel can be detachably installed on the wall panels or between the wall panels and door panels. The roof's beam support frame can be detachably installed on the wall panels and the triangular door lintel or between the door panels and the triangular door lintel, and the roof can be detachably installed on the beam support frame. The panels used to construct the shed structure can be made of blow-molded parts, resulting in a lightweight structure with lower costs. Each component can be assembled and disassembled using a modular overlapping method, making installation and dismantling relatively simple while ensuring a stable structure.

According to some embodiments, the present subject matter is directed to a modular shed structure made of molded plastic panels, comprising a floor comprising a plurality of floor panels, a plurality of wall panels coupled with the plurality of floor panels via one or more T-shaped connectors, a pair of door panels, each door panel comprising a door side panel connected to a door body via a first embedded folding groove, and a roof that comprises a central roof panel that is foldable via a second embedded folding groove and one or more side roof panels coupled to the central roof panel. According to some embodiments, the door panel further comprises a recessed door handle.

According to some embodiments, the present subject matter is directed to a configurable modular shed structure made of molded plastic panels. The configurable shed comprises a floor comprising a plurality of floor panels, a plurality of wall panels coupled with the plurality of floor panels, a pair of door panels, each door panel comprising a door side panel connected to a door body via a first embedded folding groove, a roof that comprises a central roof panel that is foldable via a second embedded folding groove and one or more side roof panels coupled to the central roof panel, and a plurality of support columns positioned at each corner of the storage shed structure. According to some embodiments, the configurable modular shed structure's size is adjustable via the numbers of the plurality of wall panels and the floor panels. Furthermore, the shed can have a raised wall panel section that offers higher ceiling in some areas.

According to some embodiments, each of the first embedded folding groove and the second embedded folding groove can have thinner plastic material, and wherein the second embedded folding groove can enable the central roof panel to form a roof peak when the storage shed structure is installed.

According to some embodiments, the modular shed structure can further comprise a door lintel installed between the roof and the door panels, wherein the door lintel can comprise a upper edge to engage with a downward-facing slot on the roof. The door lintel further can further comprise a position bump formed on top of the triangular door lintel, and the position bump can be embedded into a position recess formed on the roof.

According to some embodiments, a floor panel can have an upward-opening strip groove with a plurality of T-shaped installation holes, and the plurality of T-shaped installation holes are configured to engage with the one or more T-shaped connectors.

According to some embodiments, the vertical part of a T-shaped connector can pass through a T-shaped installation hole, and the horizontal part of the T-shaped connector can be positioned at the bottom of the T-shaped installation hole.

According to some embodiments, a door panel further can comprise a metal pivotable frame bracket encasing the edge of the door side panel and the door body. The metal pivotable frame bracket can comprise a pair of rotatable support members affixed to reinforce the door panel, and the door side panel and door body can be constrained within corresponding U-shaped grooves on the pair of rotatable support members.

According to some embodiments, the side walls of the pair of rotatable support members can have through holes, and corresponding mounting holes can be provided on the corresponding positions of the door side panel and door body. According to some embodiments, the modular shed structure can have a plurality of fixation components configured to fix the metal pivotable frame bracket via the through holes and the corresponding mounting holes.

According to some embodiments, the roof can further comprise a beam support frame configured to support the roof, wherein the beam support frame comprises at least one central beam column and a central crossbar positioned in the middle of the at least one central beam column. The beam support frame can further comprises a plurality of side crossbars in parallel to the central crossbar, and wherein the central crossbar and the plurality of side crossbars can be distributed on the central beam column at intervals.

According to some embodiments, the central crossbar is affixed to a door lintel and the plurality of side crossbars are affixed to the roof. According to some embodiments, top surfaces of the central roof panel and the one or more side roof panels form a stepped structure that gradually descends from the center to the sides.

According to some embodiments, the modular shed structure can further comprise a plurality of support columns positioned at each corner of the storage shed structure, wherein the plurality of support columns are formed by injection mold.

According to some embodiments, each of the plurality of support columns can have an outer support plate and an inner support plate that are connected by a plurality of reinforcing ribs between them. According to some embodiments, each of the plurality of support columns can have sockets formed between the outer support plate and the inner support plate, and wherein the sockets are configured to receive the plurality of wall panels.

According to some embodiments, the inner edges of the inner support plate can extend further than those of the outer support plate to form an extension section configured to fix to the wall panels.

According to some embodiments, the present subject matter is directed to a modular shed structure made of molded plastic panels, comprising a floor comprising a plurality of floor panels, a plurality of wall panels coupled with the plurality of floor panels, the pair of door panels, each door panel comprising a door side panel connected to a door body via a first embedded folding groove, and a roof that comprises a central roof panel that is foldable via a second embedded folding groove and one or more side roof panels coupled to the central roof panel.

According to some embodiments, the present subject matter is directed to a modular shed structure made of molded plastic panels, comprising a floor comprising a plurality of floor panels, a plurality of wall panels coupled with the plurality of floor panels via one or more T-shaped connectors, one or more door panels, each door panel comprising a door side panel connected to a door body via a first embedded folding groove, a roof that comprises a central roof panel that is foldable via a second embedded folding groove and one or more side roof panels coupled to the central roof panel, and a plurality of support columns positioned at each corner of the storage shed structure.

According to some embodiments, the present subject matter is directed to a storage shed structure made of molded plastic panels, the shed structure comprises: a floor further comprises a plurality of corner edge floor panels, and a plurality of transitional floor panels coupled to the plurality of corner edge floor panels via one or more connectors. It further has side walls coupled with the floor, the side walls further comprise a plurality of flat panels, a plurality of foldable corner panels that form four corners of the storage shed structure. The storage shed structure further comprises one or more doors coupled with the side walls and the floor, and a roof that comprises a plurality of foldable roof panels. According to some embodiments, the shed further comprises a lintel installed between the roof and the side walls, wherein the lintel comprises one or foldable lintel panels.

According to some embodiments, each of the molded plastic panels has similar size and shape to reduce package space and transportation cost. Also, the one or more connectors comprise at least a butterfly connector and a cross/double-butterfly connector.

According to some embodiments, each foldable corner panel has an integrated folding groove that has thinner plastic material, and wherein the embedded folding groove enables each foldable corner panel to fold at a fixed angle when the storage shed structure is installed. The embedded folding groove can enable each corner edge floor panel and each foldable corner panel to lay flat during transportation.

According to some embodiments, the molded plastic panels comprise a number of back strengthening ribs that comprise vertical support grooves and horizontal support grooves, and wherein each vertical support groove is surrounded by a plurality of horizontal support grooves.

According to some embodiments, each corner edge floor panel has two sides to connect to wall panels and each transitional floor panel has one side to connect to the wall panels.

According to some embodiments, at least one side of the corner edge floor has more than one coupling mechanism. According to some embodiments, a first side of a transitional floor panel has a first slider rail, a first side of a corner edge floor panel has a second slider rail configured to be in continuation with the first slider rail, and wherein the first side of the corner edge floor panel further has one or more clips. According to some embodiments, the first slider rail comprises one of a L-shaped groove and a T-shaped groove, or another type of groove.

According to some embodiments, the first slider rail of the transitional floor panel and the second slider rail of the corner edge floor panel are configured to engage with a first slider of a wall panel, and wherein the one or more clips of the corner edge floor panel are configured to engage one or more clip slots on the wall panel.

According to some embodiments, the plurality of foldable corner panels are connected to the plurality of flat panels via interlocked teeth couplings. The interlocked teeth couplings comprise a plurality of protrusions and matched recesses arranged on both the plurality of foldable corner panels and the plurality of flat panels, wherein the plastic material has varied depth based on the design of the interlocked teeth couplings.

According to some embodiments, the plurality of transitional floor panels and the plurality of flat panels of the side walls are extendable. According to some embodiments, a concave door frame can transition within a foldable corner panel, wherein the concave door frame is sloped towards a door.

According to some embodiments, a plurality of supporting beams can be stored within embedded lots in the back of the molded plastic panels during transportation, wherein a depth of the embedded slots is smaller than a depth of the supporting beams.

According to some embodiments, the interior surface of foldable corner panels can have a plurality of embedded shelf grooves. One or more shelves can be slotted into the shelf grooves to provide storage and to enhance the stability of the storage shed structure.

According to some embodiments, the present subject matter is directed to a foldable molded plastic panel that comprises an embedded folding groove that divides a molded plastic panel into a first leaf and a second leaf, wherein the embedded folding groove has thinner plastic material that enables the molded plastic panel to fold at a fixed angle when the foldable molded plastic panel is installed, wherein the foldable molded plastic model unfolds and forms a flat surface prior to the installation, and wherein the foldable molded plastic model functions as a corner for a molded plastic structure after the installation.

According to some embodiments, the foldable molded plastic panel further comprises a second embedded folding groove with thinner less plastic material.

According to some embodiments, the foldable molded plastic panel further comprises a first coupling structure arranged on a first leaf, and a second coupling structure arranged on a second leaf, wherein the first coupling structure is different from the second coupling structure. Furthermore, the first coupling structure can comprise a slider and the second coupling structure comprises one or more clip slots.

According to some embodiments, the foldable molded plastic panel further comprises a plurality of shelf grooves embedded into interior surfaces of the foldable molded plastic panel. According to some embodiments, one or more shelves can be slotted into the plurality of shelf grooves to provide storage and to enhance the stability of the storage shed structure.

According to some embodiments, the foldable molded plastic panel further comprises a number of back strengthening ribs that comprise vertical support grooves and horizontal support grooves, and wherein each vertical support groove is surrounded by a plurality of horizontal support grooves.

According to some embodiments, the foldable molded plastic panel further comprises a first plurality of interlocked teeth couplings arranged at a first edge of the foldable molded plastic panel, wherein the first plurality of interlocked teeth couplings are configured to engage a second plurality of interlocked teeth couplings of another molded plastic panel. Furthermore, the first plurality of interlocked teeth couplings and the second plurality of interlocked teeth couplings can be further secured by an additional fixing mechanism.

According to some embodiments, the present subject matter is directed to a storage shed structure made of molded plastic panels. It comprises a floor further that further comprises a plurality of corner edge floor panels, and a plurality of transitional floor panels coupled to the plurality of corner edge floor panels via one or more connectors. The shed structure further comprises side walls coupled with the floor, the side walls further comprise a plurality of flat panels, a plurality of foldable corner panels that form four corners of the storage shed structure, a plurality of shelf grooves embedded into the interior surface of corner panels, and one or more shelves configured to insert into the plurality of shelf grooves to provide storage and to enhance the stability of the storage shed structure. Furthermore, the storage shed structure can consist of one or more doors coupled with the side walls and the floor, and a roof that comprises a plurality of foldable roof panels.

Other aspects and advantages of the present subject matter will become apparent from the following detailed description taken in conjunction with the accompanying drawings, which illustrate, by way of example, the principles of the present subject matter.

DESCRIPTION OF DRAWINGS

The present subject matter will be further described in detail below with reference to the embodiments of the accompanying drawings.

DETAILED DESCRIPTION

Figure 1:
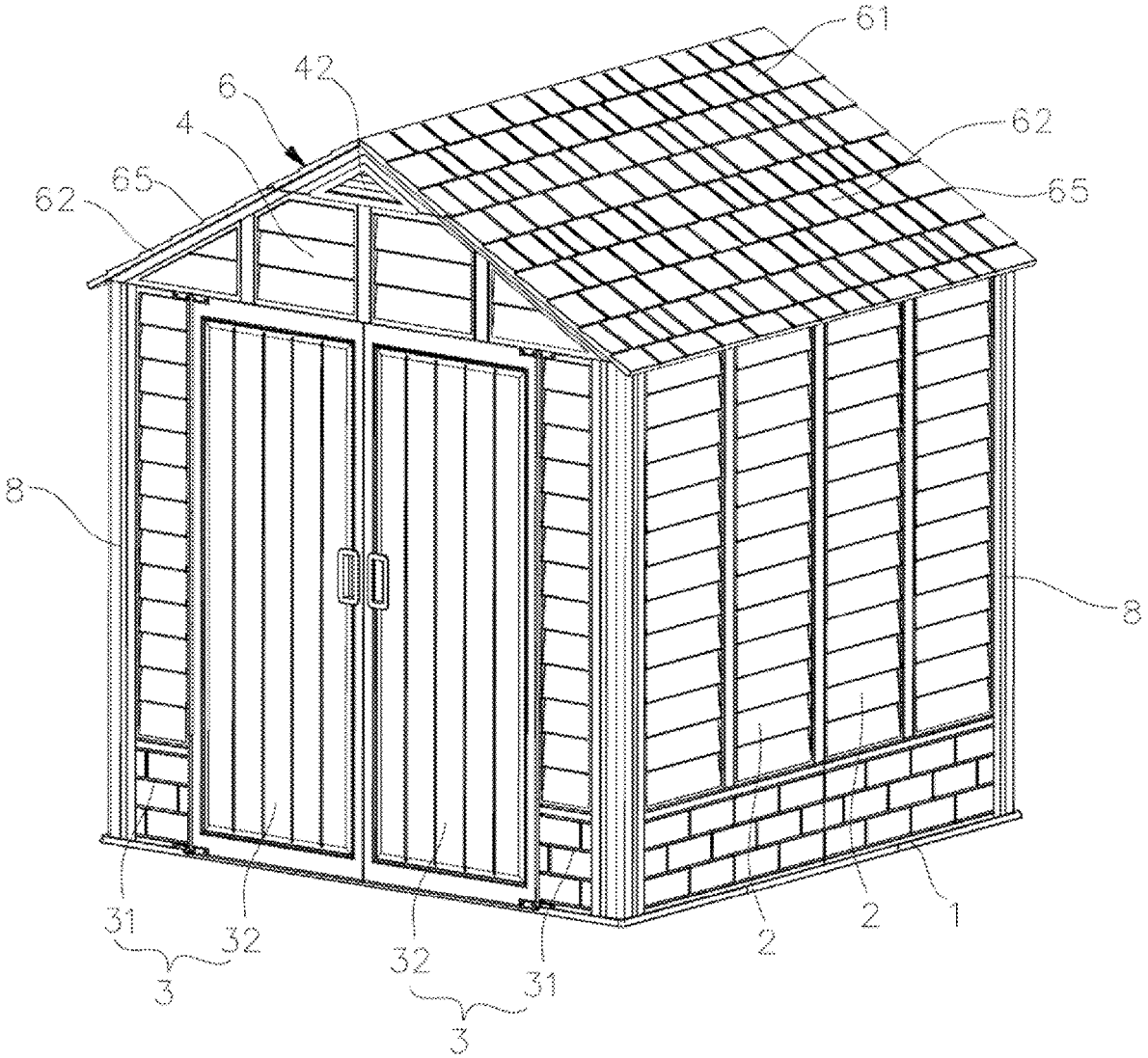
FIG. 1 is a schematic diagram of a prefab modular shed structure, according to one embodiment of the present subject matter.
Figure 2:
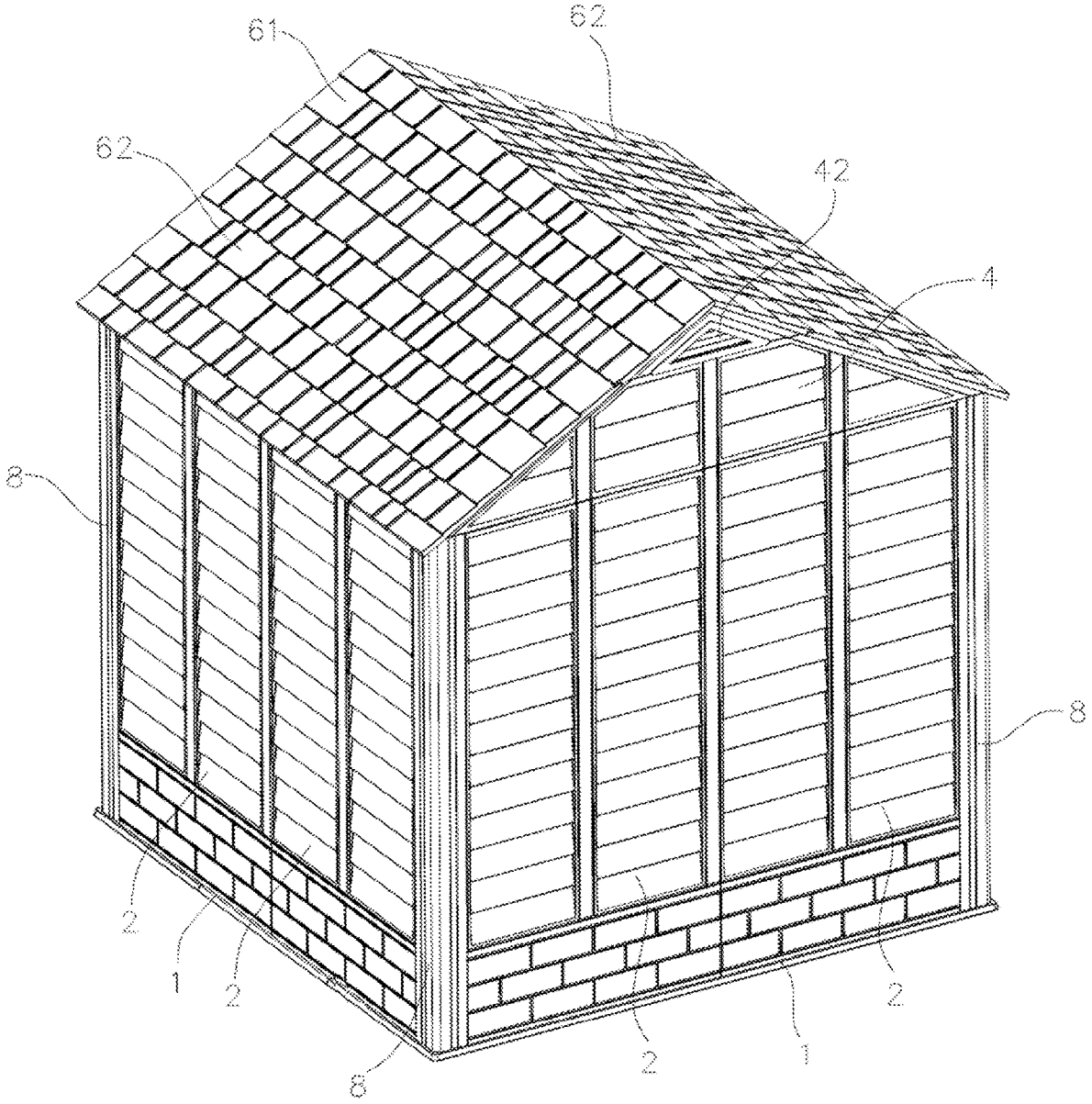
FIG. 2 is another schematic diagram of the shed structure shown in FIG. 1 at a different angle.
Figure 3:
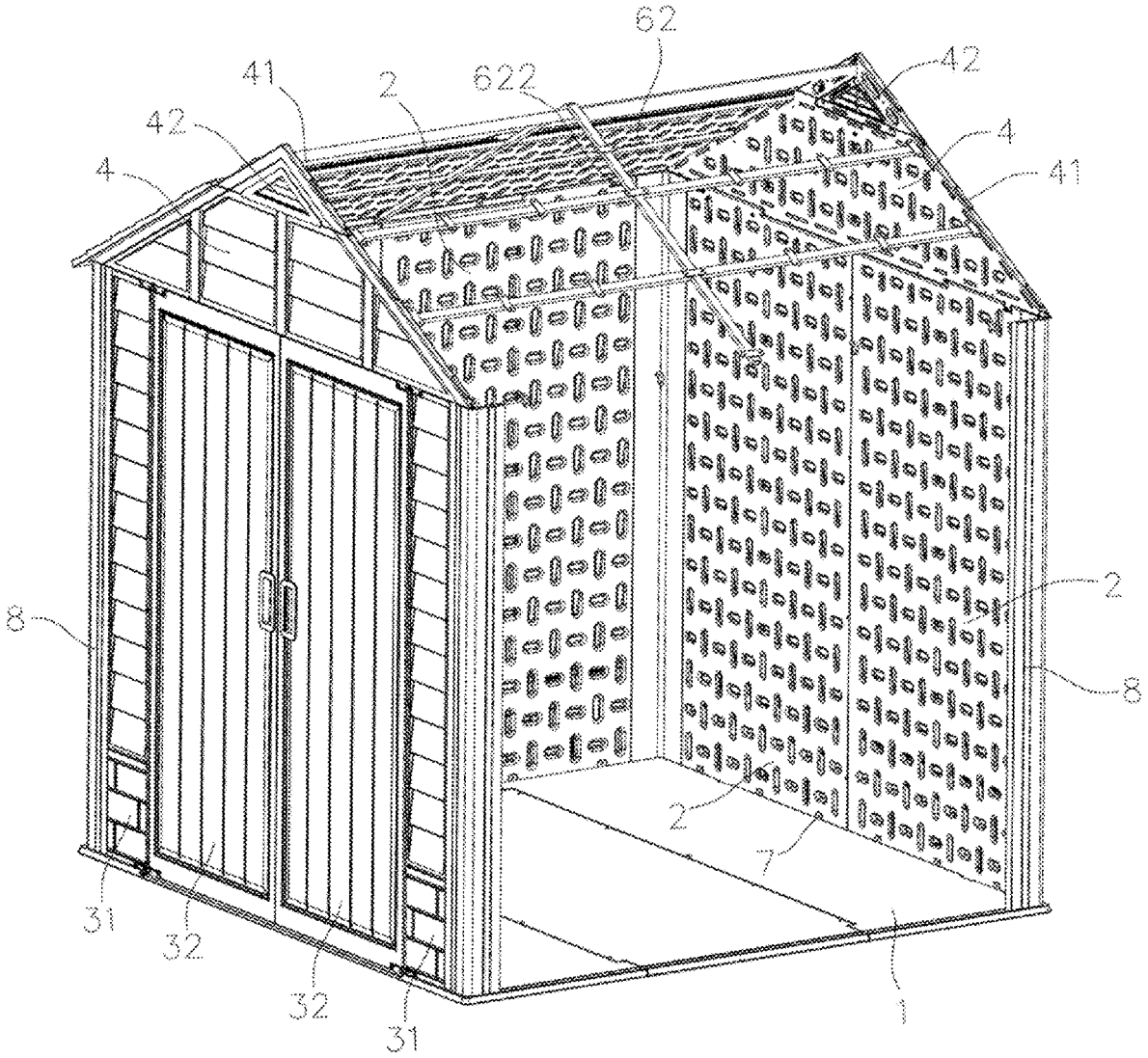
FIG. 3 is a schematic diagram of the shed structure shown in FIG. 1 with part of the roof removed.

It is to be understood that even though numerous characteristics and advantages of various embodiments of the present subject matter have been set forth in the foregoing description, together with details of the structure and function of various embodiments of the subject matter, this disclosure is illustrative only. In some cases, certain subassemblies are only described in detail with one such embodiment. Nevertheless, it is recognized and intended that such subassemblies may be used in other embodiments of the subject matter. Practitioners skilled in the art will recognize many modifications and variations. Changes may be made in detail, especially matters of structure and management of parts within the principles of the embodiments of the present subject matter to the full extent indicated by the broad general meaning of the terms in which the appended claims are expressed.

Having disclosed exemplary embodiments and the best mode, modifications and variations may be made to the disclosed embodiments while remaining within the scope of the embodiments of the subject matter as defined by the following claims.

According to some embodiments, as shown in FIGS. 1 to 15, prefab modular shed structure can include a floor (1), wall panels (2), door panels (3), a door lintel (4), beam support frames (5), and a roof (6). The floor (1), wall panels (2), door panels (3), door lintel (4), and roof (6) can be made of blow-molded panels and assembled on site with a modular overlapping method. The bottom of the wall panels (2) can be detachably connected to the floor (1). According to one embodiment, the door lintel (4) can be detachably installed on the wall panels (2) and door panels (3), while the roof beam support frames (5) can be detachably installed on the wall panels (2) and door lintel (4). The roof (6) can be detachably installed on the roof's beam support frames (5).

Figure 4:
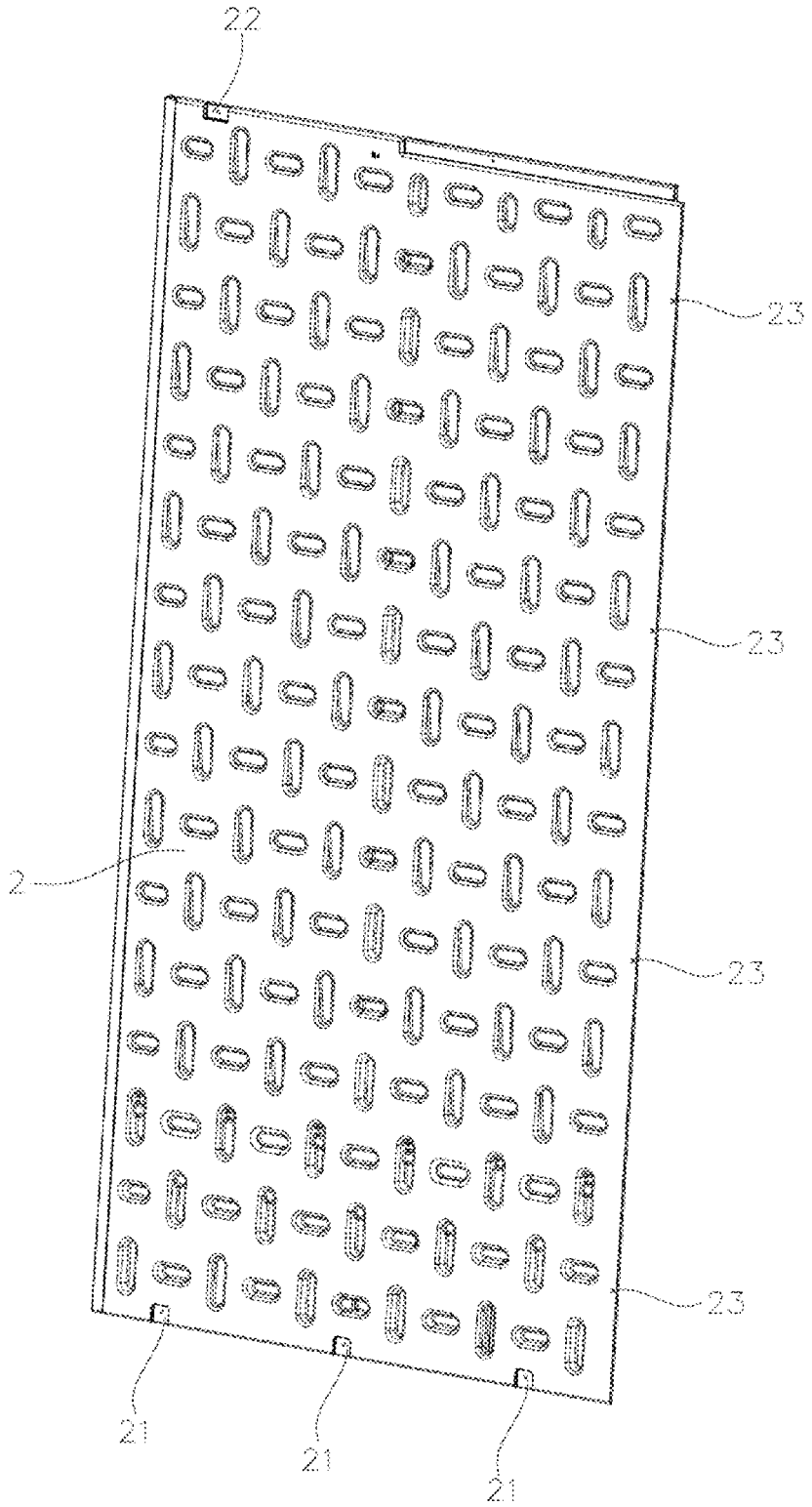
FIG. 4 is a schematic diagram of the structure of the wall panel, according to one embodiment of the present subject matter.

According to some embodiments, as shown in FIGS. 4 to 7, the wall panels (2) and floor (1) can be assembled with a specific connector designed to secure the connections within these components. According to some embodiments, FIG. 4 is an exemplary wall panel 2 of a prefab modular shed. Wall panel (2) can have recess area on one side to insert into a socket opening of the support column. The upper edge of the wall panel (2) can pre-form an upper notch (22) for connecting the panel with the roof via the connector. The lower edge of the wall panel (2) can pre-form a notch (21) for connecting with the floor (1) via the T-shaped connector 7.

According to some embodiments, a side wall can comprise two or more wall panels (2). The joint area between adjacent wall panels (2) can have corresponding screw holes (23). Self-tapping screws can pass through these screw holes (23) to connect and fix the adjacent wall panels (2). Additional coupling mechanisms, such as embedded snap couplings, can also be adopted between these wall panels.

Figure 5:
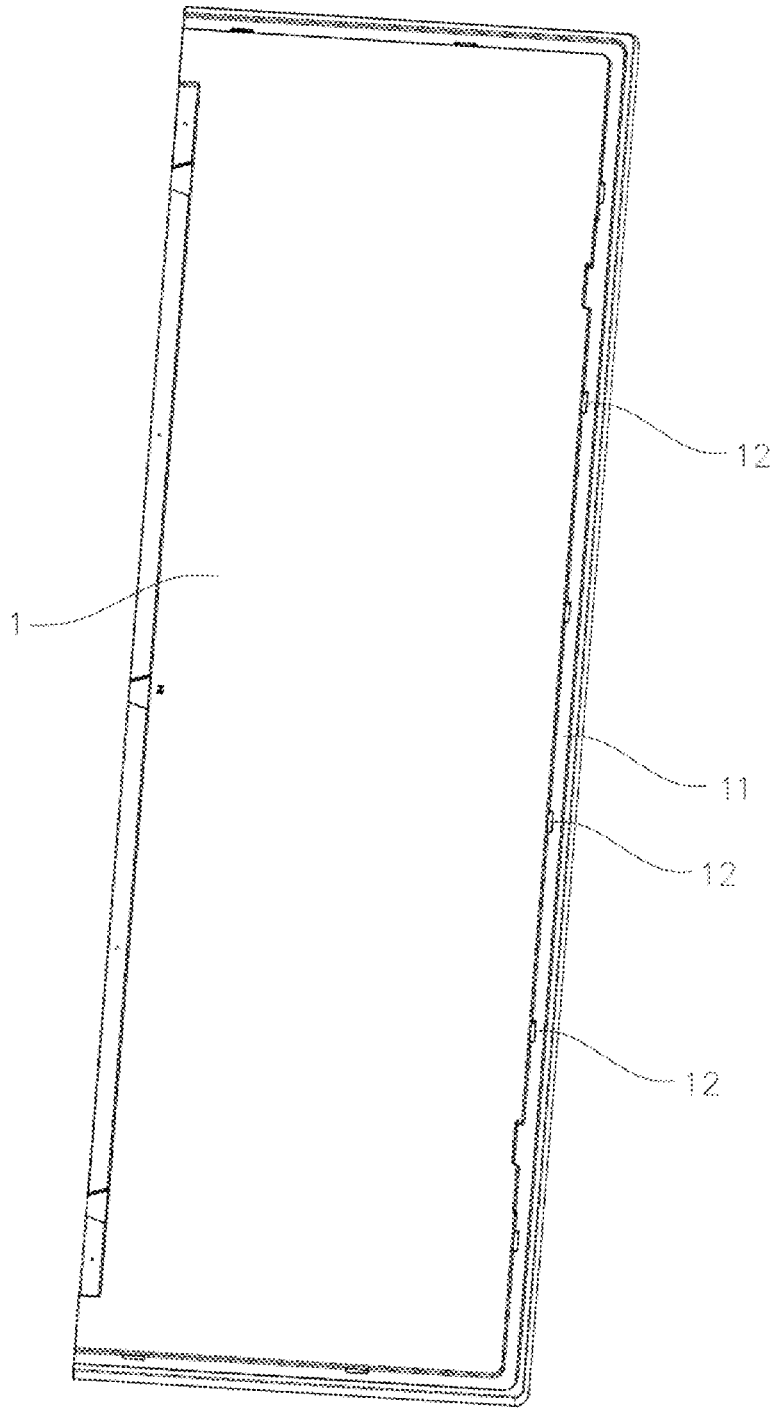
FIG. 5 is a schematic diagram of the structure of the floor, according to one embodiment of the present subject matter.

According to some embodiments, FIG. 5 is an exemplary floor panel (1) of a prefab modular shed. The edge of the floor panel (1) can have an upward-facing strip groove (11). Inside the groove (11), along its length, there can be pre-formed as partial of T-shaped mounting holes (12). The wall panel (2) can be inserted into the upward-facing strip groove (11). Furthermore, a notch (21) (see FIG. 4) molded at the lower part of the inner side of the wall panel (1) can form remaining partial of T-shaped mounting holes (12), which can receive the vertical portion of the T-shaped connector 7.

Figure 6:
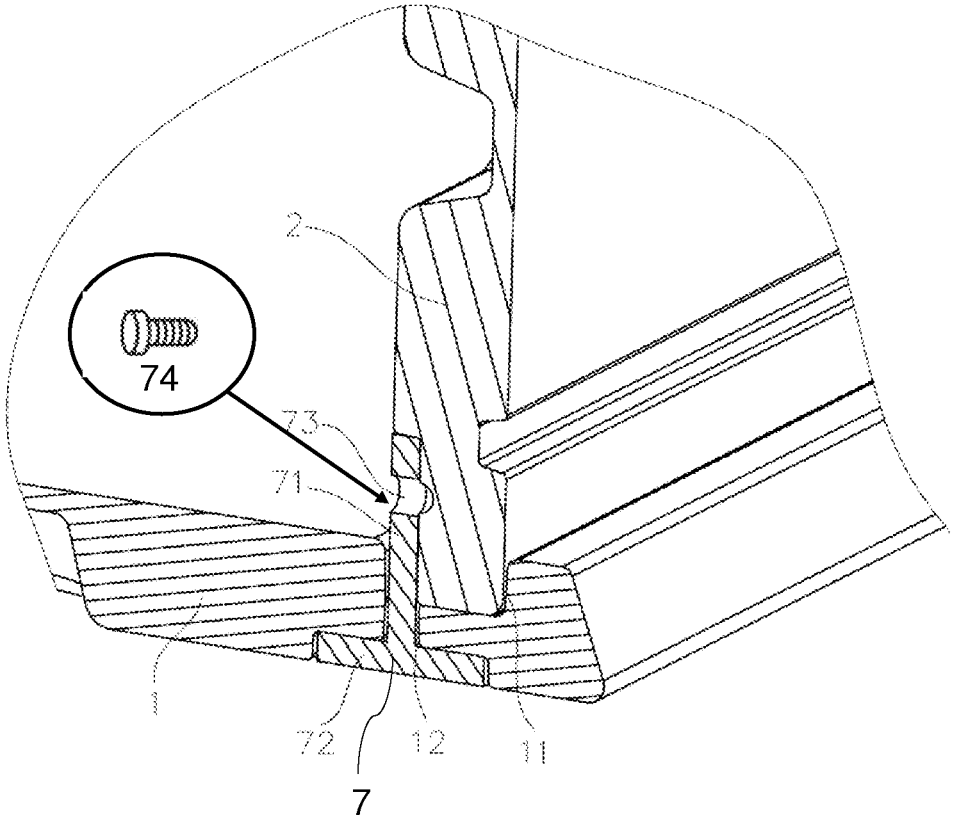
FIG. 6 is a sectional view of the assembly structure of the wall panel and the floor, according to one embodiment of the present subject matter.
Figure 7:
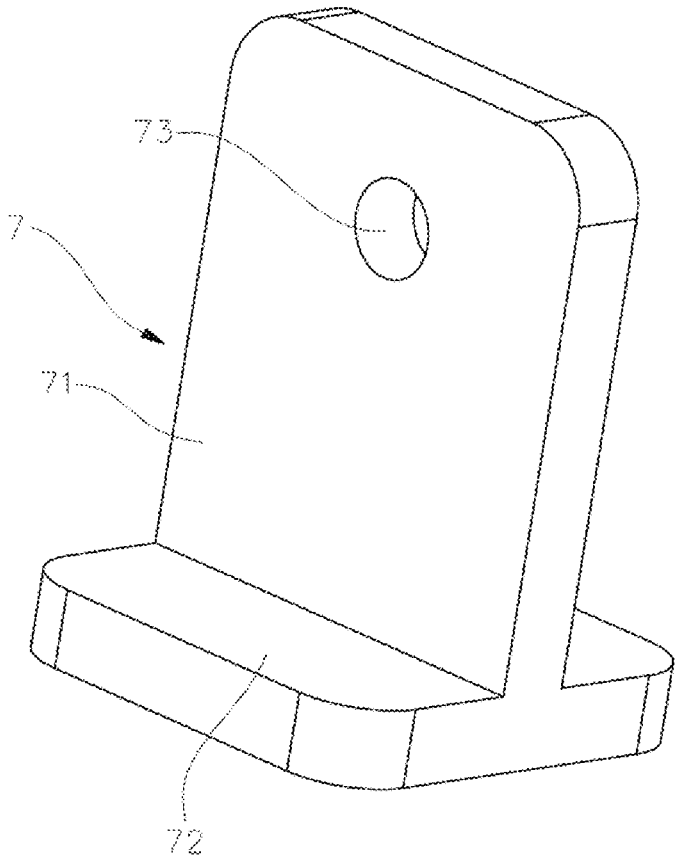
FIG. 7 is a schematic diagram of the structure of the T-shaped connector, according to one embodiment of the present subject matter.

As shown in FIG. 6, the edge of the floor (1) can have an upward-facing strip groove (11), inside which is a vertically-through T-shaped mounting hole (12) that can be distributed at intervals along its length. The wall panel (2) can be inserted from top to bottom into the strip groove (11). The coupling structure can also include a T-shaped connector (7) that corresponds to the t-shaped mounting hole (12). The vertical portion (71) of each T-shaped connector (7) can pass upward through the T-shaped mounting hole (12) and extend above the strip groove (11). The vertical portion (71) of the T-shaped connector (7) can protrude above the strip groove (11) and can be fixed to the wall panel (2), for example, via a pre-formed notch (21) embedded in the wall panel (2).

According to some embodiments, the horizontal portion (72) of the T-shaped connector (7) can engage with the bottom of the T-shaped mounting hole (12). According to some embodiments, as shown in FIG. 4, the lower part of the inner side wall of the wall panel (2) can be equipped with a number of pre-formed notches (21). The vertical portion (71) of the T-shaped connector (7) can rest into the notch (21) and can abut against the inner side wall of the wall panel (2).

According to some embodiments, a mounting hole (73) can be pre-formed in the protruding part of the vertical portion (71) above the strip groove (11). A fixation component, such as a screw 74, can connect and secure the wall panel (2) via the mounting hole (73). For example, the screw can be a self-tapping screw. In another example, a rivet can be used. As such, the T-shaped connector (7) can securely lock the wall panel (2) with the floor (1) to ensure that the wall panel (2) does not shift under external force, providing a secure assembly structure. Additionally, after installing the T-shaped connectors (7), the lower surface of the horizontal part (72) of each T-shaped connector (7) can be flush with the lower surface of the surrounding area of the strip groove (11) of the floor (1). According to some embodiments, the T-shaped connector (7) can be adopted to connect any adjacent and perpendicular panels of the modular shed.

Figure 8:
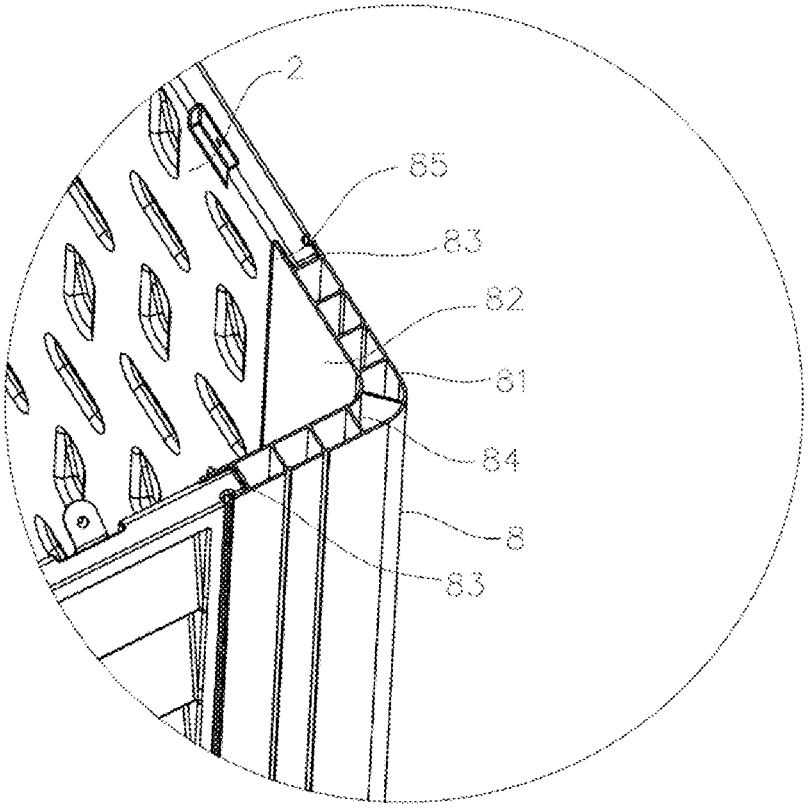
FIG. 8 is a schematic diagram of the assembly structure of the wall panel and the support column, according to one embodiment of the present subject matter.

According to some embodiments, as shown in FIG. 8, the corner connection between adjacent wall panels (2) of the shed structure can be achieved through support columns (8). The support columns (8) can be formed via injection mold and can feature reinforcing ribs vertically arranged. These support columns can have an outer support plate (81) and an inner support plate (82). To enhance the structural strength of the support columns, reinforcing ribs (84) can connect the outer and inner support plates, preventing deformation due to compression.

According to some embodiments, an opening facing the corresponding side wall panel (2) can form a socket (83) between the outer and inner support plates. The wall panels (2) are inserted into the corresponding sockets (83) with a corresponding and tight fit. Additionally, the edges of the inner support plates (82) can extend further than those of the outer support plates (81), forming an extension section (85)

that can be fixed to the wall panels (2) with screws, which can be self-tapping screws. According to some embodiments, a flat support column, instead of being a corner component, can serve as a support column and connector between adjacent wall panels (2).

Figure 14:
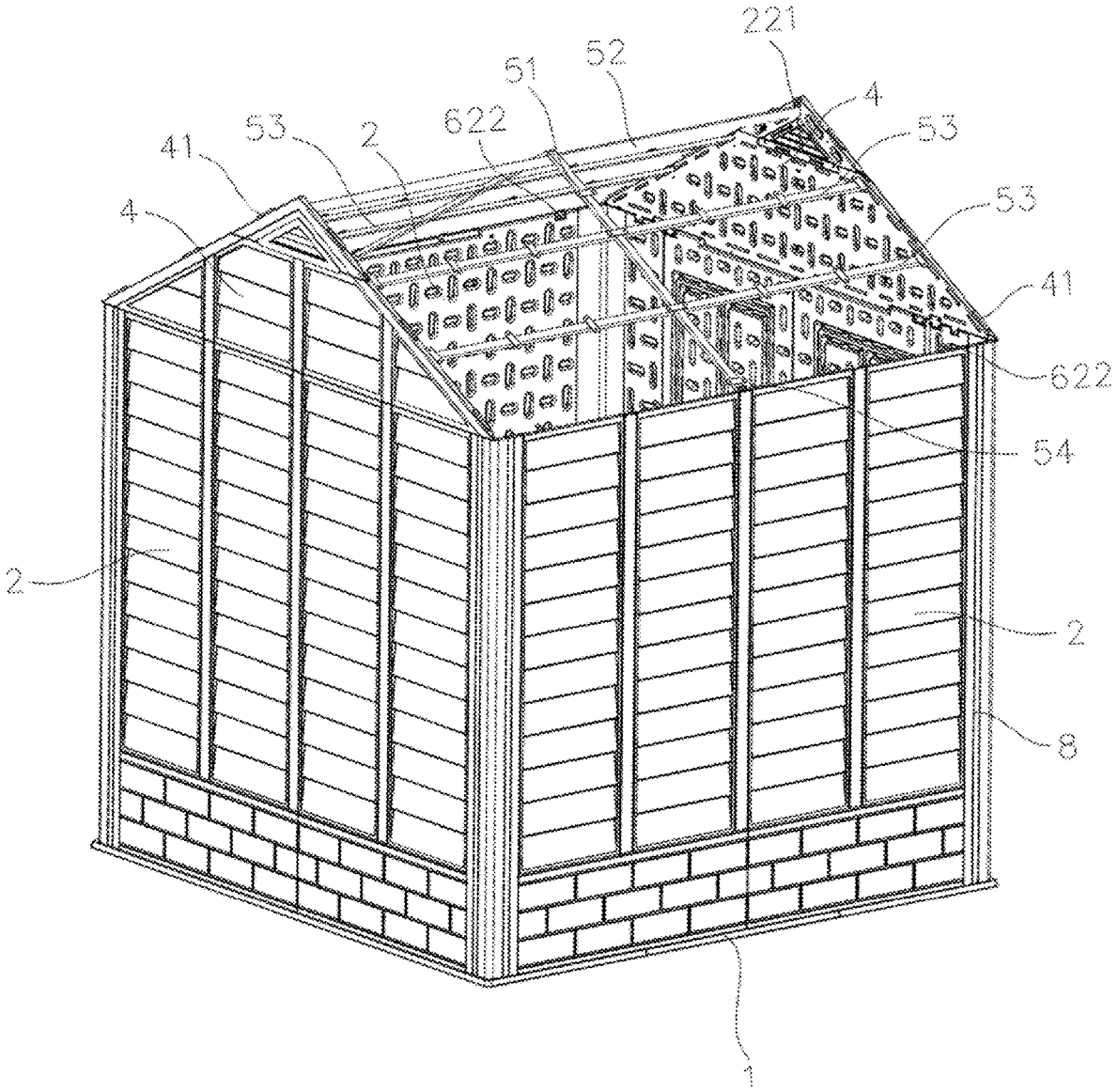
FIG. 14 is a schematic diagram of the structure of the shed structure with the roof removed, according to one embodiment of the present subject matter.
Figure 15:
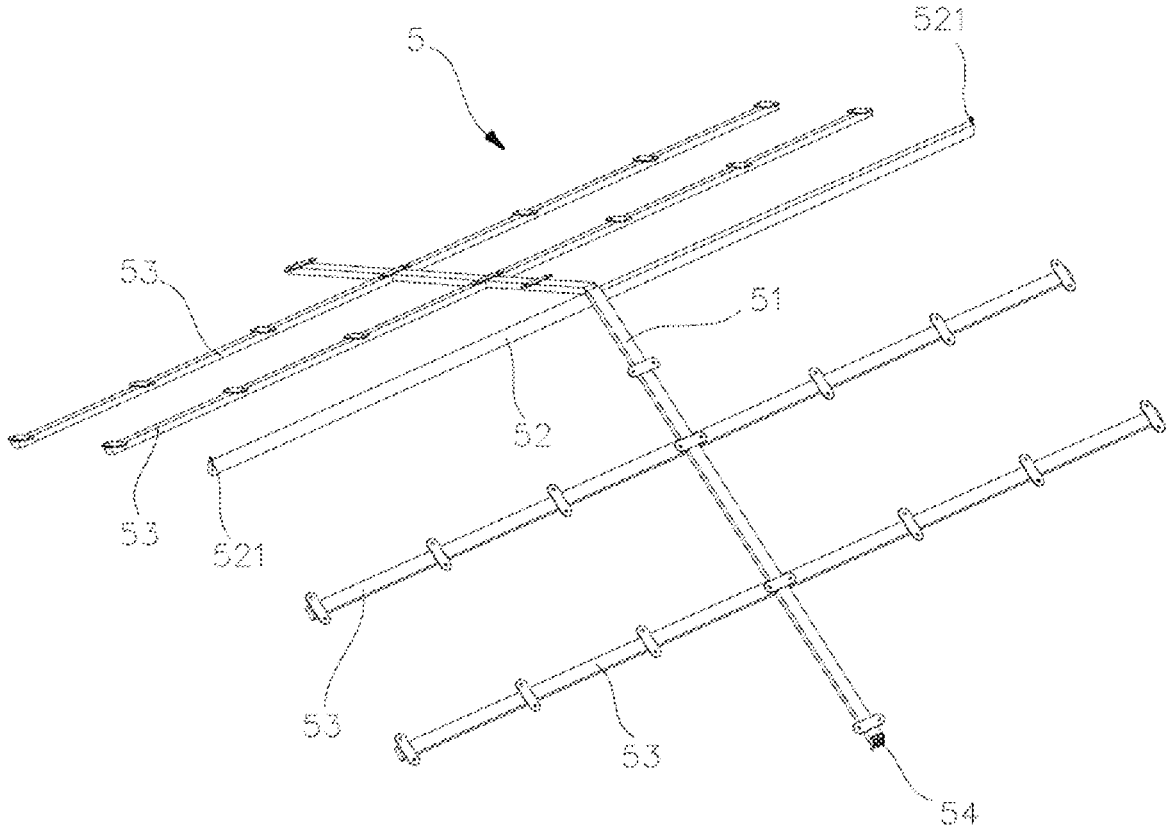
FIG. 15 is a schematic diagram of the structure of the beam support frame of the roof, according to one embodiment of the present subject matter.
Figure 16:
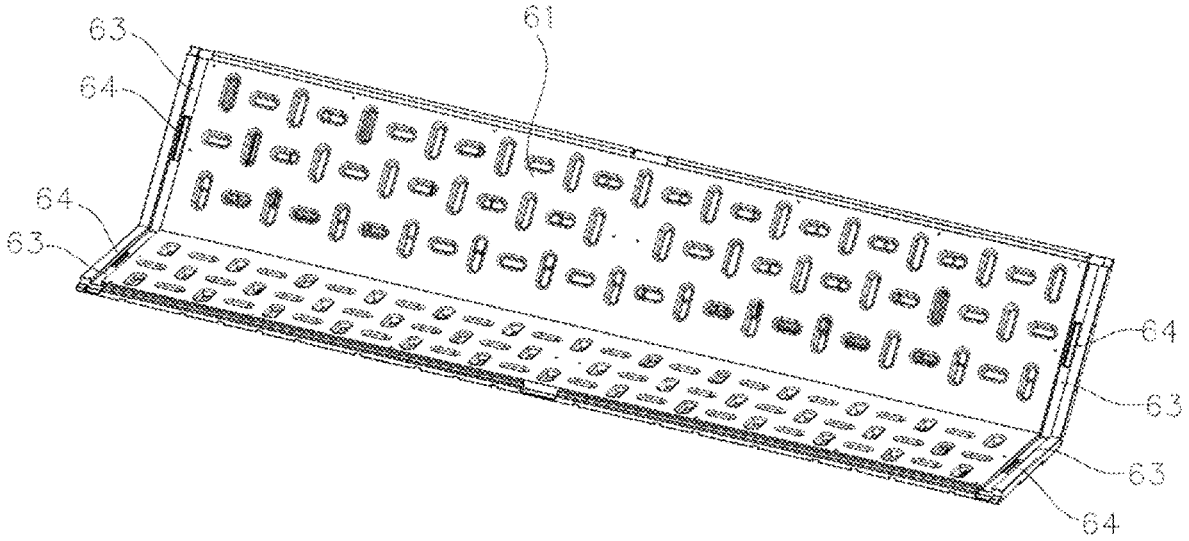
FIG. 16 is a schematic diagram of the structure of the central roof panel, according to one embodiment of the present subject matter.
Figure 17:
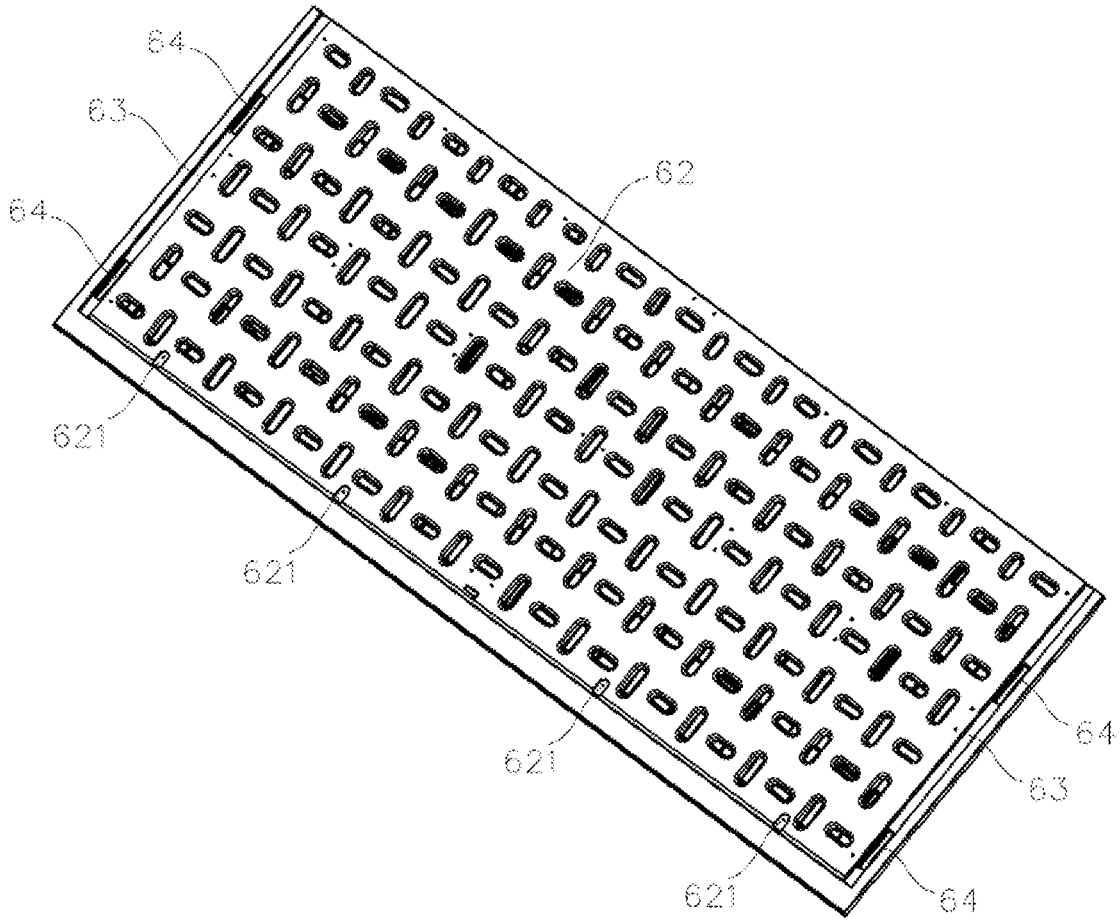
FIG. 17 is a schematic diagram of the structure of the side roof panel, according to one embodiment of the present subject matter.

According to some embodiments, as shown in FIGS. 4 and 14, the upper edge of the wall panels (2) can have an upper notch (22) where a fixing connecting piece (622) can be installed to secure the wall panels to the roof (6).

According to some embodiments, each side of the shed structure can consist of two wall panels (2). At the joints of adjacent wall panels (2), corresponding screw holes (23) can be pre-formed for screws to connect and secure adjacent wall panels (2), thus preventing separation. According to some embodiments, a shed structure can have more than two wall panels (2) on a single side, wherein the screw holes (23) can be applied between adjacent wall panels (2).

Figure 9:
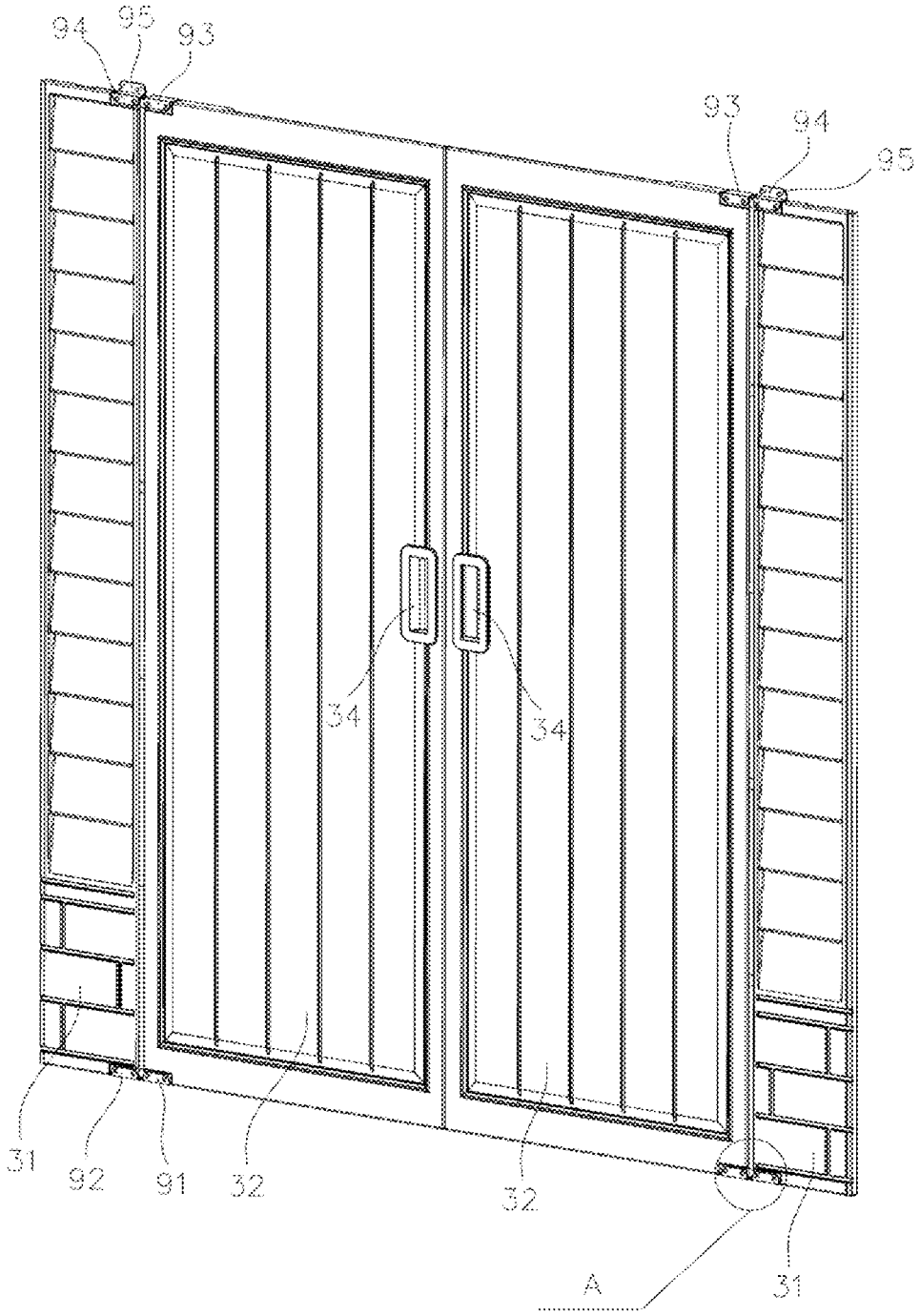
FIG. 9 is a schematic diagram of the structure of the door body, according to one embodiment of the present subject matter.
Figure 10:
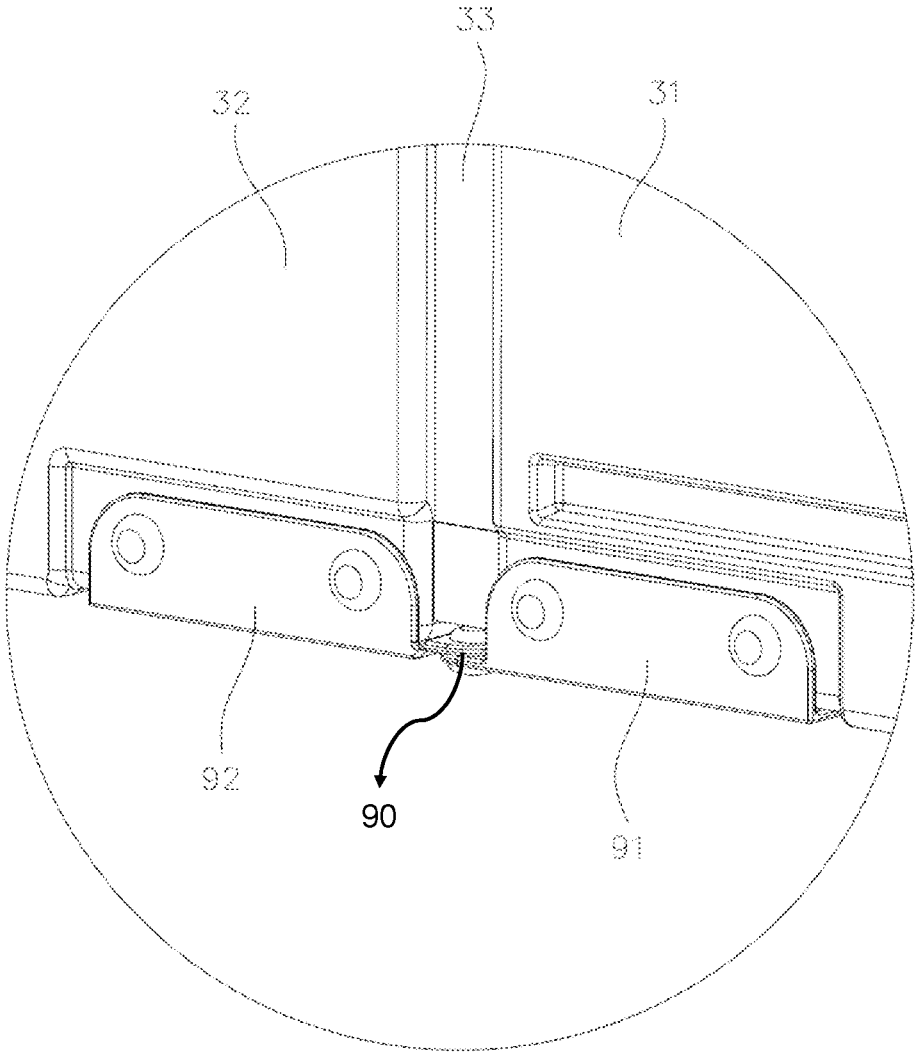
FIG. 10 is an enlarged schematic diagram of part A in FIG. 9.

According to some embodiments, as shown in FIGS. 9 to 13, the door panel (3) can include a door side panel (31) and a door body (32). The door body (32) and the door side panel (31) can integrally formed via blow molding as one piece. They can be connected through a embedded folding groove (33) that are molded integrally with both the door side panel (31) and the door body (32), allowing the door body (32) to rotate relative to the door side panels (31). As shown in FIG. 10, the embedded folding groove 33 can have thinner plastic materials than the side panel 31 or the door body 32.

Figure 12:
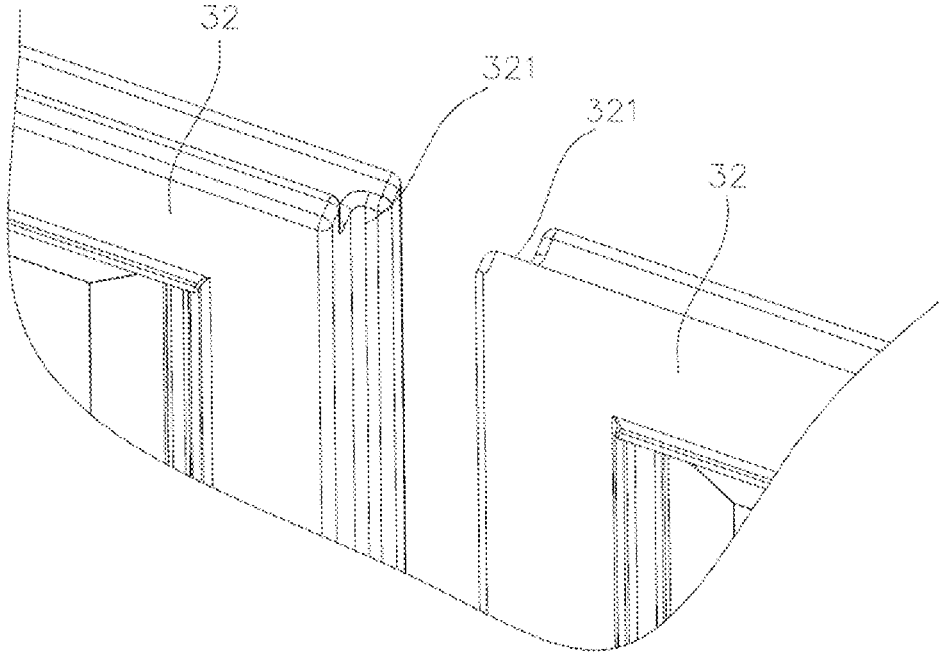
FIG. 12 is a schematic diagram of the staggered coupling structure of the folding door, according to one embodiment of the present subject matter.
Figure 13:
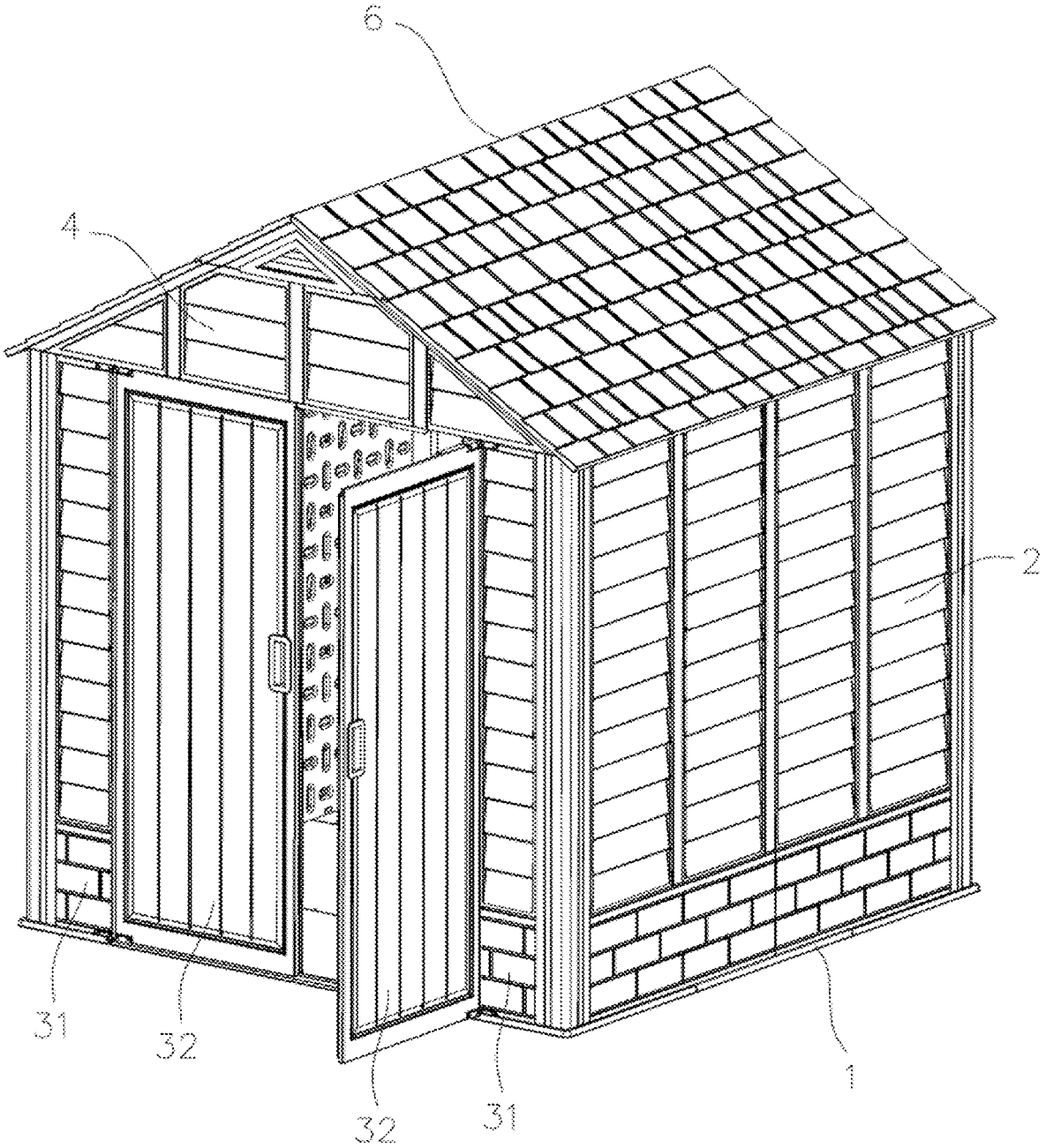
FIG. 13 is a schematic diagram of the shed structure according to one embodiment of the present subject matter with the rear door open.

According to some embodiments, as shown in FIG. 9, the door structure can adopt a dual door design. Both the door side panels (31) and the door bodies (32) can come in pairs, with the door side panels (31) positioned outside the corresponding door bodies (32). As shown in FIG. 12, the fitting edges of the two door bodies (32) can have staggered interlocking structures (321) to render an optimized closure and to prevent rainwater from seeping into the shed structure.

Figure 11:
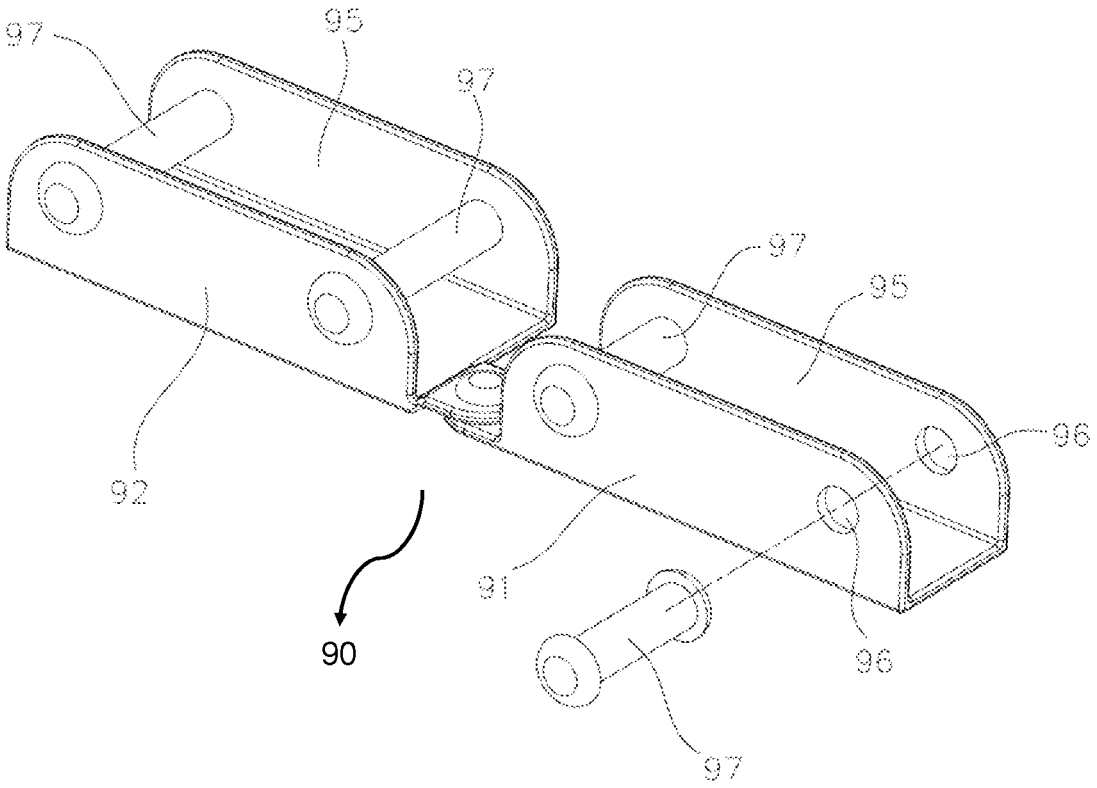
FIG. 11 is a schematic diagram of the structure of the support member, according to one embodiment of the present subject matter.

According to some embodiments, a pivotable frame bracket can encase the edge of the rotating panels to increase the strength and durability of the door. As shown in FIGS. 10 and 11, the pivotable frame bracket (90) can comprise a pair of rotatable support members affixed to the pivotable joint of the door panel to reinforce the door structure. For example, as shown in FIG. 10, the bottom of the door side panel (31) near the door body (32) can be equipped with a first support member (92), whereas the bottom of the door body (32) is equipped with a second support member (91). The first support member (92) and the second support member (91) can be rotatably connected to each other. The embedded folding groove (33) can be positioned above the rotational connection of the first and second support members (92, 91).

Additionally, the top of the door side panel (31) near the door body (32) can be equipped with a third support member (94), whereas the top of the door body (32) can have a fourth support member (93). The third and fourth support members (94, 93) can be also rotatably connected, with the embedded folding groove (33) placed under their rotational connection. By supporting the door structure with these support members, it can prevent the door panel (3) from sagging over time and avoid torsion problems due to unsynchronized movement of the door panel (3). According to some embodiments, each support member can be equipped with a U-shaped fixed groove (95) that wraps around a panel's edge and functions as a frame enforce bracket to improve structural stability.

According to some embodiments, the pivotable frame bracket can comprise metal components with U-shaped fixed groove (95). The door side panel (31) and door body (32) can be constrained within the corresponding U-shaped grooves. The side walls of the U-shaped fixed groove (95) can have through holes (96), and corresponding mounting holes can be provided on the corresponding positions of the door side panel (31) and door body (32). A fixation component, such as a pin or screw (97), can pass through these mounting holes and through holes (96) to secure the respective support members to the door side panel (31) and door body (32).

According to some embodiments, as shown in FIG. 9, the door body (32) can feature a recessed door handle (34). The recessed design can ensure a flat and aesthetically pleasing door surface while also reduce packaging space during transportation.

According to some embodiments, as shown in FIGS. 14 to 17, the door lintel (4) is triangular-shaped under the roof (6). The door lintel (4) can comprise an upper and lower separated components, allowing the panel size to match the width of other panels for easier packaging. The upper component of the lintel can comprise a ventilation window (42) to facilitate circulation within the shed structure.

According to some embodiments, the rear door lintel (4) can be fixed to the wall panel (2) through a connector, while the front door lintel (4) can be connected to the door panels (3) through other connectors.

According to some embodiments, the roof (6) can include a central roof panel (61) and two side roof panels (62) that are respectively located on either side of the central roof panel (61). The central roof panel (61) and side roof panel (62) can be both constrained by limit structures to the door lintel (4) and can be fixed on the roof beam support frame (5).

According to some embodiments, the connection structure between the central roof panel (61), side roof panel (62), and the door lintel (4) can comprise: a downward slot (63) at the bottom edge of the roof (6) corresponding with the top edge of the triangular door lintel (4). The top edge of the triangular door lintel can be inserted into the downward slot (63) so that the roof's edge can encase the top edge of the triangular door lintel (4). The top of the triangular door lintel can be provided with a limiting protrusion (41). The downward slot (63) can further provide a limiting groove (64) into which the limiting protrusion (41) can be engaged, creating a fixation structure. According to some embodiments, the limiting protrusion (41) can include spaced, strip-shaped protrusions that fit into the limiting groove (64) to prevent the roof (6) from sliding down.

According to some embodiments, the roof beam support frame (5) can include a central beam column (51), central crossbars (52), and side crossbars (53). The central beam column (51) can be arranged parallel to the door lintel (4), while the central crossbars (52) and side crossbars (53) can be arranged on the central beam column (51). According to some embodiments, the ends of the central crossbars (52) can be fixed to the triangular door lintel, whereas the side crossbars (53) can be fixed to the roof (6).

According to some embodiments, the central beam column (51) can be foldable at the center, allowing its length to reduce to half when disassembled. This way, this foldable column can be stored within a reasonably-sized packaging box. Furthermore, under external pressure or weight, the foldable, sloped column can share and distribute the weight on the roof (6).

According to some embodiments, the ends of the central beam column (51) can be fixed to the wall panels (2) through connectors (54). For example, the connectors (54) can be injection-molded parts. The rectangular openings of these parts can be inserted into the square openings of the central beam column (51), which can be secured to the wall panels (2) with screws to enhance support.

According to some embodiments, the terminals of the central crossbars (52) can have protruding connection plates (521), which can secure the central crossbars (52) to the door lintel (4). The ends of the side crossbars (53) can either be fixed to the side roof panel (62), or be fixed to the door lintel (4).

According to some embodiments, the side crossbars (53) can serve to connect the central roof panel (61) with the side roof panels (62). According to some embodiments, the side crossbars (53) can connect the side roof panel (62) with the door lintel (4) on either side of the central beam column (51), enhancing the roof's load-bearing capacity.

According to some embodiments, the roof (6) can cover the beam support frame (5) and can be fixed to the central beam column (51) and side crossbars (53). According to some embodiments, before installation, the central roof panel (61) can be a flat blow-molded panel in its unfolded state. When it is installed, the central roof panel (61) can bend, via an embedded and integrated folding groove, at a certain angle to form a roof peak matching the door lintel (4). The embedded folding groove can be manufactured by injecting less or thinner plastic material than the rest of the panel, thus rendering a soft area that is flexible and pivotable. The middle of the central roof panel (61) can be fixed to the central beam column (51), while its sides can be connected and fixed to the roof side panels (62) through the adjacent side crossbars (53).

According to some embodiments, the top surfaces of the central roof panel (61) and side roof panels (62) can form a stepped structure (65) that gradually descends from the middle towards both sides. This layered design can prevent rainwater from entering the interior of the shed structure.

According to some embodiments, the lower edge of the side roof panels (62) can be equipped with positioning slots (621) at intervals along its length. A number of connectors (622) can be installed within these slots. The connectors (622) can be made of metal or plastic. The side roof panels (62) can be secured via the matching grooves of the wall panels (2) using these connectors (622), enhancing the stability of the wall panels and preventing the side roof panels (62) from sliding or being dislocated.

Figure 18:
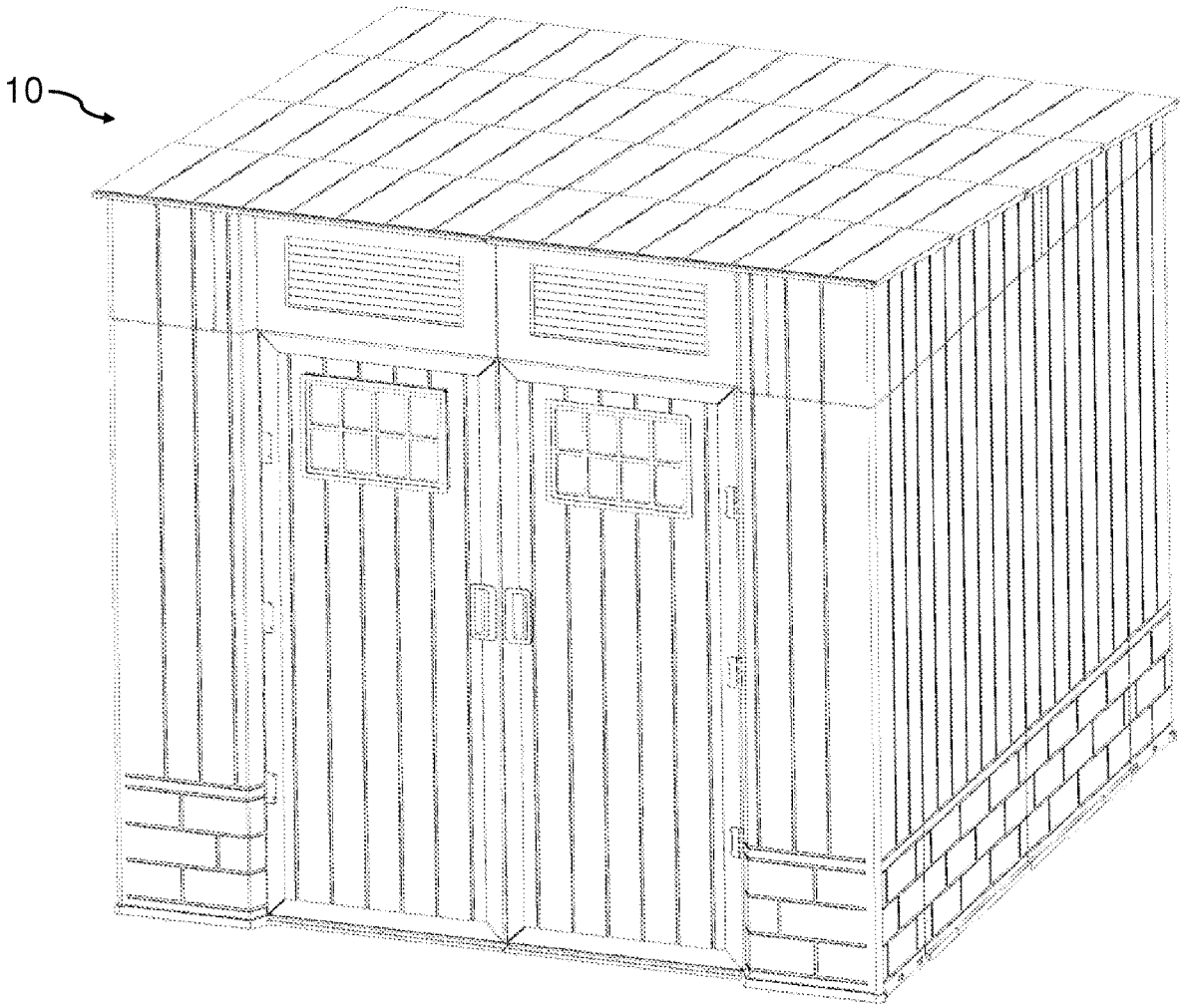
FIG. 18 is a perspective view of an embodiment of the present subject matter with the front door closed.
Figure 19:
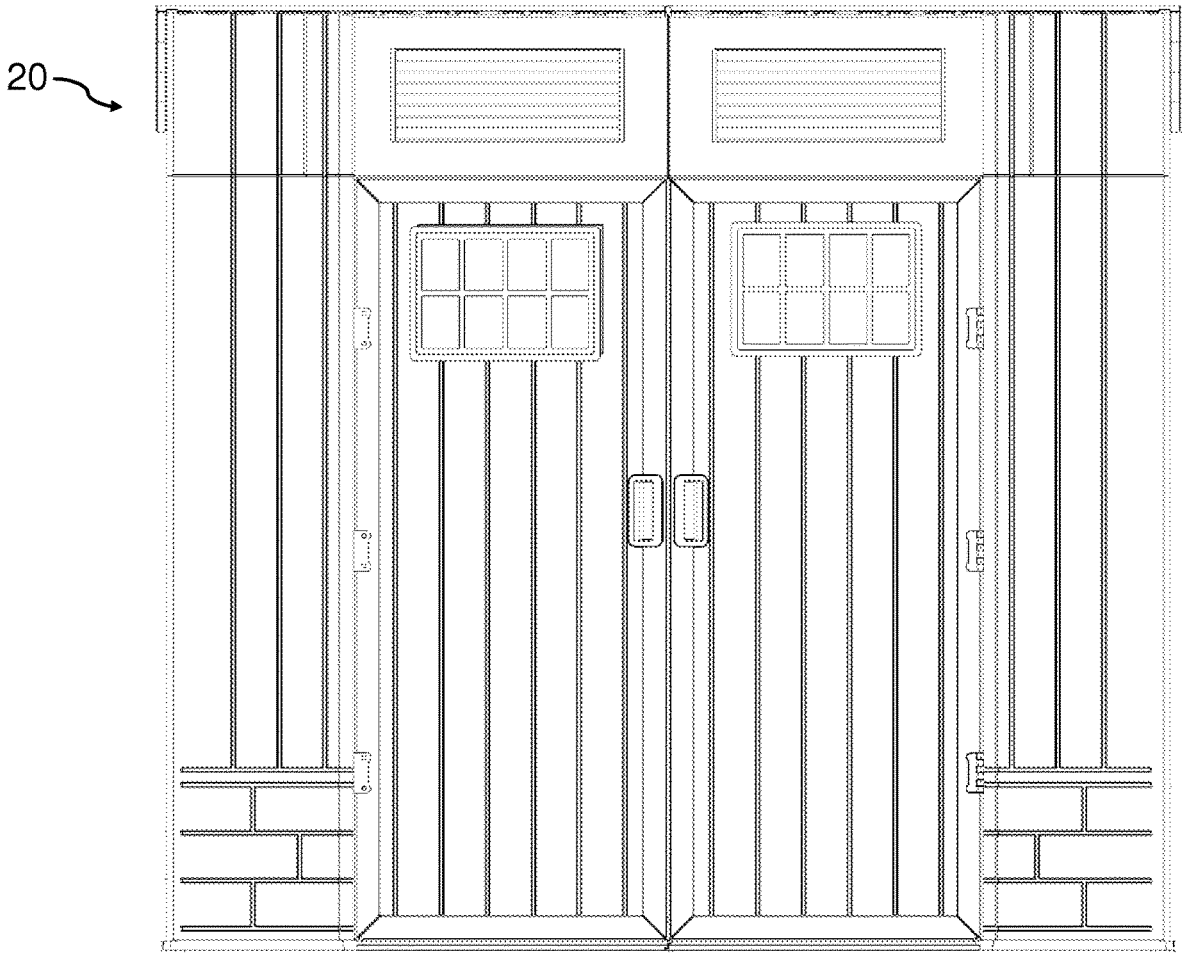
FIG. 19 is a front view of an embodiment of the present subject matter.
Figure 20:
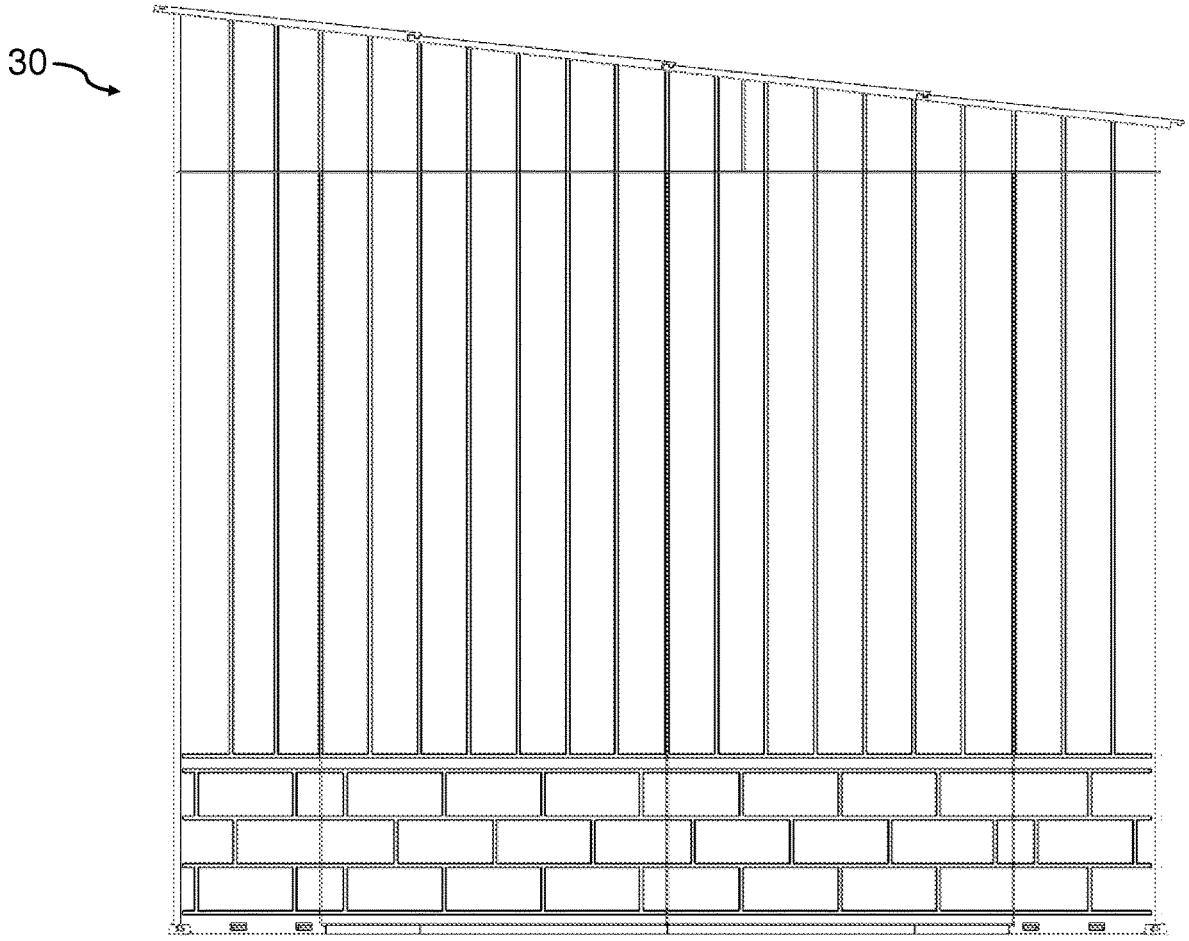
FIG. 20 is a first side view of an embodiment of the present subject matter.
Figure 21:
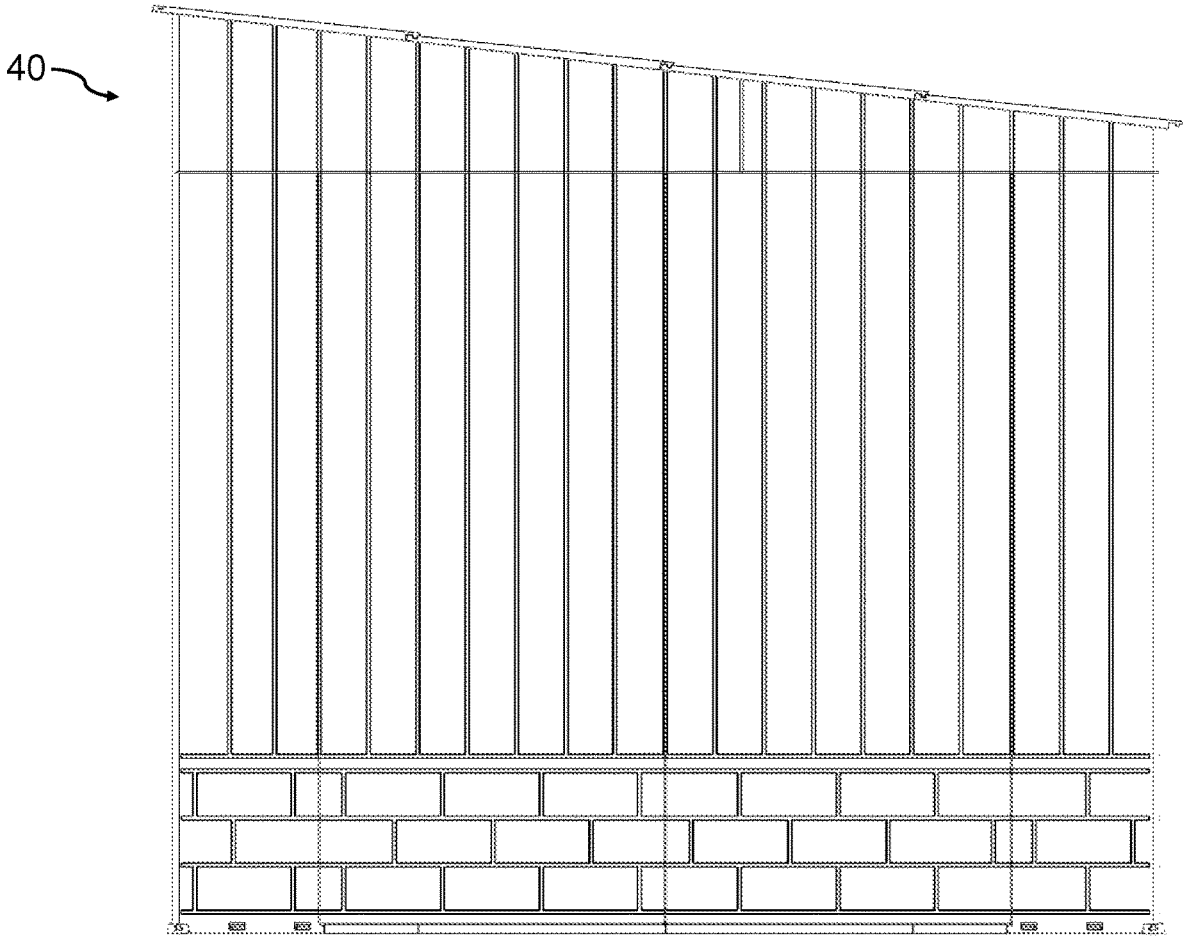
FIG. 21 is a second side view of an embodiment of the present subject matter.
Figure 22:
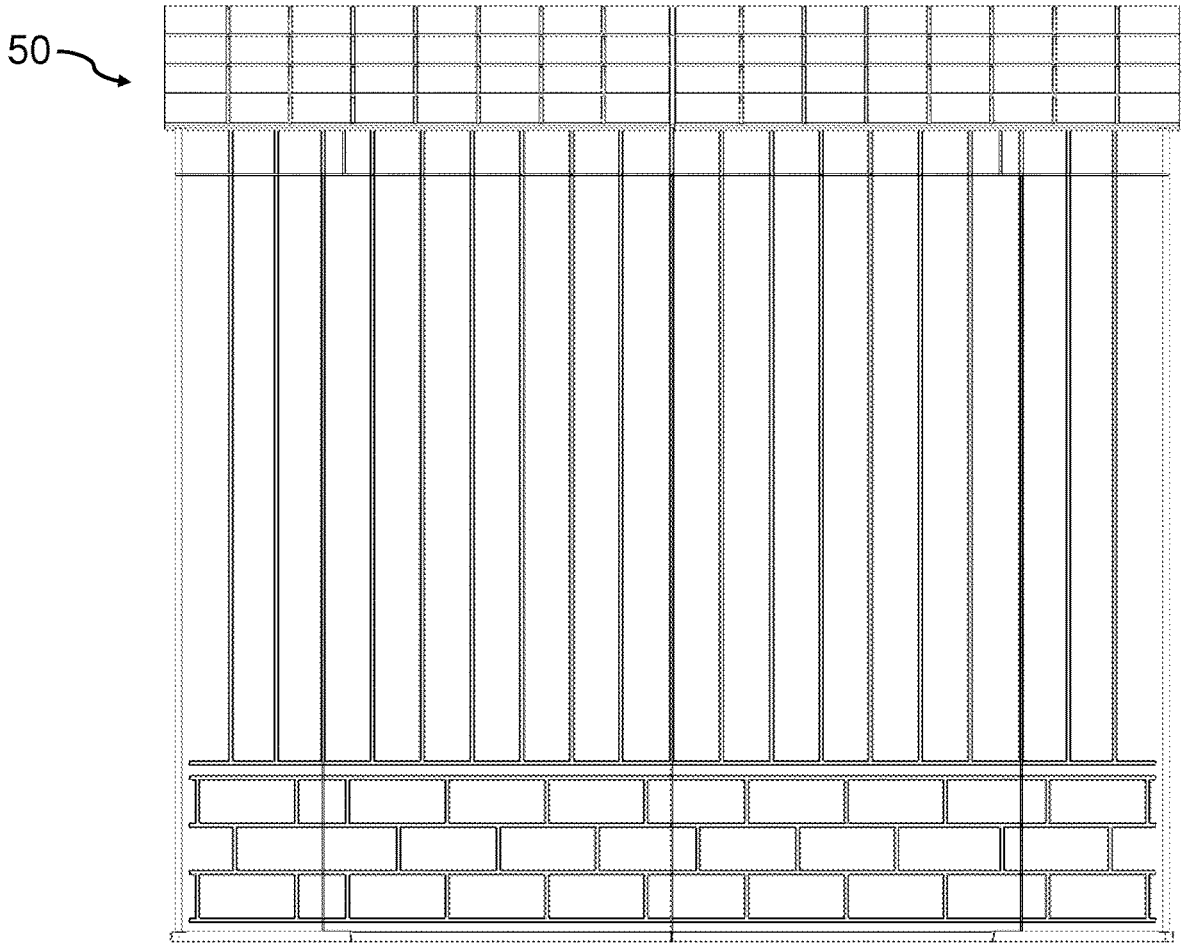
FIG. 22 is a rear view of an embodiment of the present subject matter.
Figure 23:
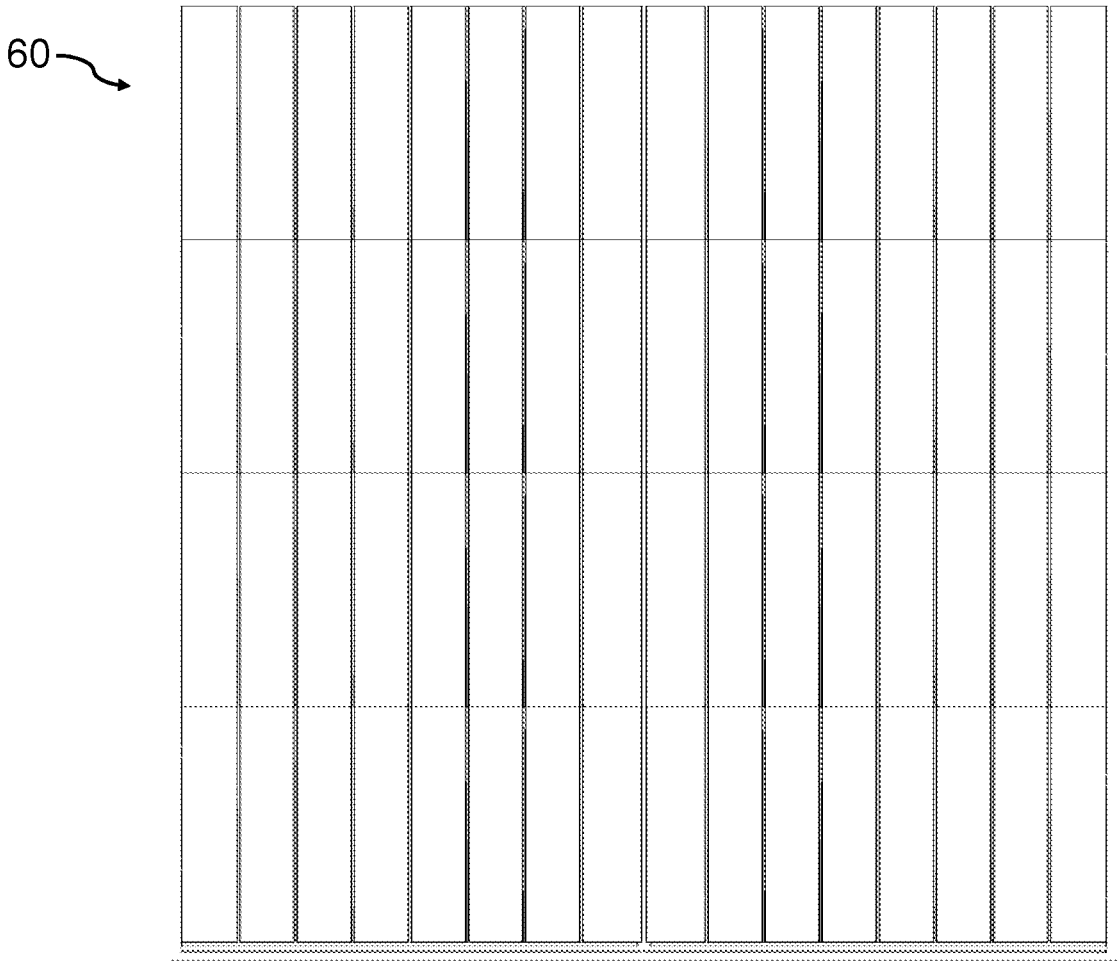
FIG. 23 is a top plan view of an embodiment of the present subject matter.

FIG. 18 is a perspective view 10 of an outdoor storage shed. The outdoor storage shed 10 can be made of molded plastic components or non-molded plastic panels that are durable and versatile. The plastic panels can be configured and manufactured in a substantially similar shape and size. This way, the package of the panels is more compact, resulting in reduced transportation cost. FIG. 19 is a front view 20 of an outdoor storage shed. FIG. 20 is a first side view 30 of an outdoor storage shed. FIG. 4 is a second side view 40 of an outdoor storage shed. FIG. 22 is a rear view 50 of an outdoor storage shed. FIG. 23 is a top view 60 of an outdoor storage shed.

Figure 24:
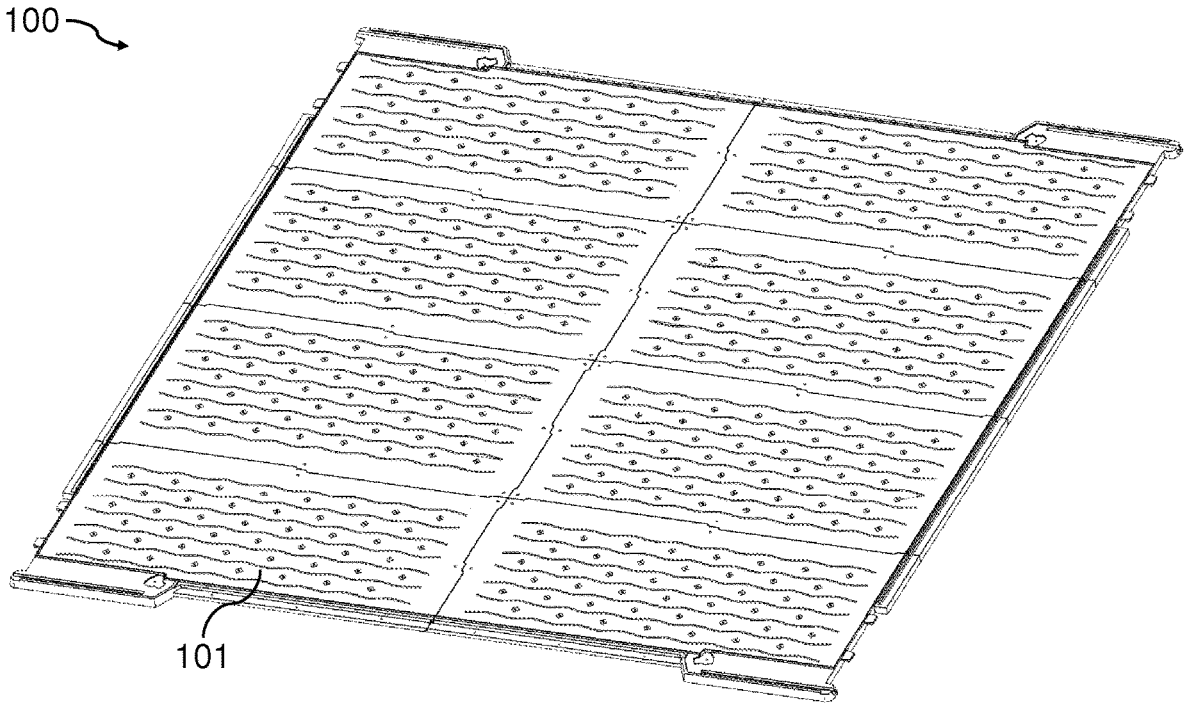
FIG. 24 is an exterior view of a floor of an embodiment of the present subject matter.

FIG. 24 is an exterior view of a floor 100 of an embodiment of the present subject matter. It shows the floor exterior 101 when floor 100 has been constructed by assembling a number of molded plastic panels. Floor 100 can provide a ground covering for a storage shed structure, which can not only provide an even surface but also prevent rain and dirt to enter the shed.

Figure 25:
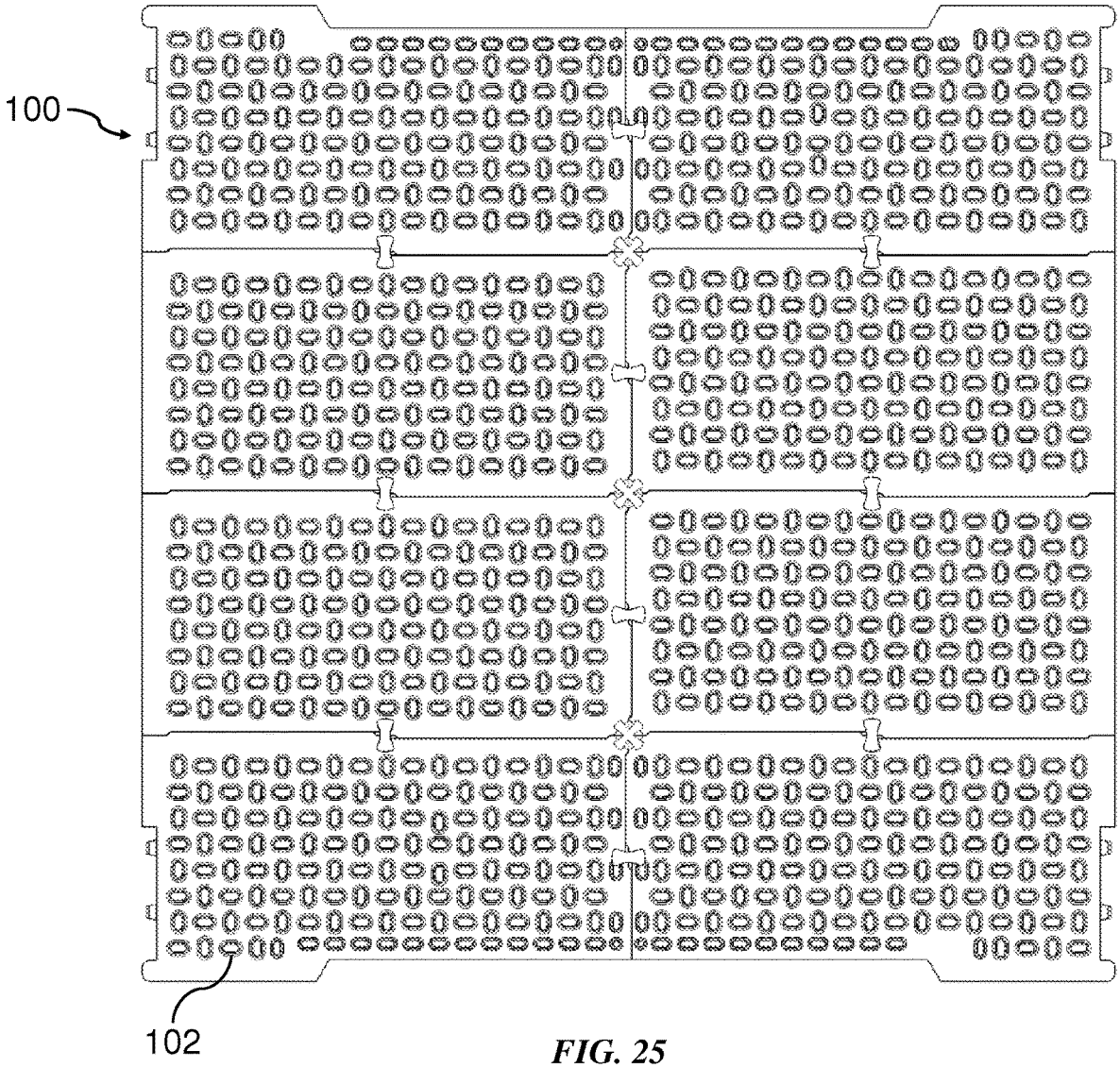
FIG. 25 is an interior view of a floor of an embodiment of the present subject matter.

FIG. 25 is an interior view of a floor 100 of an embodiment of the present subject matter. It shows the floor interior 102 when floor 100 has been assembled. As shown in this drawing, evenly spaced and symmetrically arranged back strengthening ribs are arranged in the floor interior 102 to provide enhanced stability of the plastic panel. According to some embodiments, such back strengthening ribs can comprise vertical support grooves and horizontal support grooves. In particular, each vertical support groove can be encircled by a plurality of horizontal support grooves. In addition, each horizontal support groove can be surrounded by a plurality of vertical support grooves.

Figure 26:
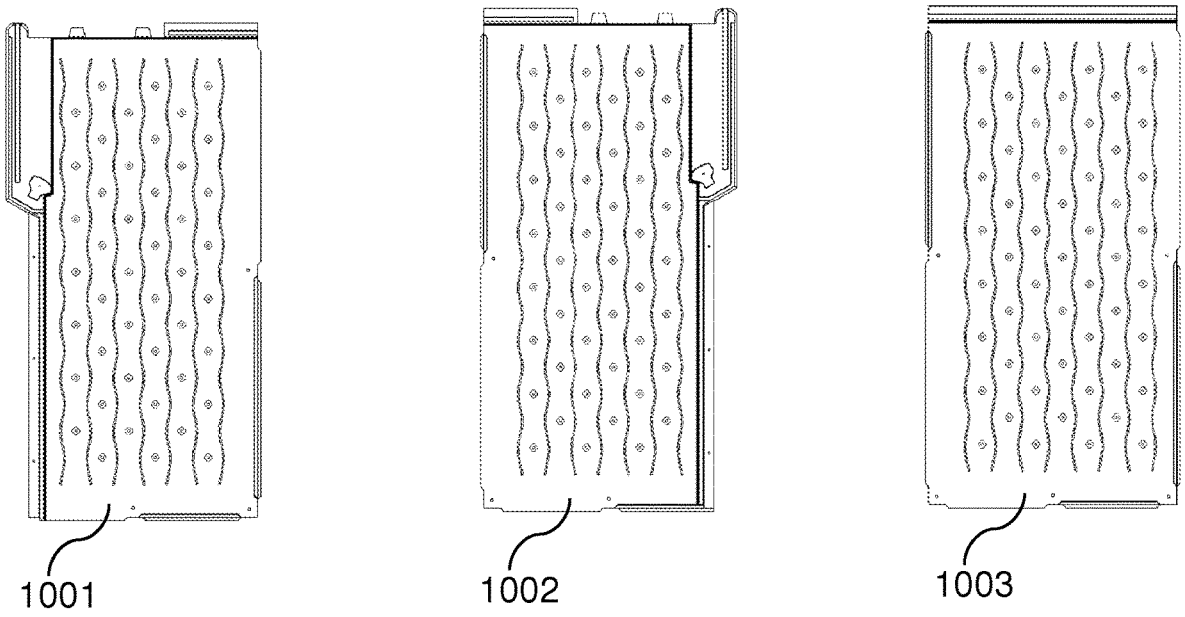
FIG. 26 shows multiple uninstalled floor panels of an embodiment of the present subject matter.

FIG. 26 shows multiple uninstalled individual floor panels of an embodiment of the present subject matter. The individual floor panels can comprise a first corner edge floor panel 1001, a second corner edge floor panel 1002, and a transitional floor panel 1003. A corner edge floor panel, serving as the corner of a floor, can have two sides that can be coupled with wall panels. A transitional floor panel, which can be positioned in a non-corner location, may have one or none side available for connection to the wall panel(s).

Figure 27:
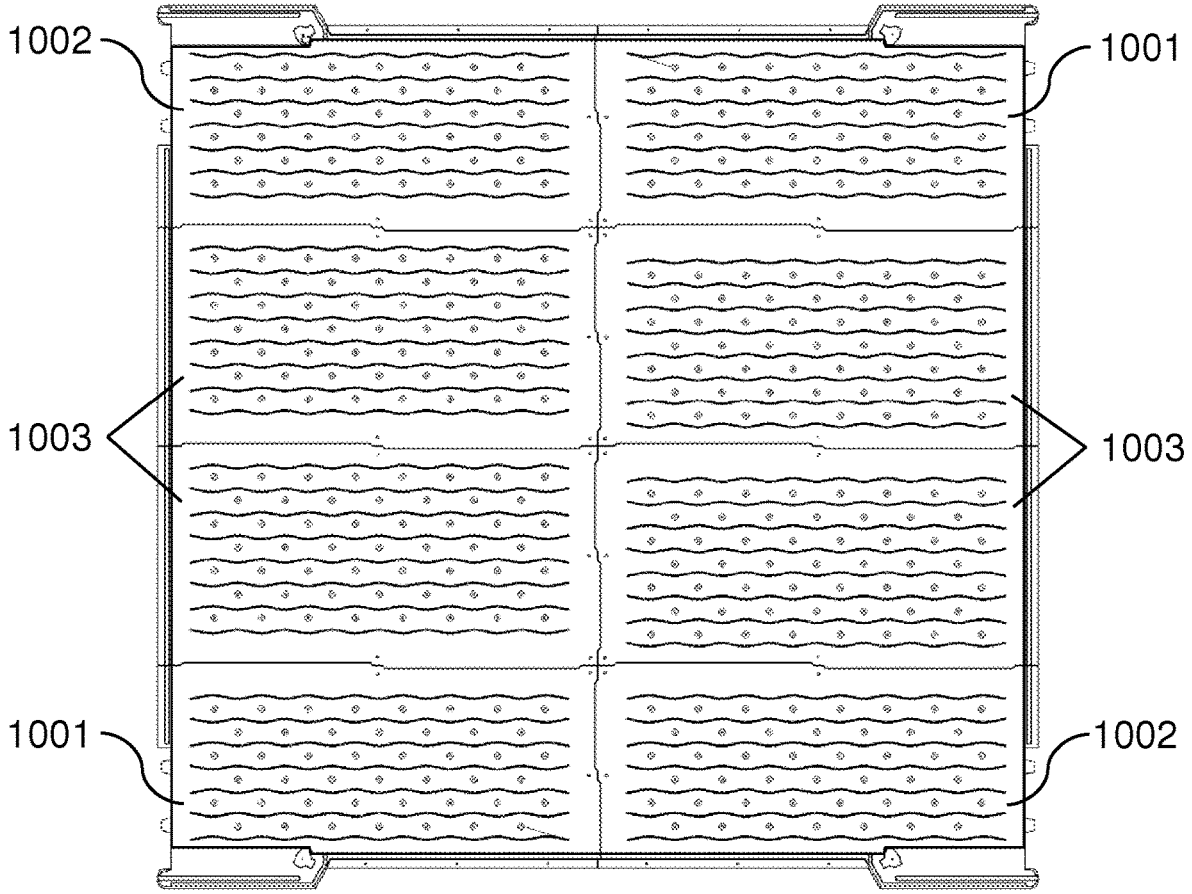
FIG. 27 shows multiple installed floor panels of an embodiment of the present subject matter.

FIG. 27 shows multiple installed floor panels of an embodiment of the present subject matter. As shown in this drawing, first corner edge floor panel 1001 and second corner edge panel 1002 can function as corners of a floor, while transitional floor panel 1003 can be inserted in between the corner panels to constitute a portion of the floor. According to some embodiments, additional transitional floor panels can be added to extend the size of the floor to render a customizable-sized storage room. To make such extensions and adjustments possible, each floor panel can be substantially identical in shape and size, thereby further enhancing the efficiency of product packaging and transportation.

Figure 28:
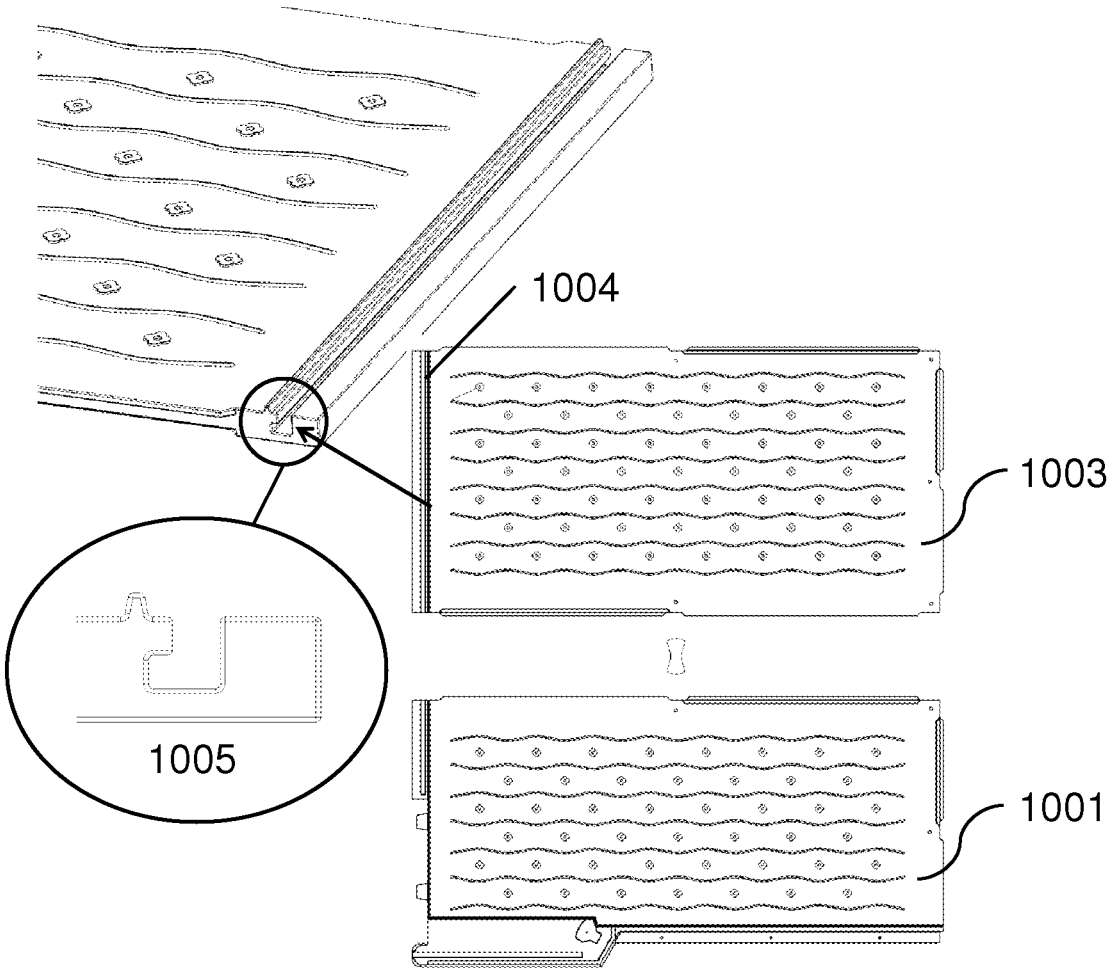
FIG. 28 shows an exploded view of an embodiment of the present subject matter.

FIG. 28 shows an exploded view of an embodiment of the present subject matter. First corner edge floor panel 1001 can be joined to the transitional floor panel 1003 using interlocked teeth couplings and supplementary connectors. According to some embodiments, the transitional floor panel 1003's first side has a first slider rail 1004, which could feature an L-shaped groove or rail 1005 designed to accommodate an L-shaped slider located on a wall panel. In other embodiments, the slider rail can incorporate a T-shaped or differently-shaped groove designed to house a corresponding slider for connecting with a wall panel.

First corner edge floor panel 1001 can be coupled to transitional floor panel 1003 via interlocked teeth couplings and additional connectors. According to some embodiments, a first side of transitional floor panel 1003 has a first slider rail 1004, which could comprise a L-shaped groove or rail 1005 configured to receive a L-shaped groove arranged on a wall panel. According to some embodiments, the slider rail could be a T-shaped or differently-shaped groove configured to received a corresponding slider for coupling with a wall panel.

Figure 29:
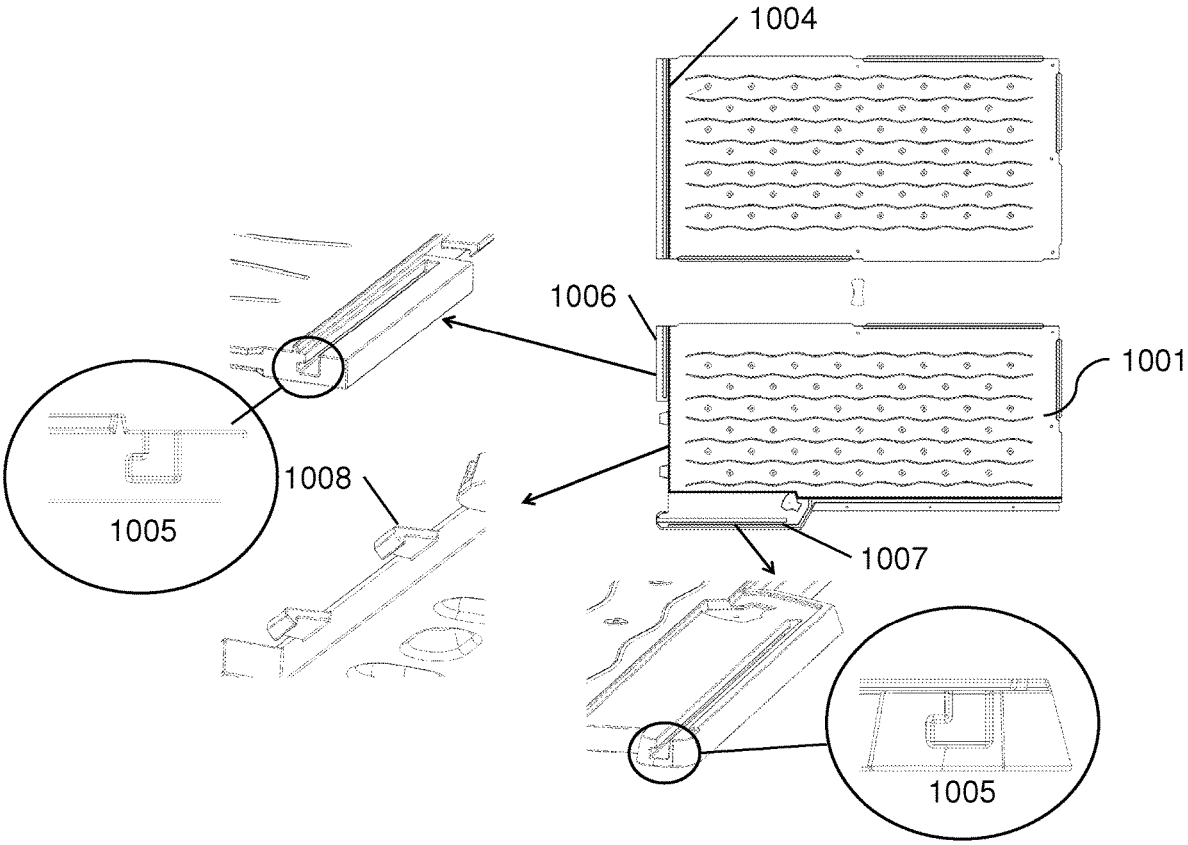
FIG. 29 shows another exploded view of an embodiment of the present subject matter.

FIG. 29 shows another exploded view of an embodiment of the present subject matter. As shown in this drawing, a first side of corner edge floor panel 1001 has a second slider rail 1006 designed to continue from the first slider rail 1004. The second slider rail 1006 can comprise a L-shaped groove 1005 that is configured to receive the same L-shaped slider arranged on a wall panel. In addition, the first side of the corner edge floor panel 1001 further has one or more clips 1008 configured to engage with clip slots arranged on the wall panel.

According to some embodiments, a corner edge floor panel 1001 can incorporate two distinct coupling mechanisms on the same side. For example, a slider coupling, such as 1006, can be positioned adjacent to and in alignment with clips 1008. Consequently, a wall panel that couples to the corner edge floor panel can possess two corresponding coupling structures, such as a slider bar and clip slots, on the same side. Furthermore, these two different coupling mechanisms can each employ a contrasting engagement style, i.e., projecting vs. receiving, to enhance the connecting force and stability between the panels. For example, a panel can feature a projected coupling portion, like clips, on one side, and a receiving coupling portion, such as a slider rail, on another side.

According to some embodiments, a second side of corner edge floor panel 1001 has a third slider rail 1007 that comprises another L-shaped groove 1005 for coupling to another wall panel. According to some embodiments, the second side of corner edge floor panel 1001 can have a different coupling portion, such as clips or clip slots.

Figure 30:
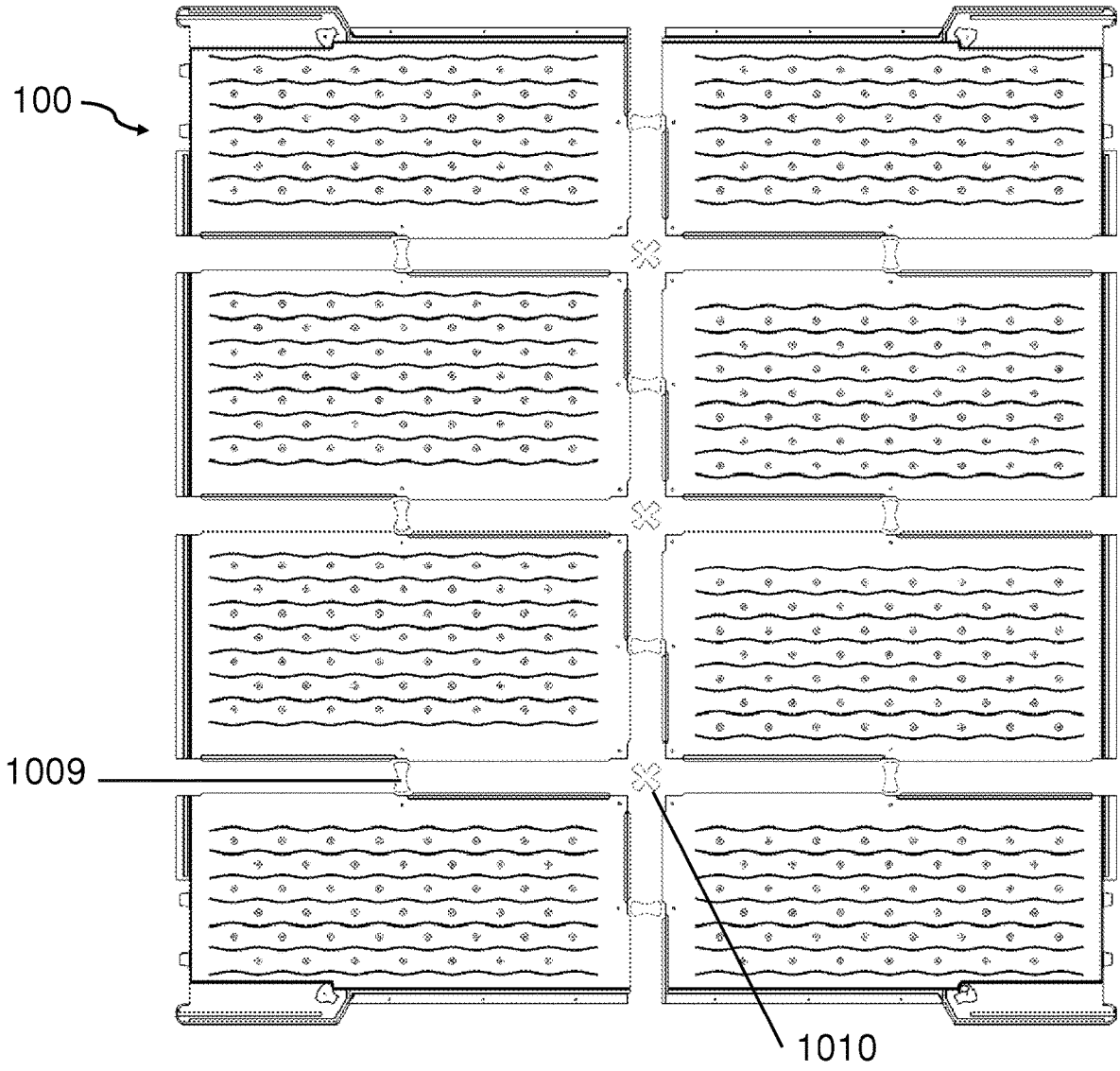
FIG. 30 shows multiple installed floor panels via connectors, according to an embodiment of the present subject matter.

FIG. 30 shows multiple installed floor panels via connectors, according to an embodiment of the present subject matter. Floor 100 can comprise corner edge floor panels and transitional floor panels that are connected by more than one coupling mechanism. For example, butterfly connector 1009 can fix two coupled panel boards, whereas cross connector 1010 can secure four coupled panel boards.

Figure 31:
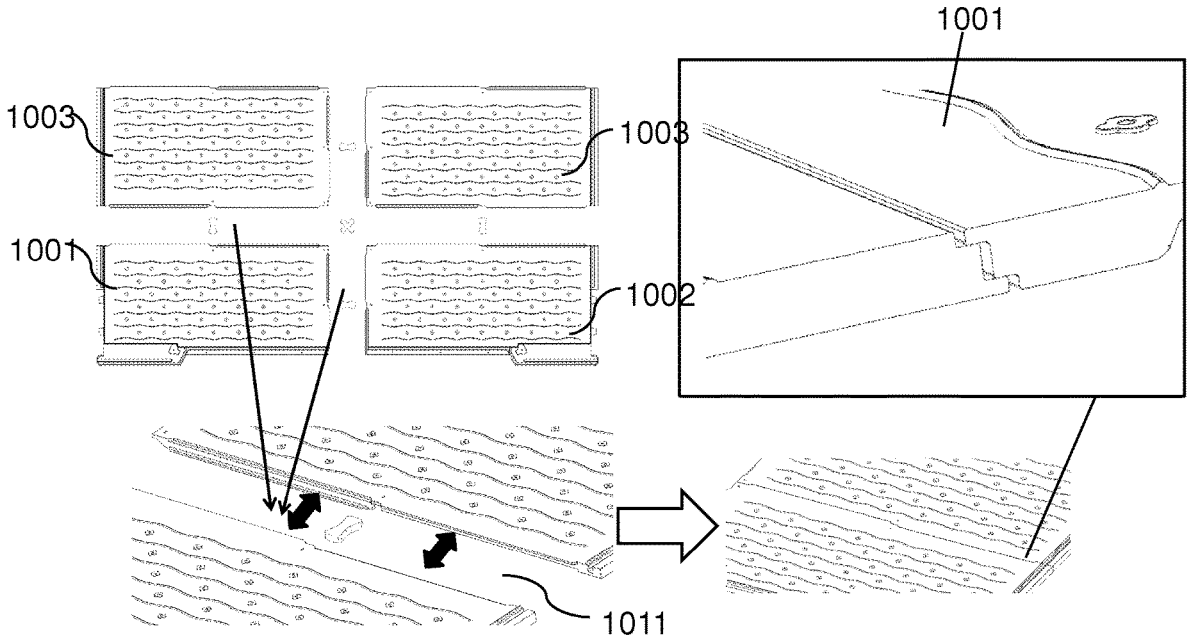
FIG. 31 shows multiple installed floor panels via connectors and interlocked teeth couplings, according to an embodiment of the present subject matter.

FIG. 31 shows multiple installed floor panels via connectors and interlocked teeth couplings, according to an embodiment of the present subject matter. A plurality of interlocked teeth couplings 1011 can securely connect two neighboring panels, e.g., first corner edge floor panel 1001 and transitional floor panel 1003, first corner edge floor panel 1001, and second corner edge floor panel 1002. The interlocked teeth couplings can have corresponding ledged portions that match each other to provide more surface contact and support, as shown in the exploded view. Furthermore, the interlocked teeth couples can create a straight and simple seam on the exterior side of the connected panels.

Figure 32:
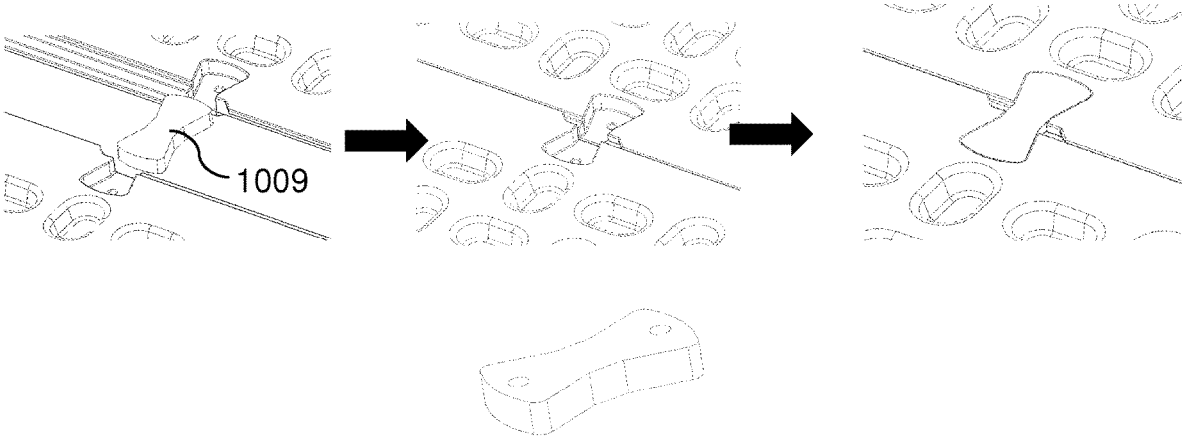
FIG. 32 shows an exploded view of an embodiment of the present subject matter.

FIG. 32 shows an exploded view of an embodiment of the present subject matter. As shown in these drawings, a butterfly connector 1009 can be inserted into the pre-manufactured slot formed by the two joined panels, which can be further affixed to the panels using a screw or another fastening tool.

Figure 33:
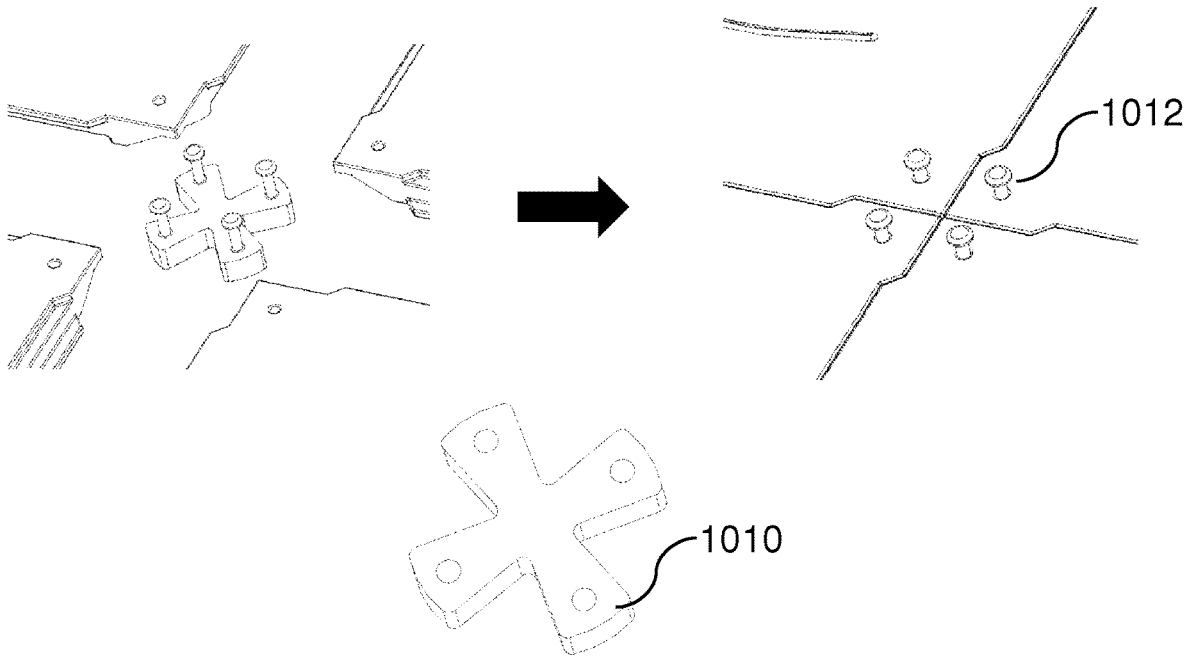
FIG. 33 shows another exploded view of an embodiment of the present subject matter.

FIG. 33 shows another exploded view of an embodiment of the present subject matter. According to some embodiments, a cross connector or a double-butterfly connector 1010 can be inserted into the pre-manufactured slot formed by four neighboring panels, which can be further affixed using a screw 1012 or another fastening tool.

Figure 34:
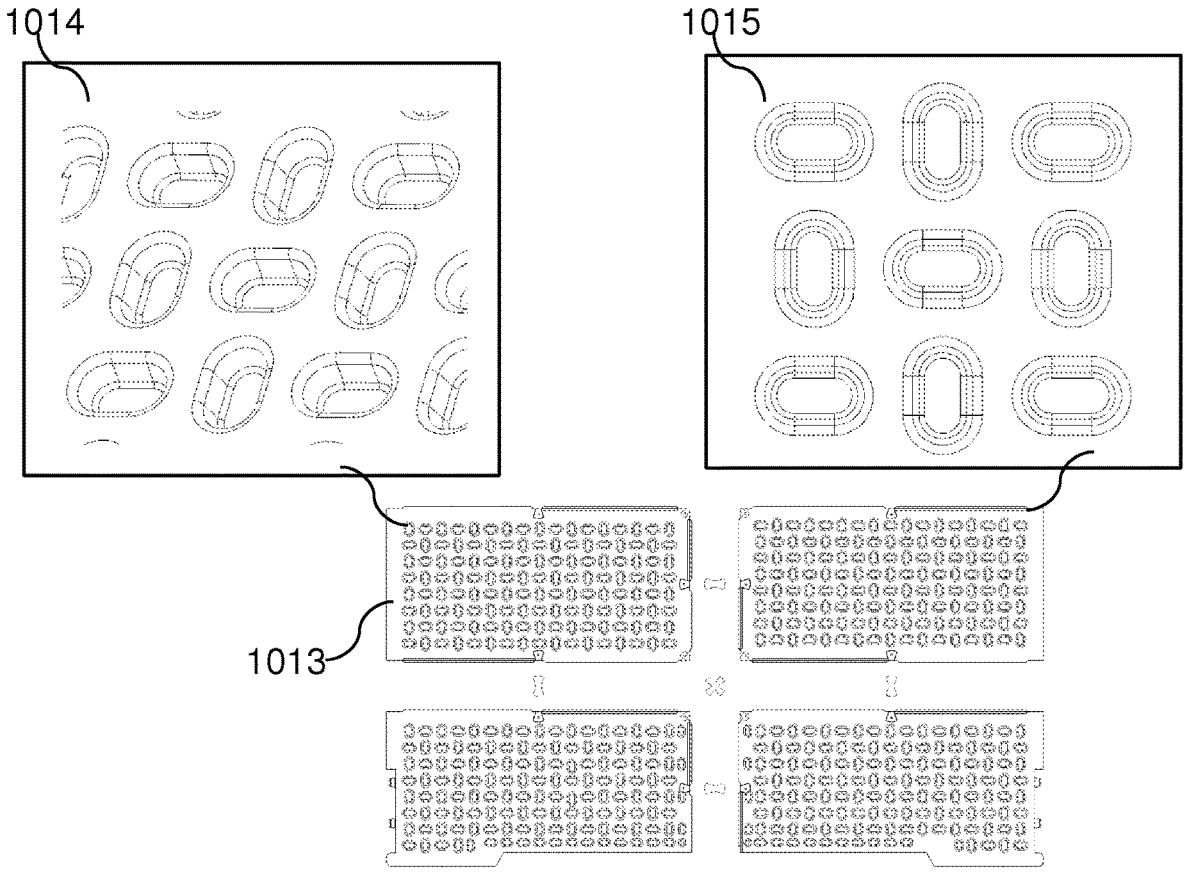
FIG. 34 shows back strengthening ribs of a molded plastic panel, according to an embodiment of the present subject matter.

FIG. 34 shows back strengthening ribs of a molded plastic panel, according to an embodiment of the present subject matter. A molded plastic panel can comprise a number of back strengthening ribs 1013 that comprise vertical support grooves and horizontal support grooves. A vertical or horizontal support groove can create an indent and touch point for the two layers of a molded plastic panel, which increase its durability and stability. In particular, each vertical support groove can be encircled by a plurality of horizontal support grooves. In addition, each horizontal support groove can be surrounded by a plurality of vertical support grooves. Such a balanced switch between the two orientations of the oval support grooves can maximize the intended benefits of the grooves. Furthermore, a side view 1014 of back strengthening ribs 1013 is displayed along with a top view 1015 of them.

Figure 35:
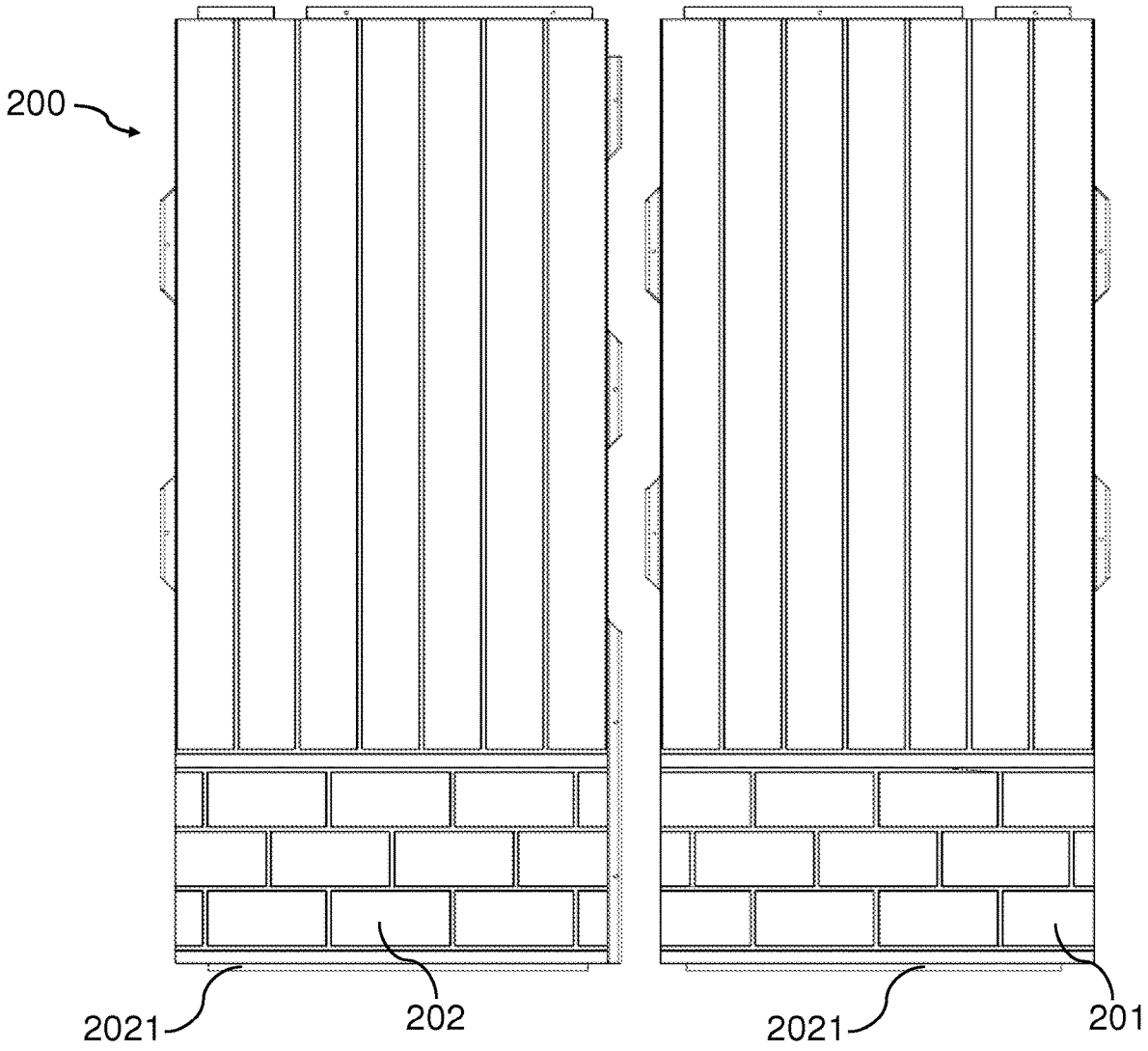
FIG. 35 shows a front view of flat wall panels, according to an embodiment of the present subject matter.

FIG. 35 shows a front view of flat wall panels, according to an embodiment of the present subject matter. According to some embodiments, the outdoor storage shed's side walls can consist of both flat panels and foldable corner panels, which can form the shed structure's four corners. Alternatively, according to some embodiments, the shed's side walls can include only foldable corner panels, thereby omitting any flat panels. As depicted in FIG. 18, the flat panel 200 may include a basic flat panel 201, which has symmetrical interlocking teeth or portions on both sides. There is also an extension flat panel 202 that can be optional and can be used for enlarging the storage shed. A slider rail 2021 for coupling with one or more floor panels can be arranged on the bottom side of the basic flat panel 201 and the extension flat panel 202.

Figure 36:
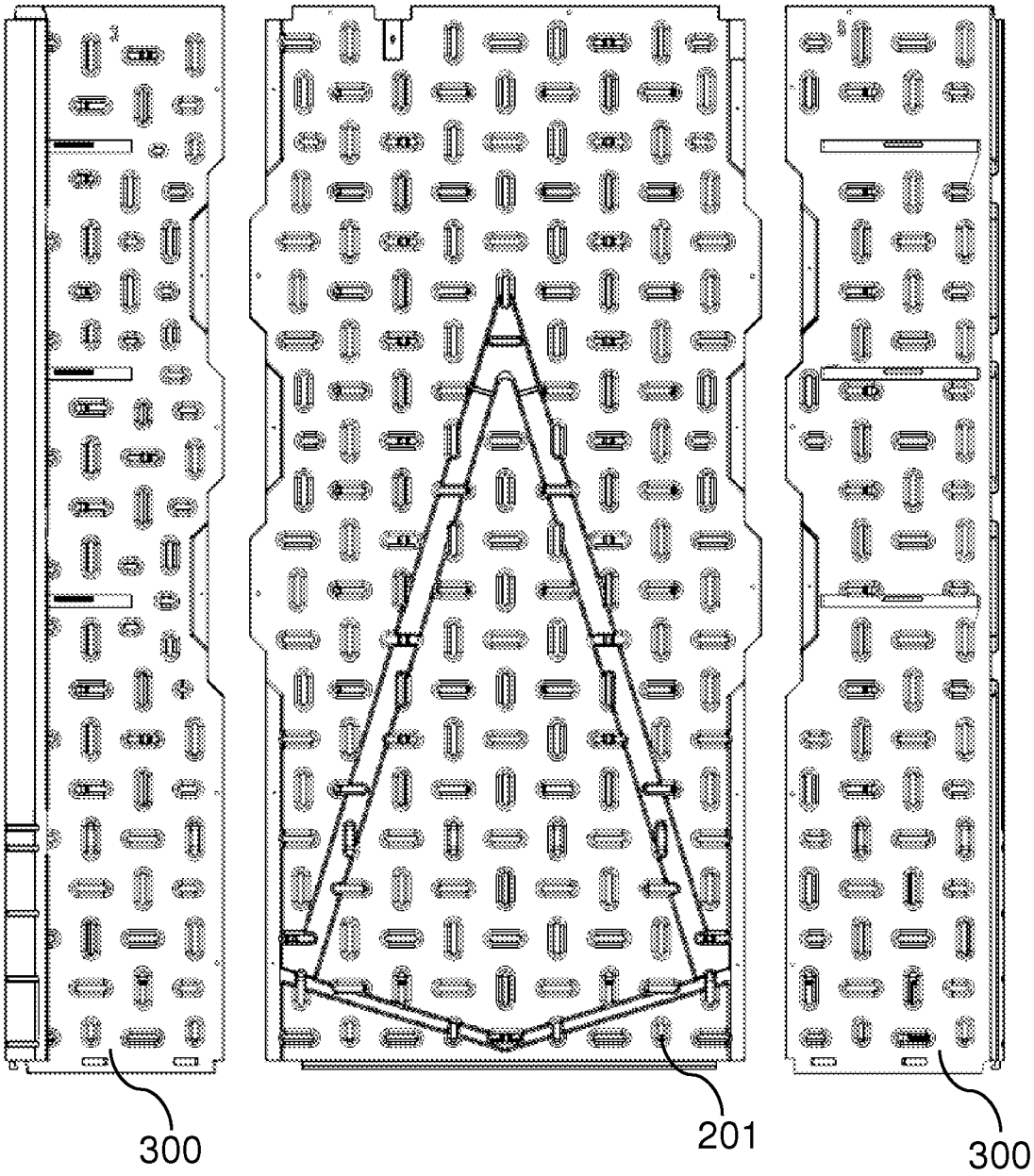
FIG. 36 shows a rear view of flat wall panel(s) and foldable corner panel(s), according to an embodiment of the present subject matter.

FIG. 36 shows a rear view of flat wall panel(s) and foldable corner panel(s), according to an embodiment of the present subject matter. A base flat panel 201 can have pre-manufactured integrated slots to store metal supporting beams during transportation. These metal support beams, once assembled and installed, can provide support for a designated section of the outdoor storage shed, such as the roof. As shown in this drawing, the base flat panel can be coupled to two foldable corner panels 300 via at least the interlocked teeth couplings.

Figure 37:
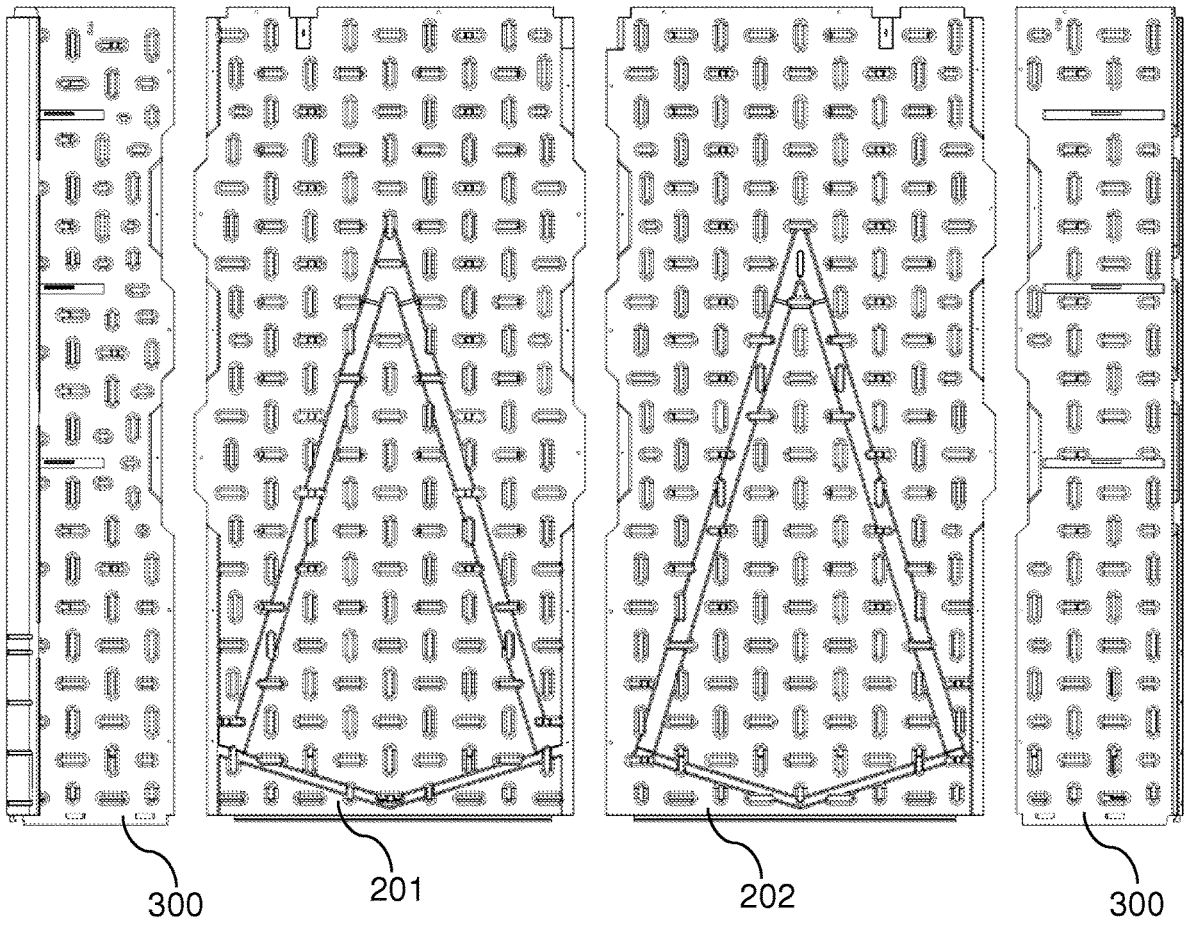
FIG. 37 shows another rear view of flat wall panel(s) and foldable corner panel(s), according to an embodiment of the present subject matter.

FIG. 37 shows another rear view of flat wall panel(s) and foldable corner panel(s), according to an embodiment of the present subject matter. Via interlocked teeth couplings, a basic flat panel 201 can be coupled with an extension flat panel 202 on a first side, and a foldable corner panel 300 on a second side. Additional extension flat panel 202 can be added to expand or customize the size of the storage shed. Another foldable corner panel 300 can be coupled to extension flat 202 to form a second corner of the shed. As shown in this drawing, during transportation, two sets of supporting beams can be stored within matching grooves embedded in the back of the plastic panels, which can save packaging space. Such supporting beams can be installed on-site to reinforce the shed's roofing assembly.

Figure 38:
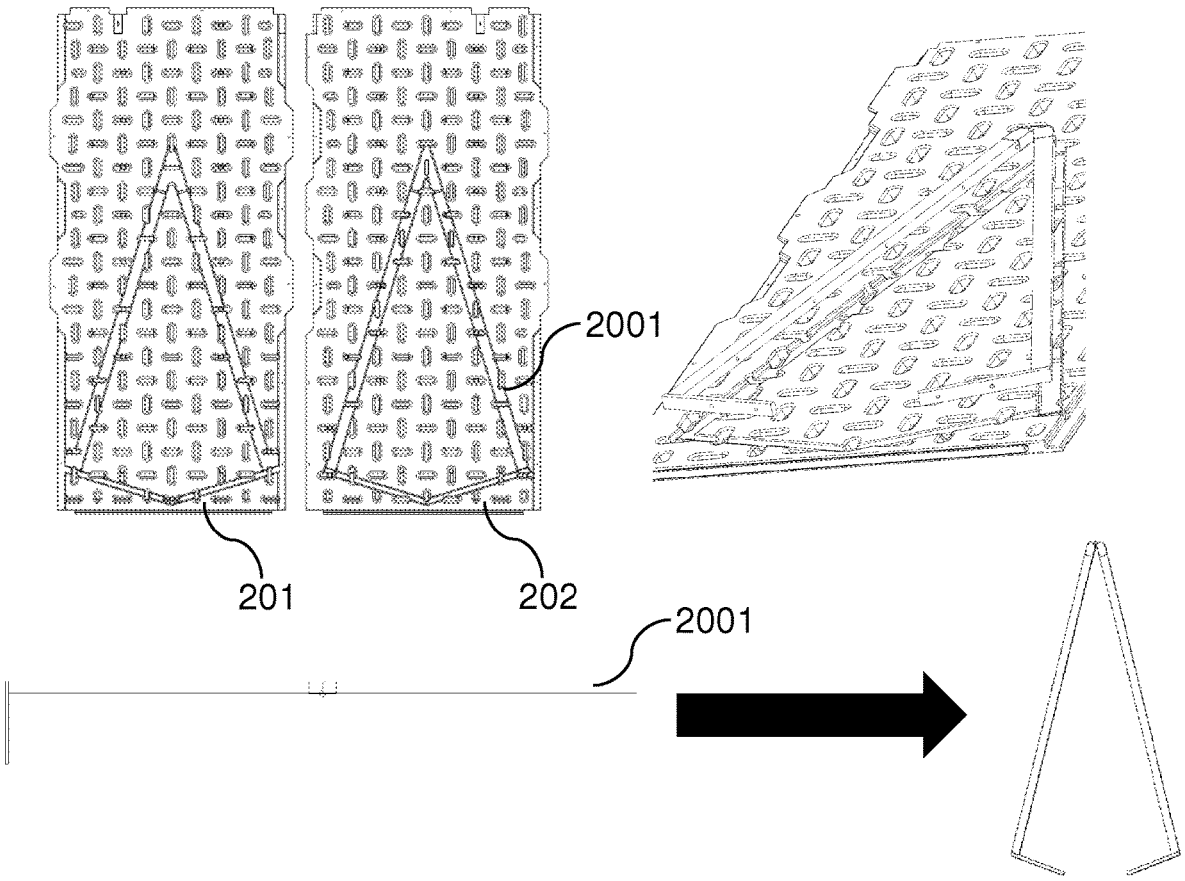
FIG. 38 shows a rear view of flat wall panels(s) with stored supporting beams, according to an embodiment of the present subject matter.

FIG. 38 shows a rear view of flat wall panels(s) with stored supporting beams, according to an embodiment of the present subject matter. Multiple supporting beams 2001 can be stored within the rear layer of a plastic molded panel, e.g., 201 and 202. As shown in this example, supporting beams can be split into two portions and connected via fastening tools during installation. To enable convenient retrieval by the user, the pre-manufactured beam slots that are integrated within the plastic layer can have a depth shallower or smaller than the depth of the supporting beams, e.g., half the depth. During transportation, a second panel, securely laying on top of the beam slots, can function as a fastener for the stored beams to prevent them from scratching and damaging other molded plastic panels in the package.

Figure 39:
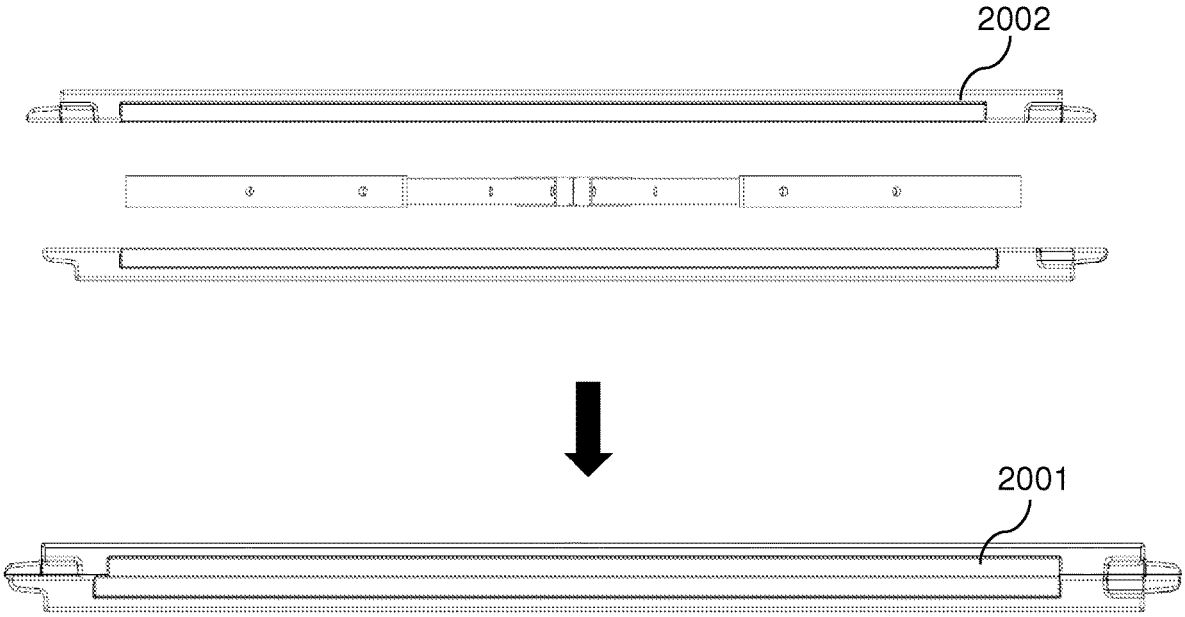
FIG. 39 shows supporting beams and their components, according to an embodiment of the present subject matter.

FIG. 39 shows supporting beams and their components, according to an embodiment of the present subject matter. This drawing shows an exemplary supporting beam 2001 can consist of multiple components of the supporting beam 2001. The components 2002 are shorter and take less space than a completed supporting beam, thus further reducing package space and cost.

Figure 40:
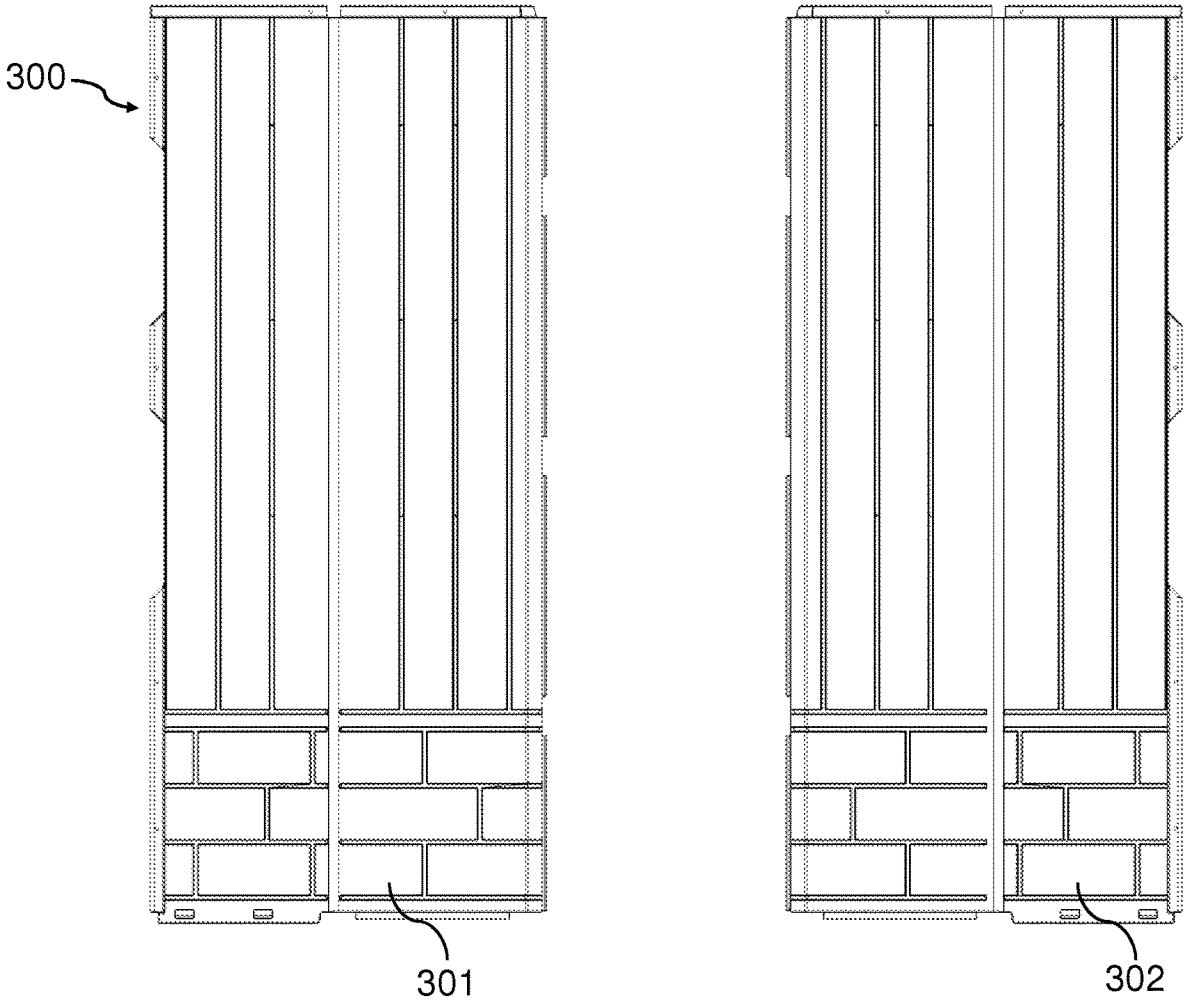
FIG. 40 shows foldable corner panels, according to an embodiment of the present subject matter.

FIG. 40 shows foldable corner panels, according to an embodiment of the present subject matter. According to some embodiments, wall panels can consist of foldable corner panels 300. Examples shown in this drawing include first foldable corner panel 301 for the front right corner of the shed and second foldable corner panel 302 for the left right corner, which constitute mirror images to each other.

Traditionally, the corner assembly of a storage shed consists of two separate panels joined by fasters, leaving a seamed connection that could cause instability. Also, water/ rain can enter the shed through the joint/seam and cause damage. The foldable corner panel solves these issues by eliminating the joint between two panels. A foldable corner panel can comprise a folding groove that divides the panel into a first leaf and a second leaf. In addition, each leaf of the foldable panel has a size and shape similar to other wall panels and floor panels. The embedded folding groove can be manufactured by injecting less or thinner plastic material than the rest of the panel, thus rendering a soft area that is flexible and rotatable.

During transportation, the two leaves are folded and closed at the groove. Prior to the installation, the foldable molded plastic model can unfold and form a flat surface. During installation, the two leaf panels of the foldable panel can be fixed at a fixed angle, e.g., 90°, to constitute a seamless corner. According to some embodiments, depending on the intended use of the final product, the two leaf panels can form a corner at other angles, such as 60°. According to some embodiments, multiple folding grooves can be integrated into a single panel to create multiple turning areas. Furthermore, the one-piece foldable corner can reduce manufacturing cost and also reduce installation complexity and time for the user.

Figure 41:
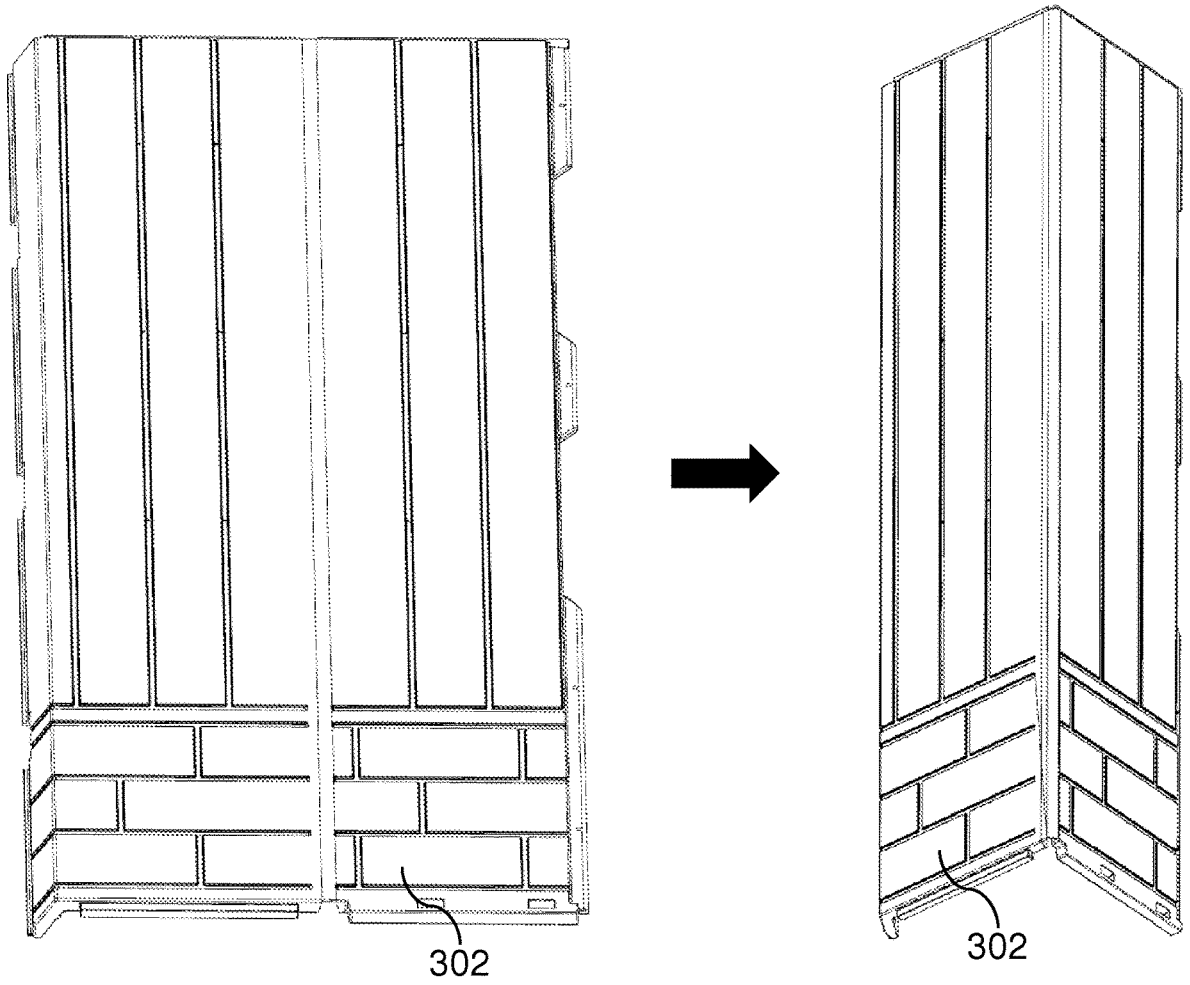
FIG. 41 shows a front view of a foldable corner panel, according to an embodiment of the present subject matter.
Figure 42:
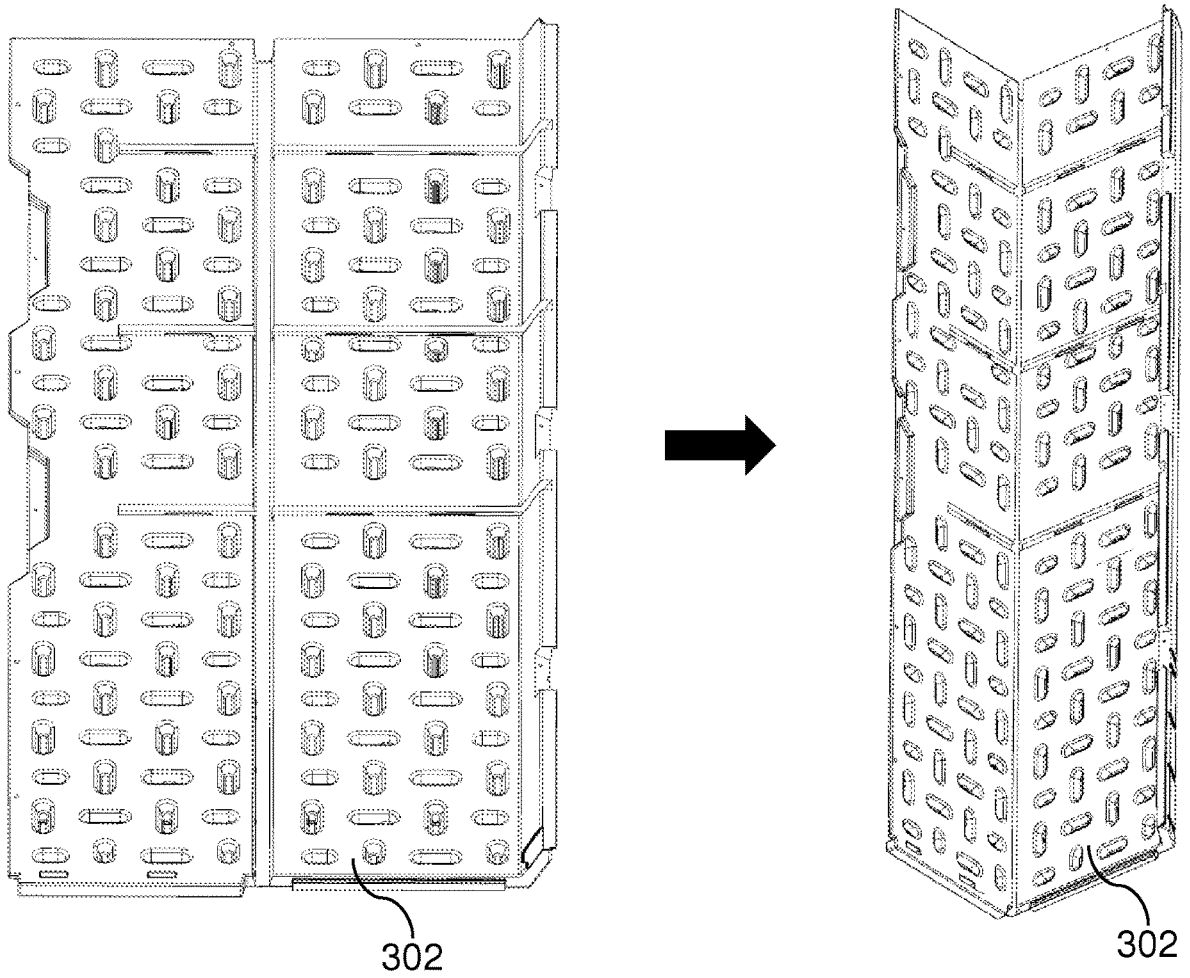
FIG. 42 shows a rear view of a foldable corner panel, according to an embodiment of the present subject matter.

FIG. 41 shows a front view of a foldable corner panel, according to an embodiment of the present subject matter. FIG. 42 shows a rear view of a foldable corner panel, according to an embodiment of the present subject matter. As shown in FIG. 41, a second foldable corner panel 302 can be unfolded at the folding groove and form a flat surface prior to the installation. After the installation, the foldable panel can be affixed to the corner edge floor panels to form a corner. A similar process is shown in FIG. 42 from the rearview.

Figure 43:
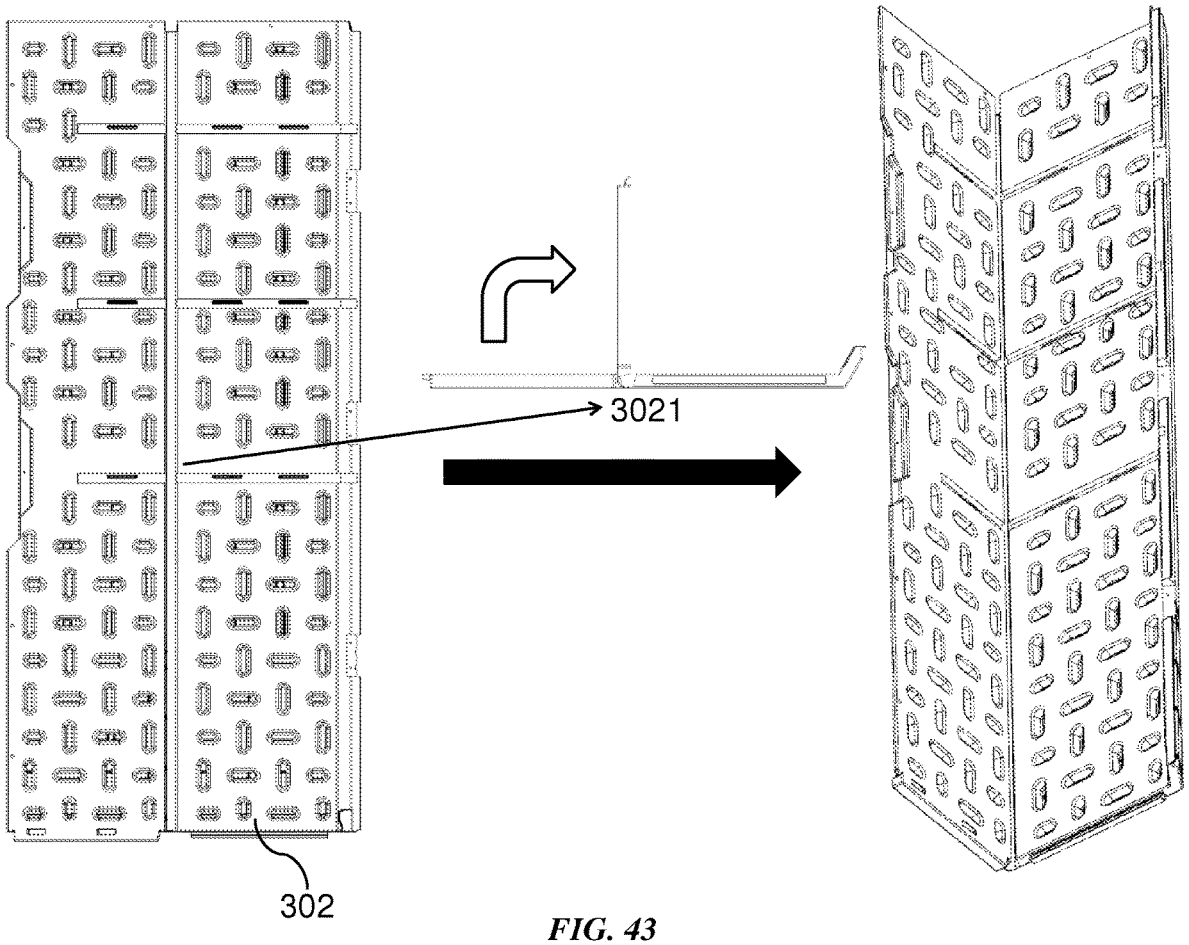
FIG. 43 shows another rear view of a foldable corner panel, according to an embodiment of the present subject matter.

FIG. 43 shows another rear view of a foldable corner panel, according to an embodiment of the present subject matter. As shown in this drawing, a folding groove 3021 can enable the turning of a foldable corner panel, e.g. second foldable corner panel 302.

Figure 44:
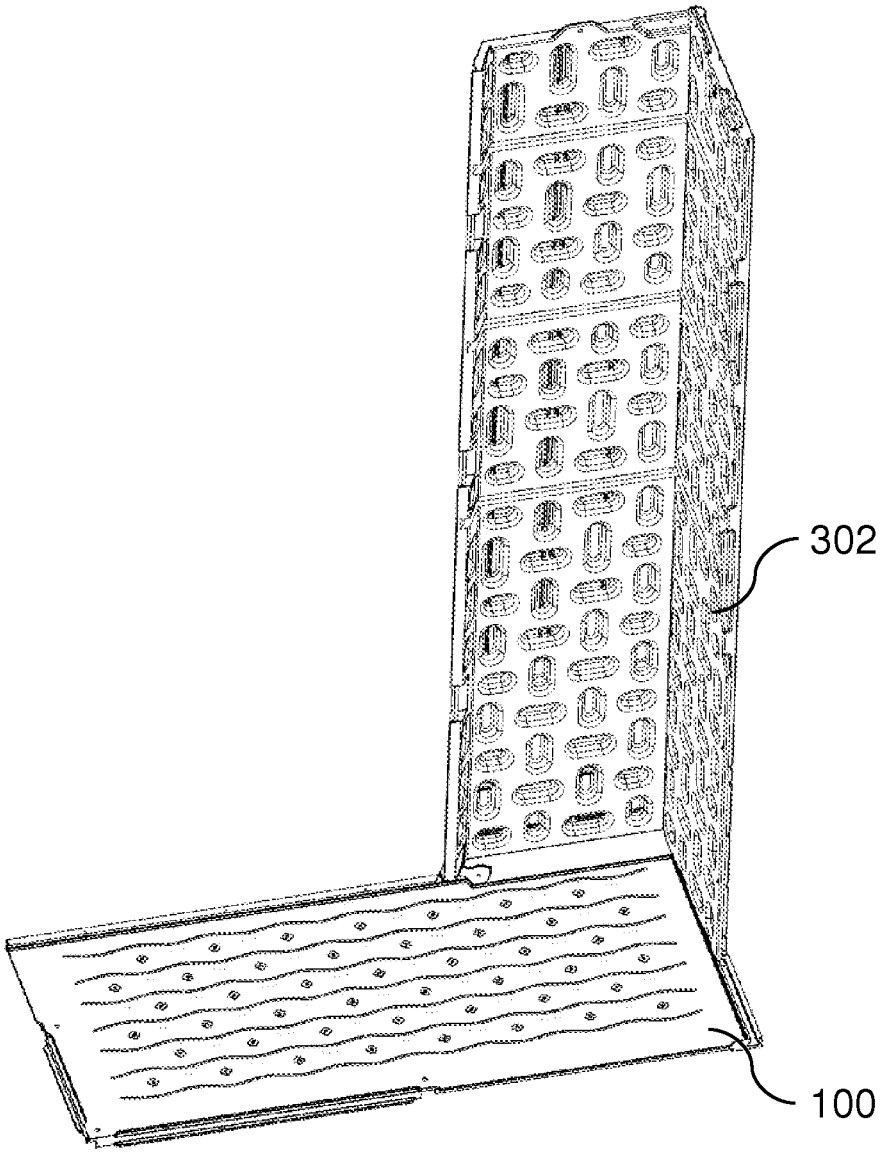
FIG. 44 shows a foldable corner panel coupled to a floor panel, according to an embodiment of the present subject matter.

FIG. 44 shows a foldable corner panel coupled to a floor panel, according to an embodiment of the present subject matter. After installation, second foldable corner panel 302 can be fixed along two edges of floor 100. According to some embodiments, floor 100 can be a corner edge floor panel that comprises two types of coupling mechanisms, e.g., a slider coupling and a clip coupling, on each edged side. According to some embodiments, seam lines between side wall panels can offset with seam lines between floor panels, which means avoiding aligning two seam lines substantially. This way, the connected floor panels and the wall panels can reinforce each other.

Figure 45:
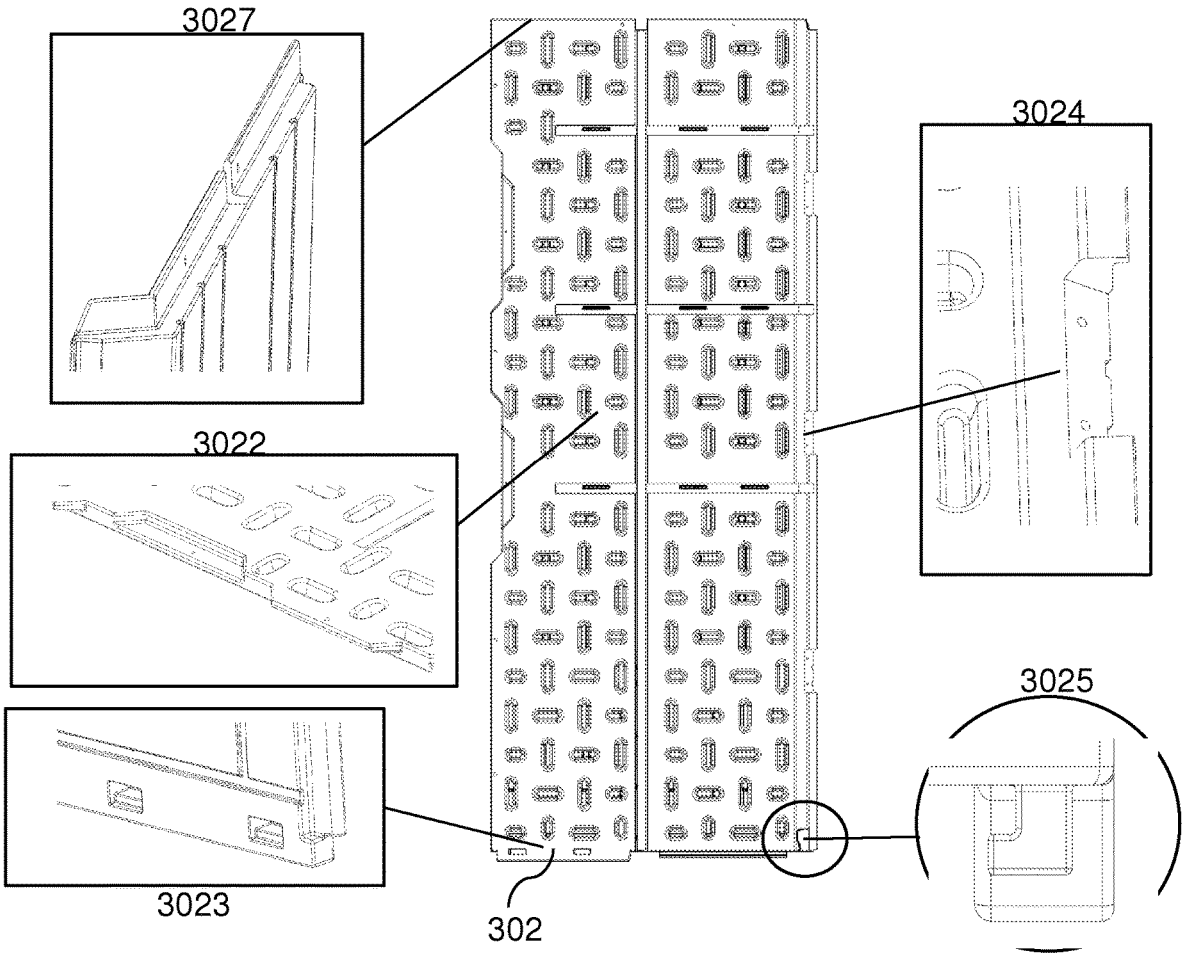
FIG. 45 shows multiple exploded views of foldable corner panel(s), according to an embodiment of the present subject matter.

FIG. 45 shows multiple exploded views of foldable corner panel(s), according to an embodiment of the present subject matter. According to some embodiments, a second foldable corner panel 302 can have a top side 3027 configured to be coupled to a lintel or a roof for the shed. A door hinge slot 3024 can be pre-manufactured so that a door can be connected to the panel. The bottom two sides along the two leaves of the panel 302 can be equipped with one or more coupling mechanisms.

According to some embodiments, each leaf can have a different coupling structure from each other so that the installation is easier, and the structural stability is enhanced. For example, clip slots 3023 on first leaf can be coupled to clips arranged on a floor panel; an L-shaped slider 3025 on a second leaf can be coupled to a L-shaped rail on the floor panel.

In addition, the rear layer of second foldable corner panel 302 can comprise back strengthening ribs 3022. As shown in this drawing, evenly spaced and symmetrically arranged back strengthening ribs are arranged to provide enhanced stability of the plastic panel. According to some embodiments, back strengthening ribs 3022 can comprise vertical support grooves and horizontal support grooves. In particular, each vertical support groove can be surrounded by a plurality of horizontal support grooves. In addition, each horizontal support groove can be surrounded by a plurality of vertical support grooves.

Figure 46:
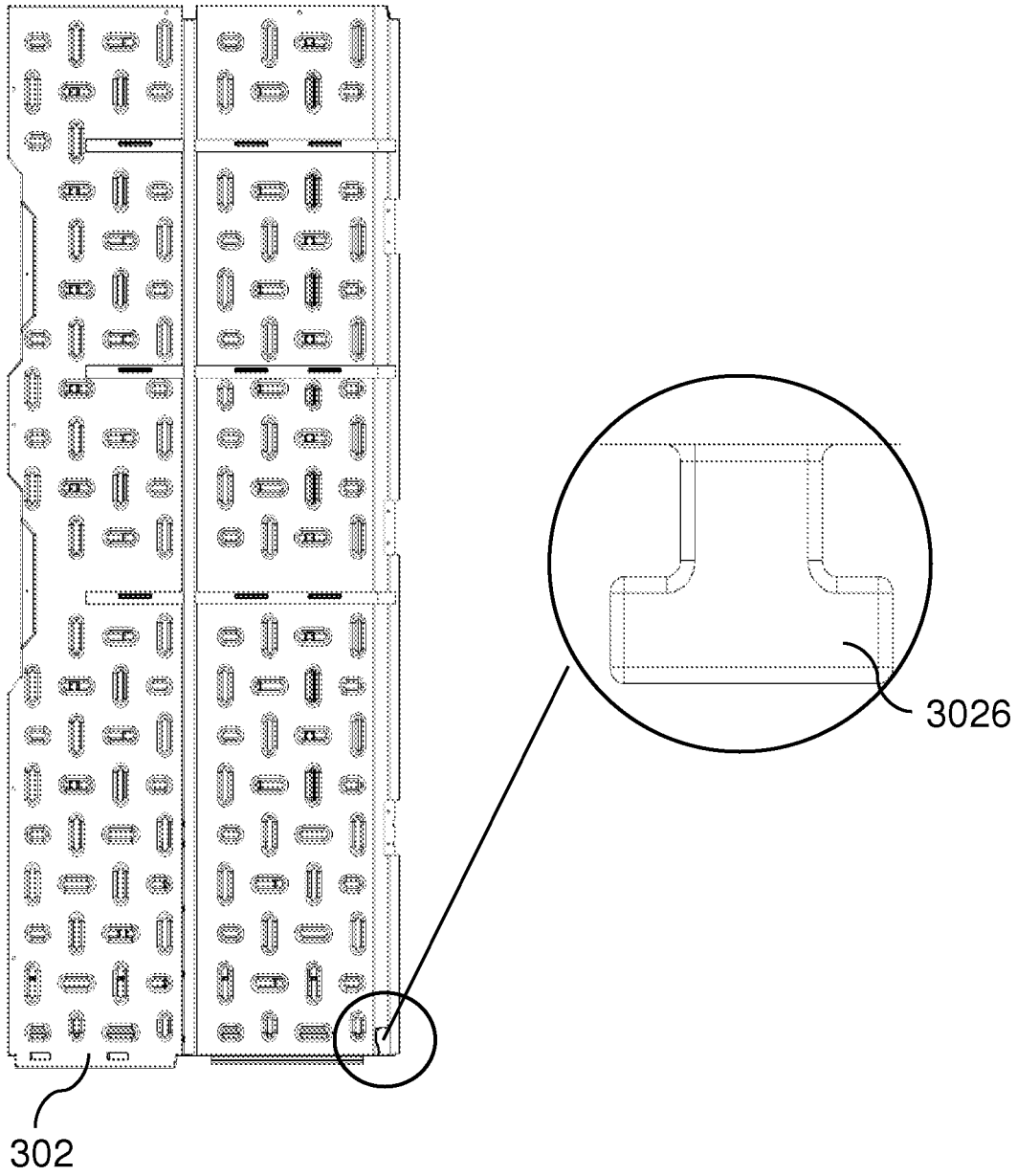
FIG. 46 shows an exploded view of foldable corner panel(s), according to an embodiment of the present subject matter.

FIG. 46 shows an exploded view of foldable corner panel(s), according to an embodiment of the present subject matter. According to some embodiments, second foldable corner panel 302 can have another type of slider, e.g., a T-shaped slider 3026, to engage with a T-shaped rail of a floor panel.

Figure 47:
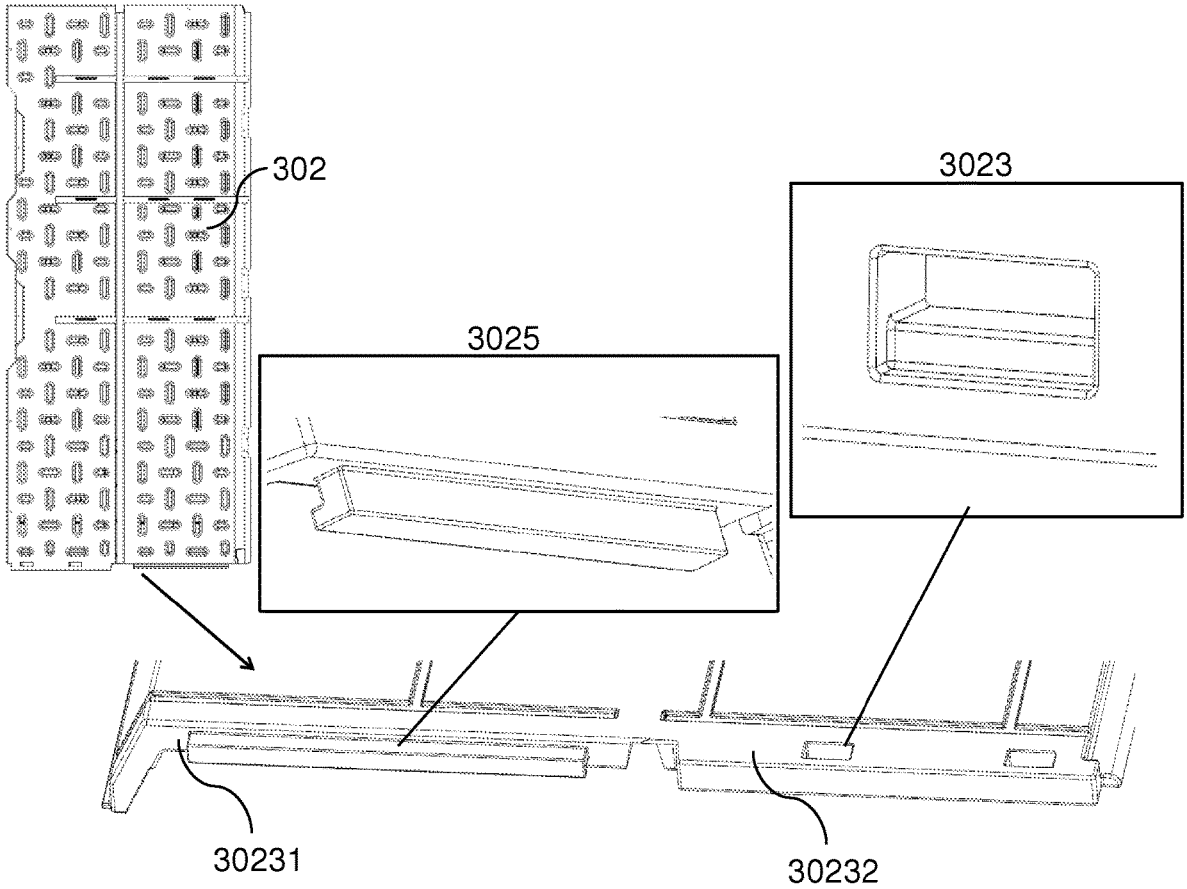
FIG. 47 shows two coupling mechanisms of foldable corner panel(s), according to an embodiment of the present subject matter.

FIG. 47 shows two coupling mechanisms of foldable corner panel(s), according to an embodiment of the present subject matter. According to some embodiments, second foldable corner panel 302 can be divided by an embedded folding groove into a first leaf 30231 and a second leaf 30232. As shown in the exploded views, first leaf 30231 can consist of an L-shaped slider 3025; second leaf 30232 can comprise clip slots 3023. According to some embodiments, the two leaves can incorporate two different coupling mechanisms. The two coupling mechanisms can adopt a contrasting engagement style, i.e. projecting v. receiving, to increase the binding force and stability between the panels. For example, a panel can have a protruding coupling portion, e.g., L-shaped slider 3025, arranged on one leaf, and a receiving coupling portion, e.g., clip slots 3023, arranged on another leaf.

Figure 48:
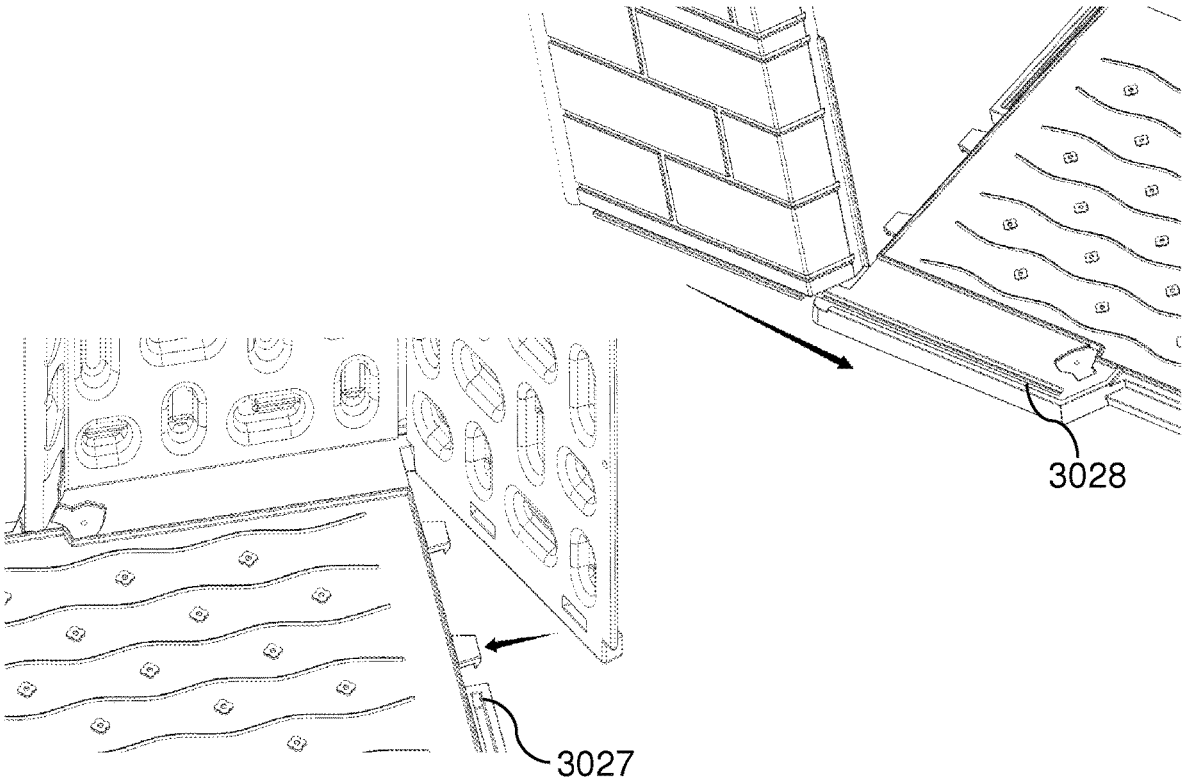
FIG. 48 shows two coupling mechanisms of foldable corner panel(s), according to an embodiment of the present subject matter.

FIG. 48 shows two coupling mechanisms of foldable corner panel(s), according to an embodiment of the present subject matter. As shown in this drawing, a clip coupling structure 3027 is arranged on a first side of the pivotable corner panel, whereas a slider coupling structure 3028 is arranged on a second side of the corner panel.

Figure 49:
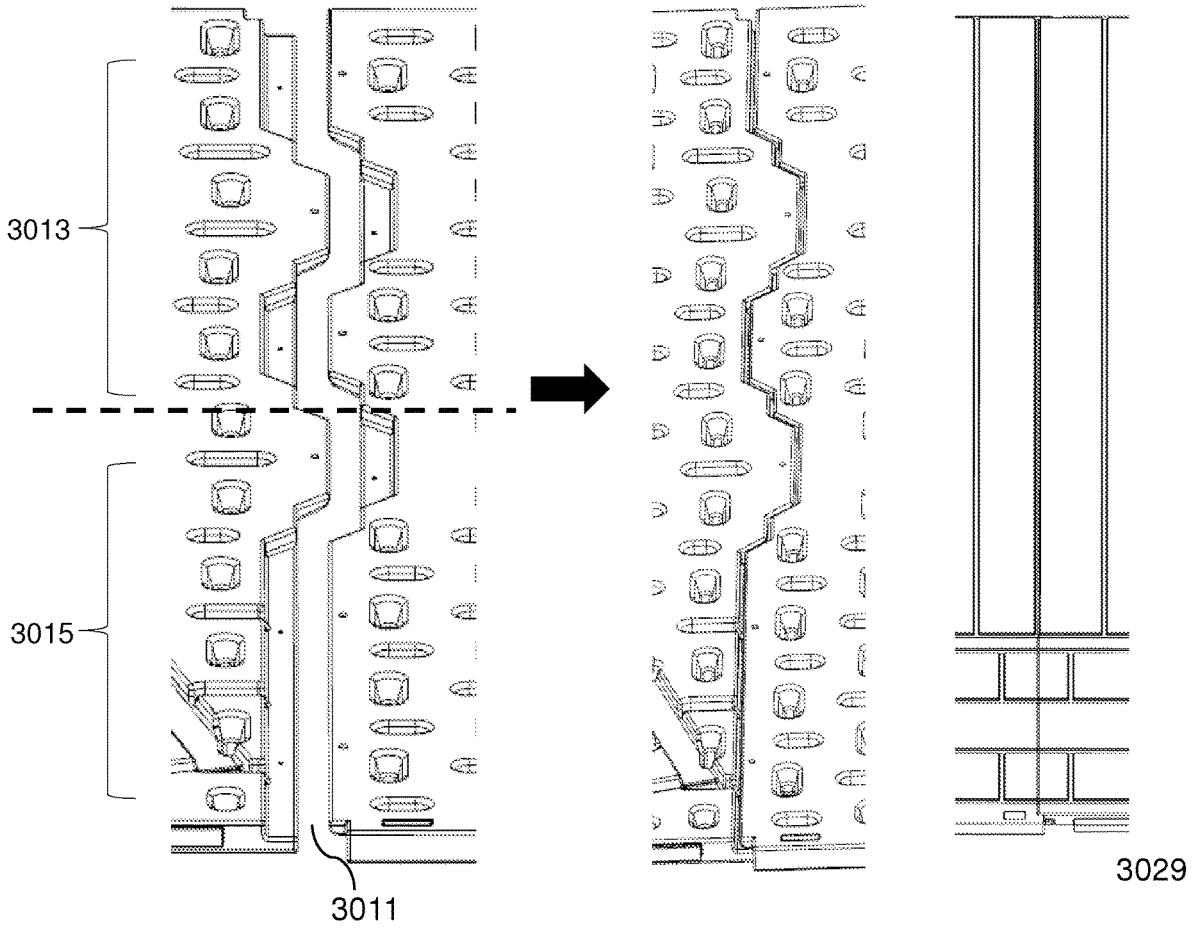
FIG. 49 shows interlocking teeth couplings between two connected wall panels, according to an embodiment of the present subject matter.

FIG. 49 shows interlocking teeth couplings between two connected wall panels, according to an embodiment of the present subject matter. According to some embodiments, interlocked teeth couplings 3011 can comprise a plurality of protrusions/lips on the left wall panel and corresponding recesses arranged on the right wall panel. It is further noted that each protrusion and recess can have varied depths of plastic material, forming varied ledges based on the design and contour of the teeth couplings. Such varied, multi-level engagement can increase the contact surface between the two panels. According to some embodiments, the protrusions/lips and the recesses are distributed asymmetrically along with connecting line. For example, the interlocked teeth portions can be placed closer to or within the upper half region 3013, instead of the lower half region 3015. This way, the installation can take less careful alignment as the lower half region shall be coupled with the floor panels.

One advantage of interlocked teeth couplings 3011 is to increase the binding and unity of any two coupled panels. The increased contact surface resulting from the teeth couplings, protrusions and recesses at varied depths, can share any force applied to the panels, thus improving the stability of the structure. Such couplings can be used between the wall panels, the floor panels, or any other plastic panels. Furthermore, one or more additional fastening tools, such as screws, can be adopted to further secure the connected panels.

FIG. 49 further shows an exterior view 3029 of interlocked teeth couplings 3011. After the assembly, there is a straight seam line formed by the interlocked teeth couplings 3011. Thus, the interlocked teeth couplings can increase the structure stability without sacrificing the aesthetic appeal of the product.

Figure 50:
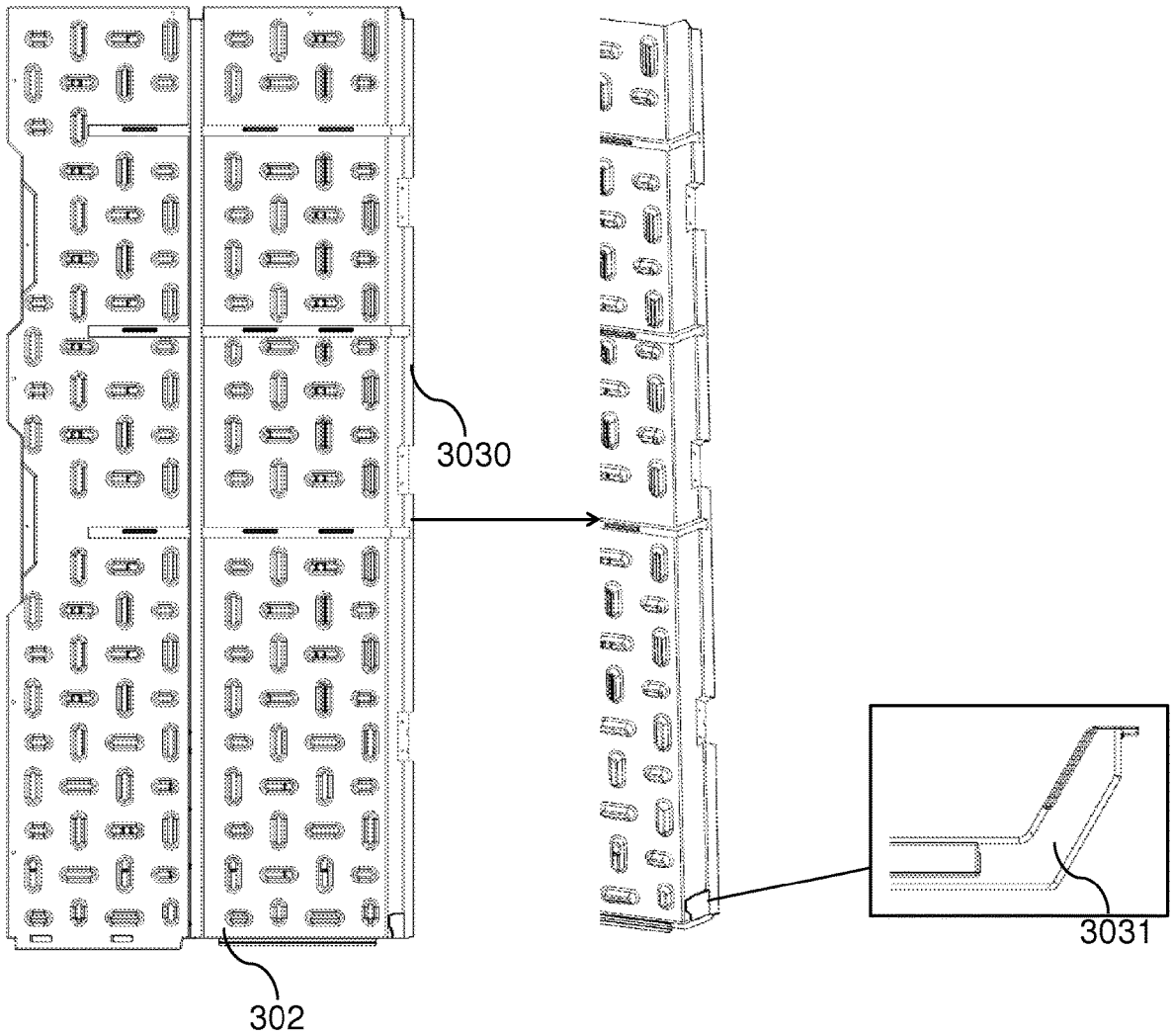
FIG. 50 shows a foldable corner panel with a concave door frame, according to an embodiment of the present subject matter. Traditionally, a shed's door is flush with the wall surface.

FIG. 50 shows a foldable corner panel with a concave door frame, according to an embodiment of the present subject matter. Traditionally, a shed's door is flush with the wall surface. According to some embodiments, the edge of second foldable corner panel 302 can transition into a concave door frame 3030, generating an inwardly concave surface 3031. This concave surface 3031 can be sloped towards a door. As illustrated in the drawing, the concave surface 3031 can be broader than a standard door frame, thus enhancing the stability of the door-wall structure. Moreover, the concave surface 3031 can also serve as a door stopper or brake when the shed door is opened, preventing the door from harshly hitting the wall panels. The design of the concave door frame also can permit the door to recess below the surface of the wall, offering protection to the door from weather elements such as rain, sunlight, or wind.

Figure 51:
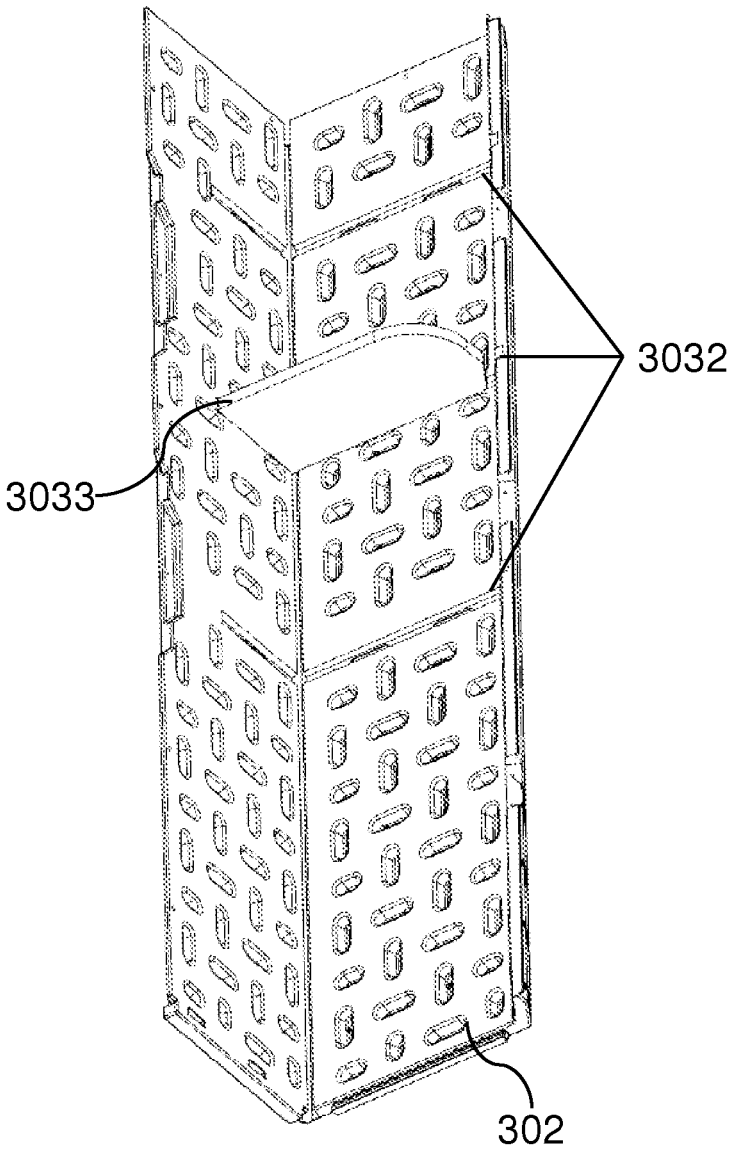
FIG. 51 shows a foldable corner panel with shelf groove (s), according to an embodiment of the present subject matter.

FIG. 51 shows a foldable corner panel with shelf groove (s), according to an embodiment of the present subject matter. According to some embodiments, a foldable corner panel, e.g., second foldable corner panel 302 can consist of a number of shelf grooves 3032 that are manufactured and embedded into the interior surface of the two panel leaves. A number of molded plastic self 3033 can be slotted into shelf grooves 3032. Such shelves can offer not only additional storage space within the shed but also increase the structural stability of the corner panel assembly.

Figure 52:
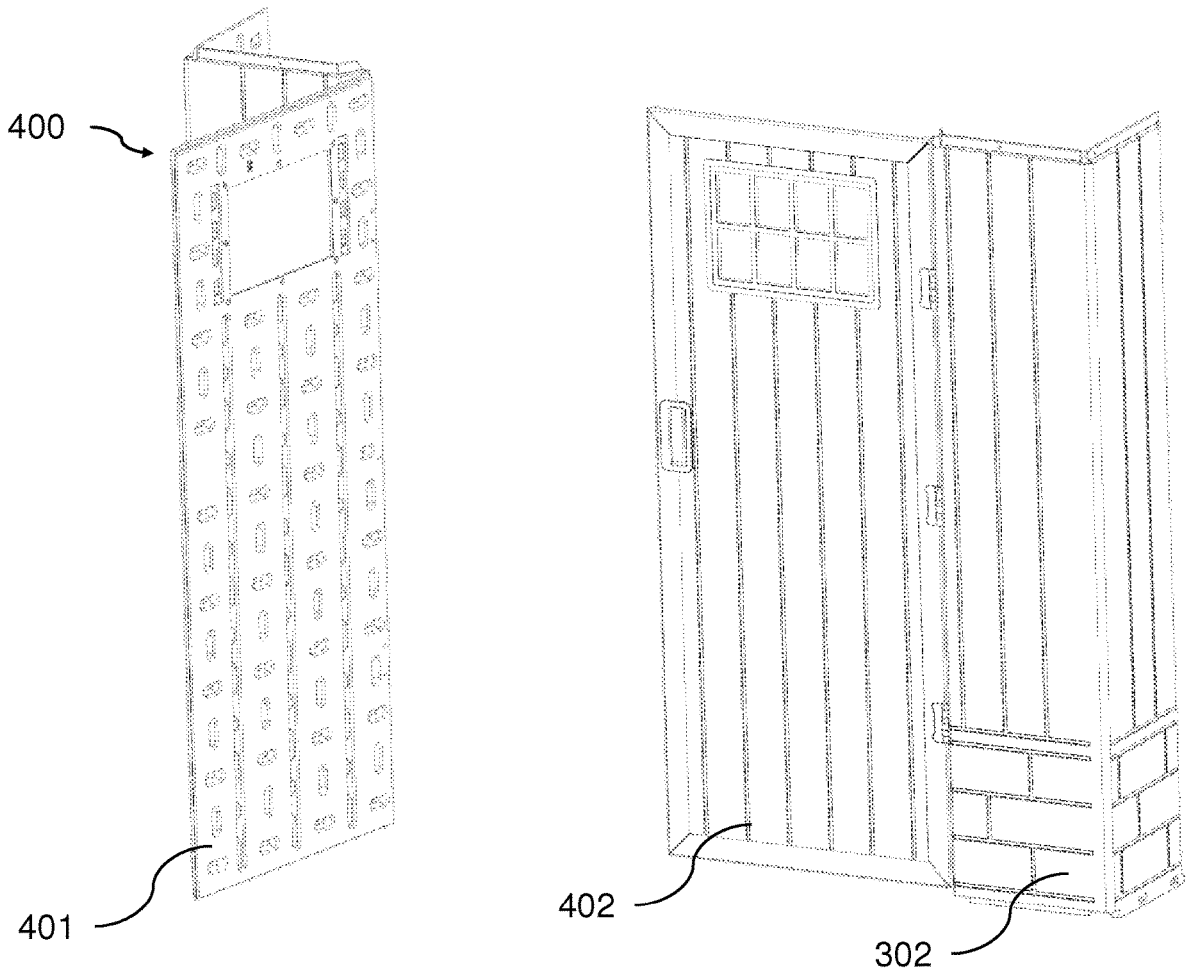
FIG. 52 shows a foldable corner panel coupled with a door, according to an embodiment of the present subject matter.

FIG. 52 shows a foldable corner panel coupled with a door, according to an embodiment of the present subject matter. According to some embodiments, the shed storage structure can comprise a door 400 that further consists of a first door panel 401 and a second door panel 402. Such door 400 can be connected to a foldable corner panel, such as second foldable corner panel 302. According to some embodiments, the shed storage structure can comprise a front door and a back door. According to some embodiments, the shed storage structure can have only a front door.

Figure 53:
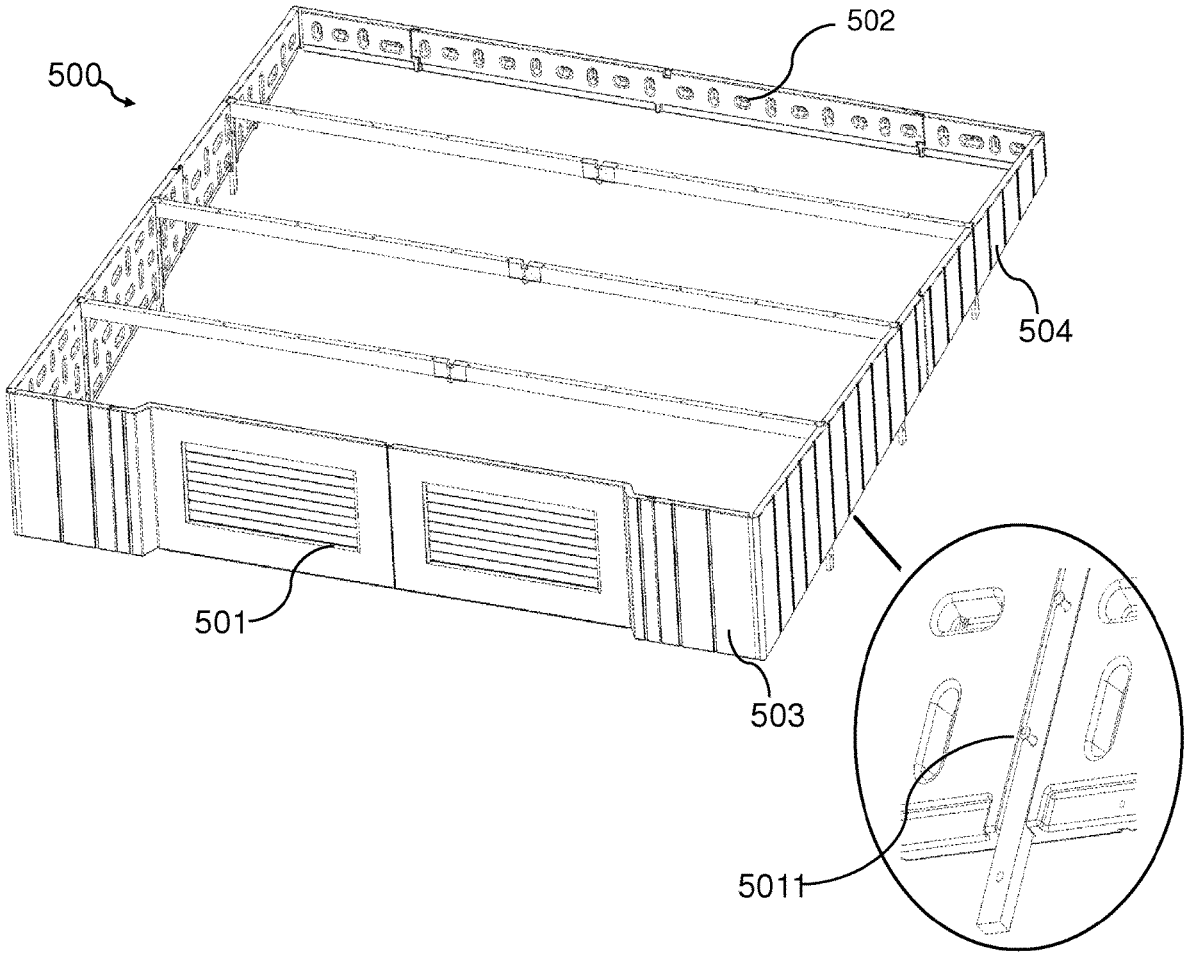
FIG. 53 shows an assembled lintel for the outdoor storage shed, according to an embodiment of the present subject matter.

FIG. 53 shows an assembled lintel for the outdoor storage shed, according to an embodiment of the present subject matter. According to some embodiments, a lintel 500 can function as a supporting component between the shed's wall panels and the roof. Lintel 500 can comprise front lintel 501, rear lintel 502, front foldable lintel panel 503 and rear foldable lintel panel 504. Lintel 500 can be fixed to wall panels and roof via connectors such as screws 5011.

Figure 54:
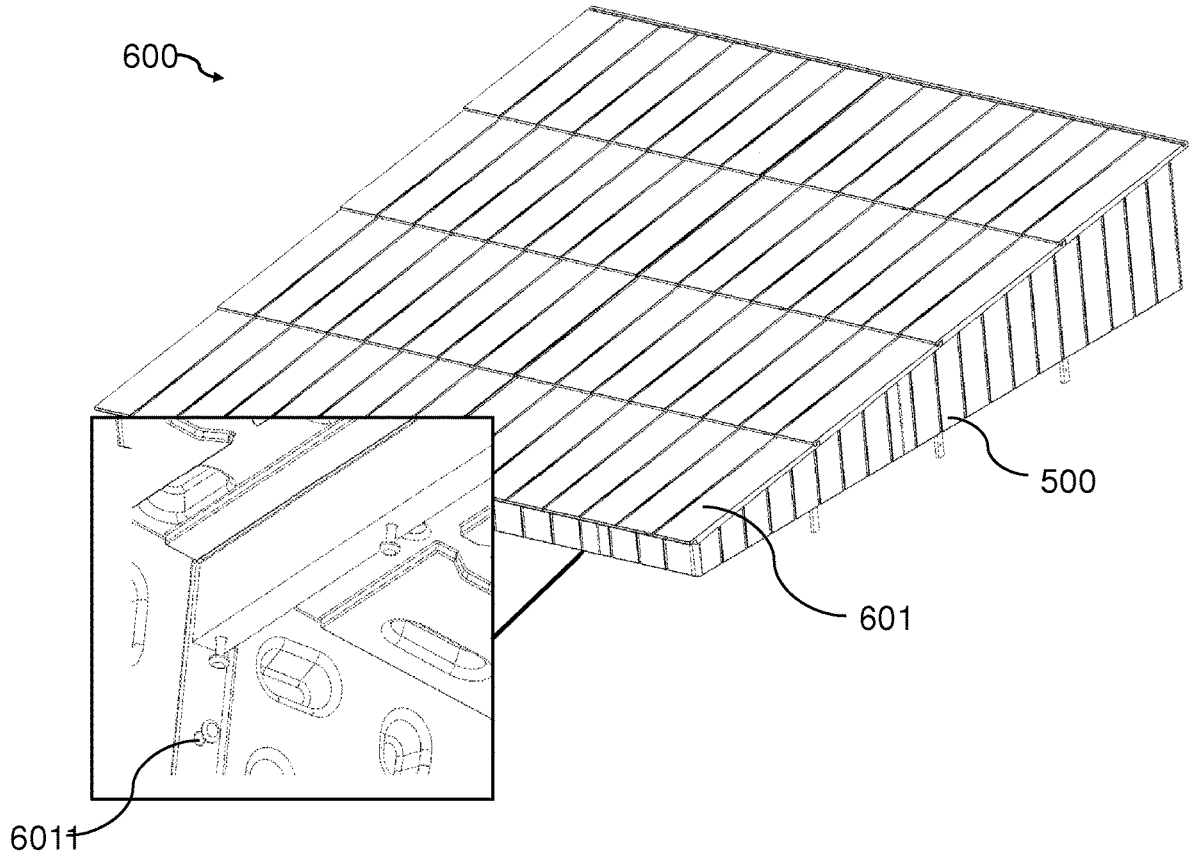
FIG. 54 shows a roof connected with a lintel for the outdoor storage shed, according to an embodiment of the present subject matter.

FIG. 54 shows a roof connected with a lintel for the outdoor storage shed, according to an embodiment of the present subject matter. According to some embodiments, a roof with lintel 600 can comprise a roof 601 that is fixed to lintel 500 via various connectors such as screws 6011.

Figure 55:
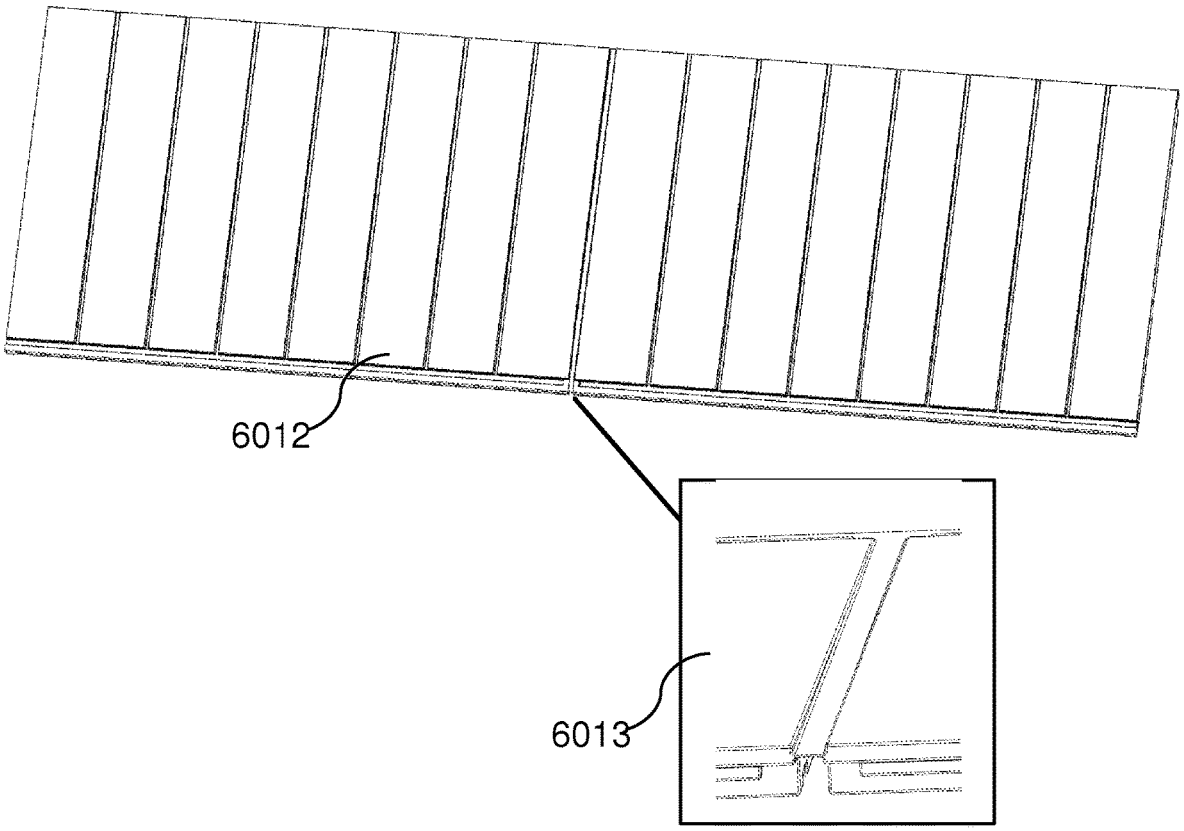
FIG. 55 shows a foldable roof panel for a roof, according to an embodiment of the present subject matter.

FIG. 55 shows a foldable roof panel for a roof, according to an embodiment of the present subject matter. according to some embodiments, a foldable roof panel 6012 can be utilized to reduce the storage space and cost. As shown in the drawing, a folding groove 6013 can be manufactured by injecting less or thinner plastic than the rest of the roof panel. During transportation, foldable roof panel 6012 can be folded into half size at folding groove 6013, which is similar sized with the other panels. During installation, foldable roof panel 6012 can unfold and form a flat surface.

Figure 56:
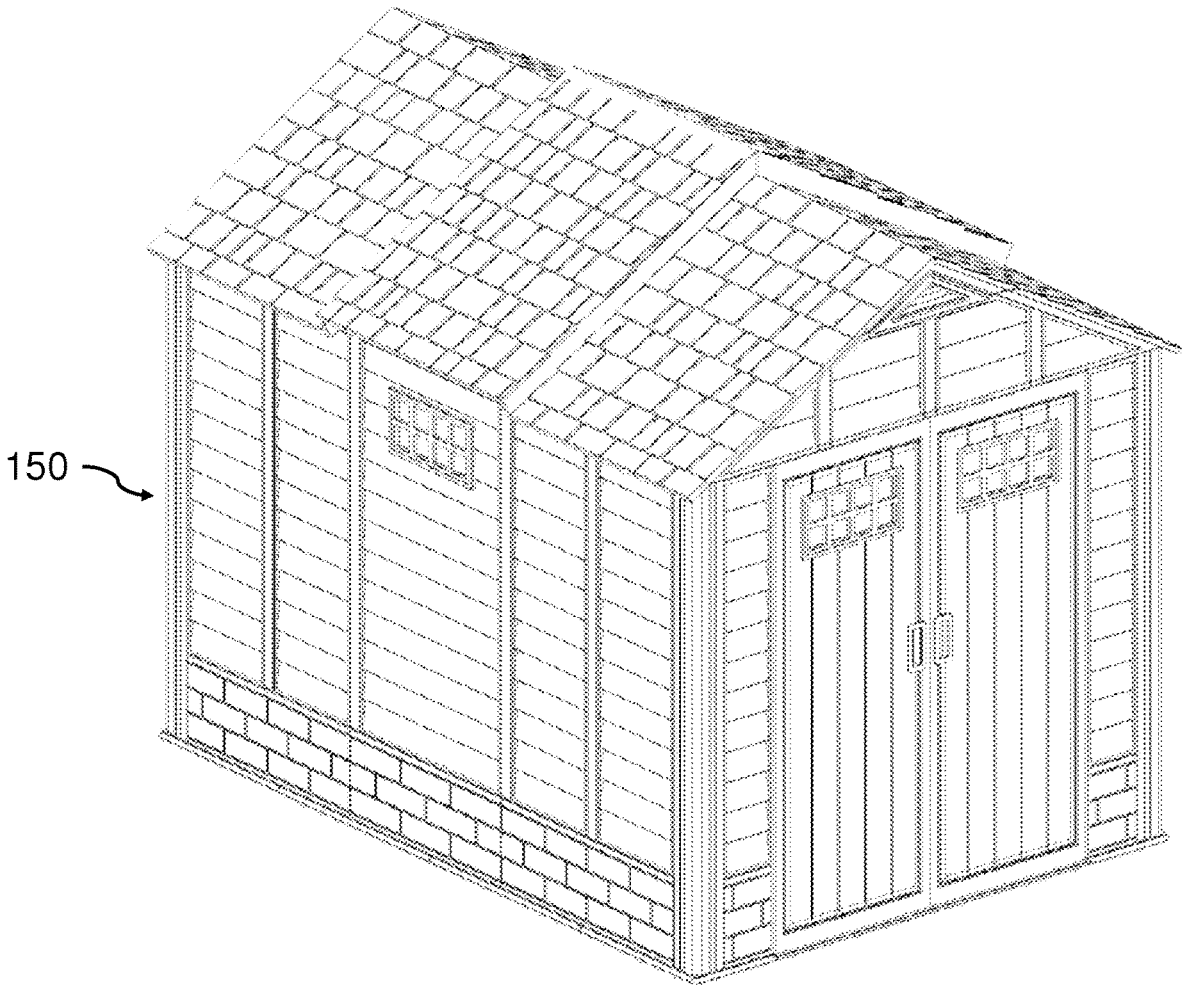
FIG. 56 is a schematic diagram of the structure of a first configurable prefab modular shed structure, according to one embodiment of the present subject matter.
Figure 57:
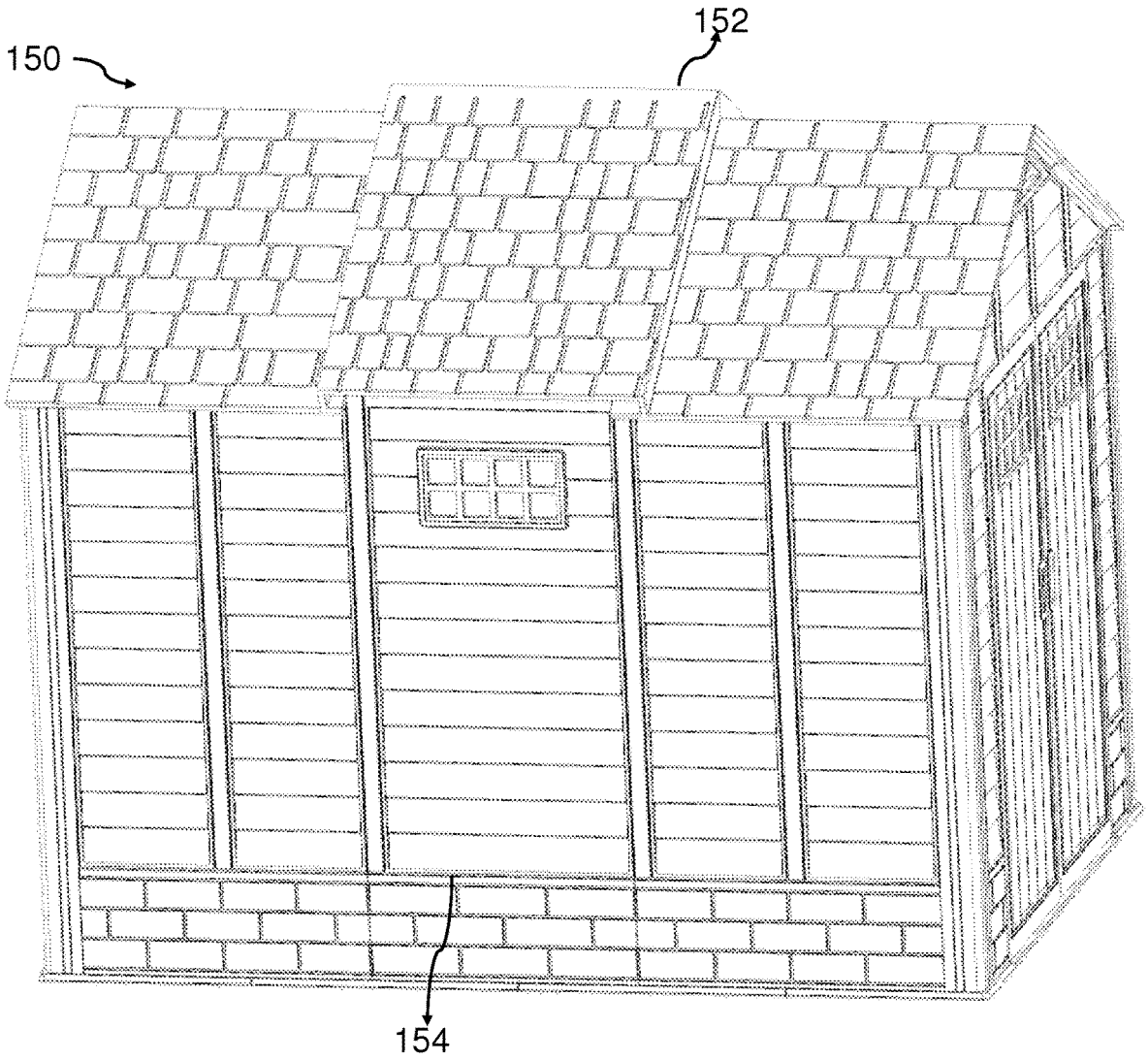
FIG. 57 is another schematic diagram of the structure of the first configurable prefab modular shed structure as shown in FIG. 56, according to one embodiment of the present subject matter.

FIGS. 56 and 57 show a schematic diagram of the structure of a first configurable prefab modular shed structure. According to some embodiments, depending on the preferred shed space, the modular shed structure 150 can be configured and expanded via additional extension wall panel such as the extension wall panel 154. Similarly, extension floor panels can be coupled to the base flat panel to extend the floor. According to some embodiments, a raised section 152 can be incorporated to offer higher ceiling in certain section of the shed.

Figure 58:
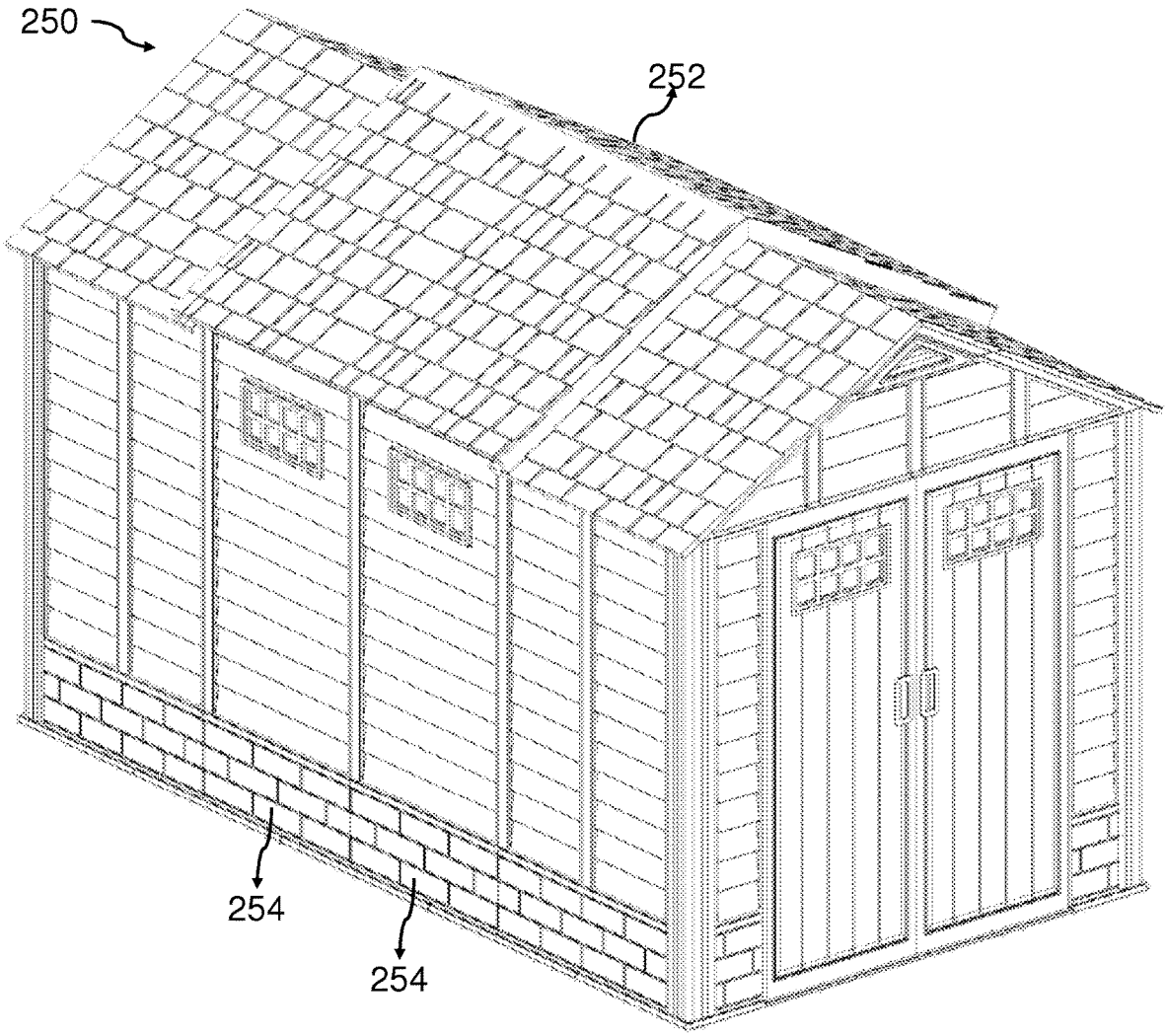
FIG. 58 is a schematic diagram of the structure of a second configurable prefab modular shed structure, according to one embodiment of the present subject matter.
Figure 59:
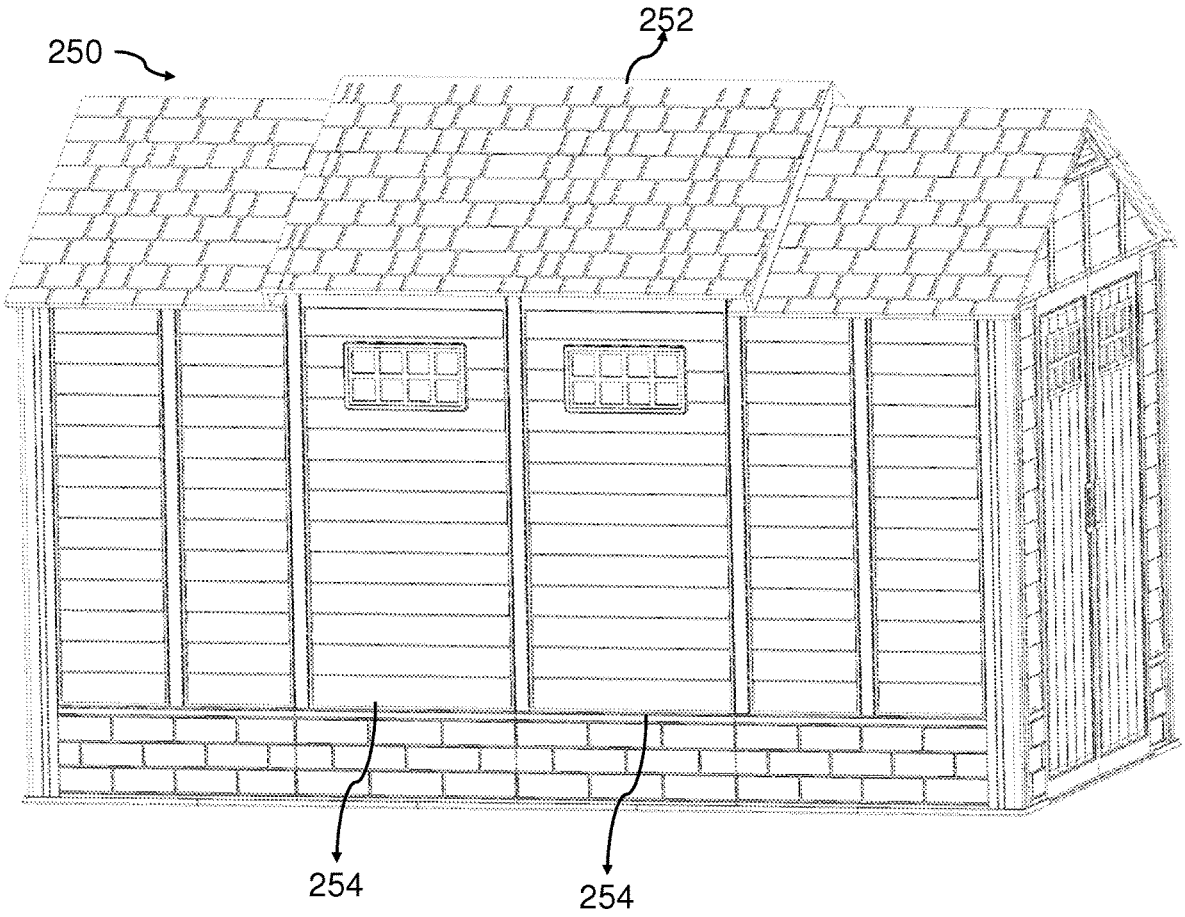
FIG. 59 is another schematic diagram of the structure of the second configurable prefab modular shed structure as shown in FIG. 58, according to one embodiment of the present subject matter.

FIGS. 58 and 59 show a schematic diagram of the structure of a second configurable prefab modular shed structure. According to some embodiments, the modular shed structure 250 can be further expanded via additional extension wall panels such as the extension wall panels 254. Similarly, extension floor panels can be coupled to the base flat panel to extend the floor. According to some embodiments, a raised section 252 can be incorporated to offer higher ceiling in certain section of the shed.

Figure 60:
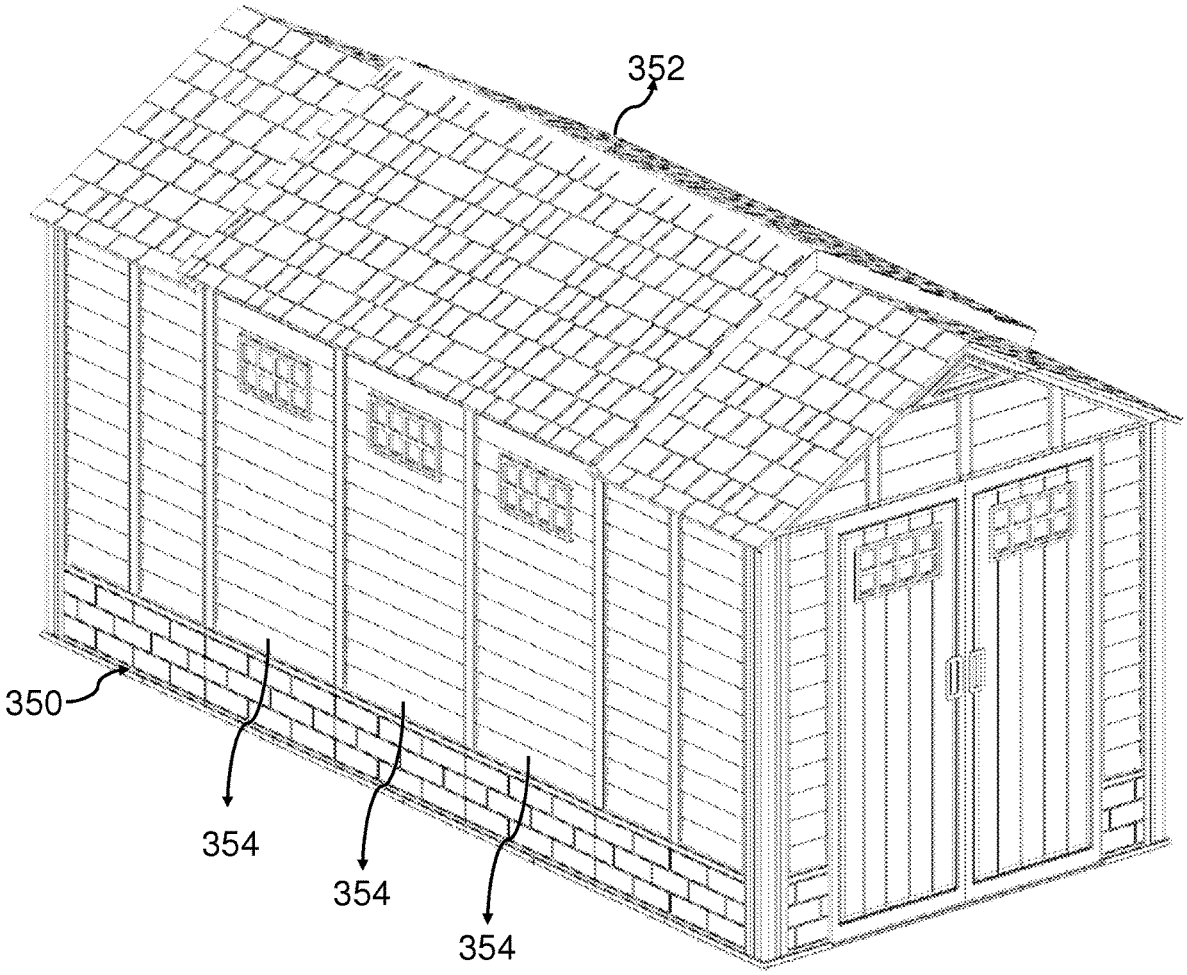
FIG. 60 is a schematic diagram of the structure of a third configurable prefab modular shed structure as shown, according to one embodiment of the present subject matter.
Figure 61:
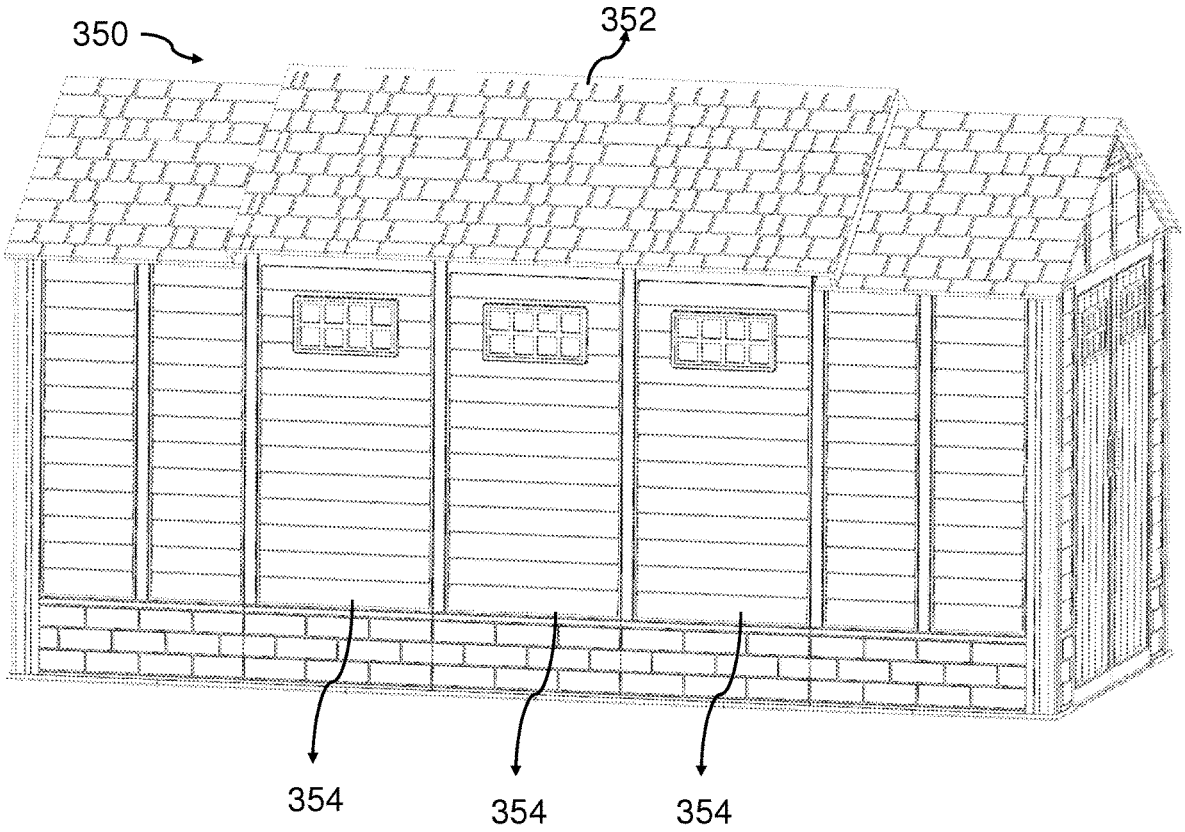
FIG. 61 is another schematic diagram of the structure of the third configurable prefab modular shed structure as shown in FIG. 60, according to one embodiment of the present subject matter.

FIGS. 60 and 61 are schematic diagram of the structure of a third configurable prefab modular shed. According to some embodiments, the modular shed structure 350 can be further expanded via additional extension wall panels such as the three extension wall panels 354. Similarly, extension floor panels can be coupled to the base flat panel to extend the floor. According to some embodiments, a raised section 352 can be incorporated to offer higher ceiling in certain section of the shed.

Figure 62:
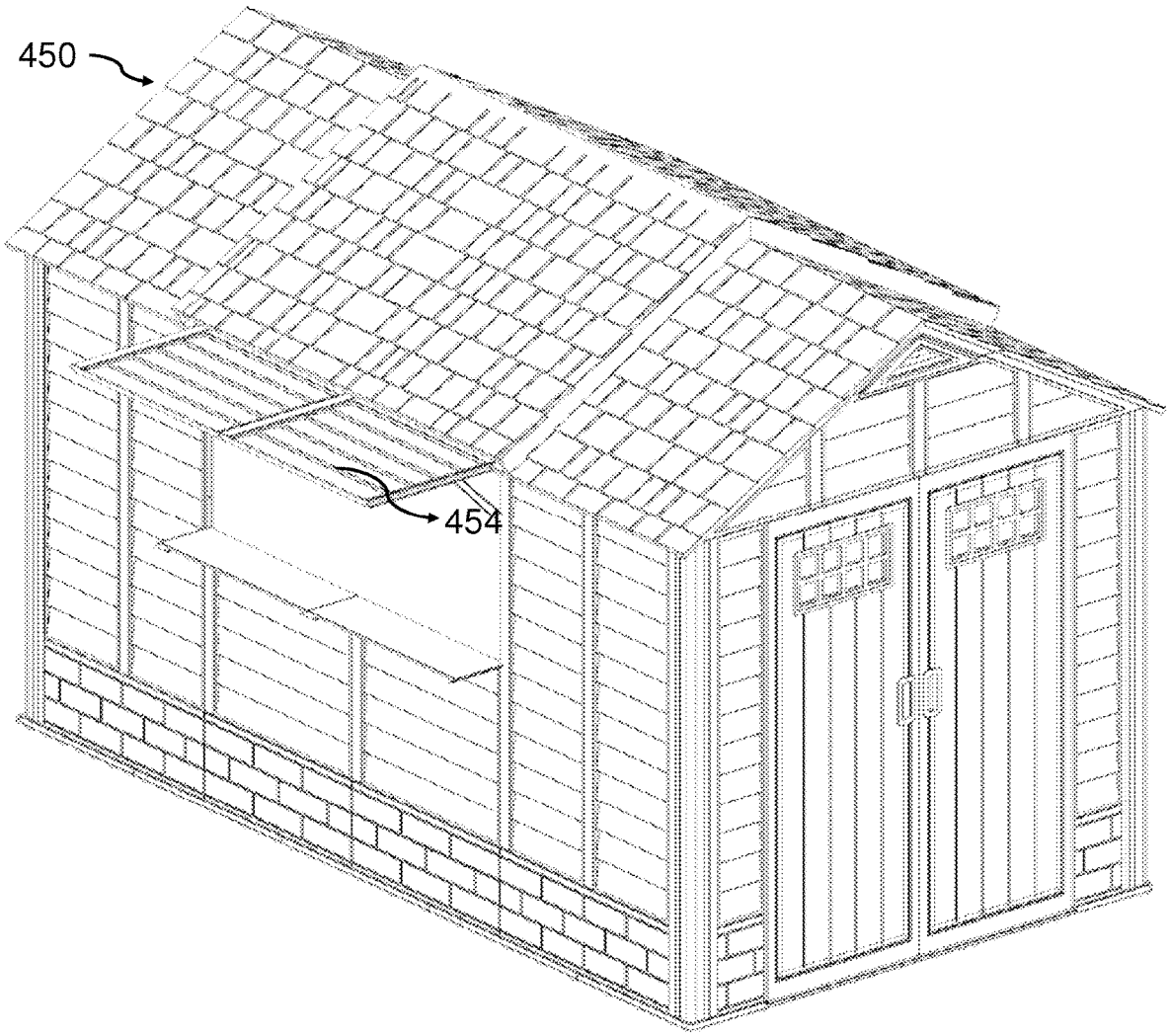
FIG. 62 is a schematic diagram of the structure of a prefab modular shed structure, according to one embodiment of the present subject matter.
Figure 63:
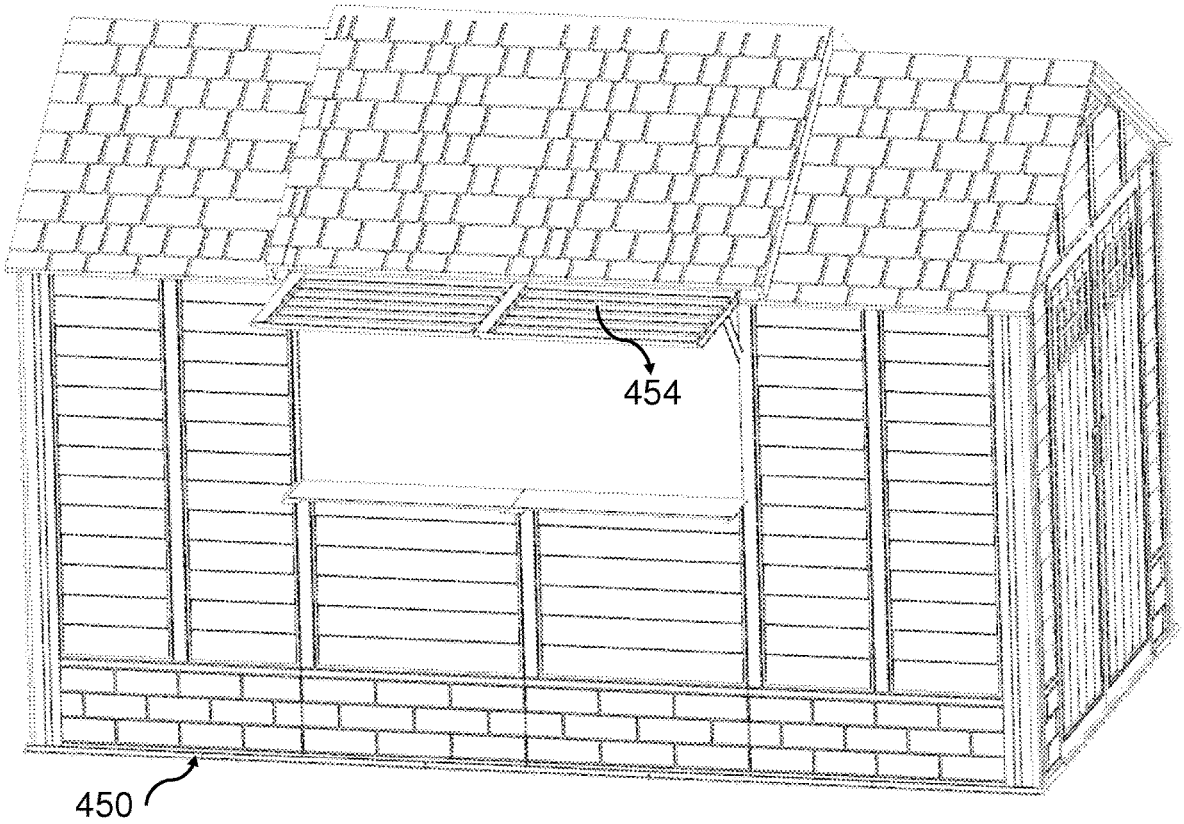
FIG. 63 is another schematic diagram of the structure of the configurable prefab modular shed structure as shown in FIG. 62, according to one embodiment of the present subject matter.

FIGS. 62 and 63 are another schematic diagram of the structure of a configurable prefab modular shed structure that provides a bar window. According to some embodiments, a modular shed 450 can incorporate a bar window 454 that can be used as a service space when needed. As shown in these figures, the middle section of the shed can have a raised ceiling that is higher than the remaining ceiling. According to some embodiments, the modular shed 450 can be configurable with extension floor panels and wall panels, which offers flexible space depending on the needs of the customer.

According to some embodiments, the storage shed structure of the present subject matter can be an indoor shed. Furthermore, some or all features of the present subject matter can be incorporated into other types of molded plastic assembly.

The above are only the preferred embodiments of the present subject matter. It should be pointed out that for those of ordinary skill in the art, without departing from the principle of the present subject matter, various modifications or improvements can be made to the present subject matter, such as in other applications. For example, the disclosed features can be incorporated into other molded plastic furniture assemblies, or these features, when applicable, can be incorporated into non-molded plastic furniture assembly, and these are all considered to be within the protection scope of the present subject matter.

It is to be understood that even though numerous characteristics and advantages of various embodiments of the present subject matter have been set forth in the foregoing description, together with details of the structure and function of various embodiments of the subject matter, this disclosure is illustrative only. In some cases, certain subassemblies are only described in detail with one such embodiment. Nevertheless, it is recognized and intended that such subassemblies may be used in other embodiments of the subject matter. Practitioners skilled in the art will recognize many modifications and variations. Changes may be made in detail, especially matters of structure and management of parts within the principles of the embodiments of the present subject matter to the full extent indicated by the broad general meaning of the terms in which the appended claims are expressed.

Having disclosed exemplary embodiments and the best mode, modifications and variations may be made to the disclosed embodiments while remaining within the scope of the embodiments of the subject matter as defined by the following claims.

What is claimed is:

1. A modular shed structure made of molded plastic panels, comprising:

a floor comprising a plurality of floor panels;

a plurality of wall panels coupled with the plurality of floor panels;

a pair of foldable door panels, each door panel comprising a door side panel connected to a door body via a first embedded folding groove; and a roof that comprises a central roof panel that is foldable via a second embedded folding groove and one or more side roof panels coupled to the central roof panel, the roof further comprises a beam support frame configured to support the roof, wherein the beam support frame comprises at least one central beam column and a central crossbar positioned in a middle of the at least one central beam column, wherein the first embedded folding groove and the second embedded folding groove are each defined by respective living hinges extending an entire length thereof, the embedded folding grooves dividing each foldable panel into a first leaf and a second leaf.

2. The modular shed structure of claim 1, wherein at least one of the wall panels includes a raised wall panel section.

3. The modular shed structure of claim 1, wherein the second embedded folding groove enables the central roof panel to form a roof peak when the shed structure is installed.

4. A modular shed structure made of molded plastic panels, comprising:

a floor comprising a plurality of floor panels, at least one said floor panel having an upward-opening strip groove extending along an edge thereof with a plurality of T-shaped installation holes therein;

a plurality of wall panels coupled with the plurality of floor panels via one or more T-shaped connectors engaging the T-shaped installation holes;

a pair of foldable door panels, each door panel comprising a door side panel connected to a door body via a first embedded folding groove; and a roof that comprises a central roof panel that is foldable via a second embedded folding groove and one or more side roof panels coupled to the central roof panel, wherein the first embedded folding groove and the second embedded folding groove are each defined by respective living hinges extending an entire length thereof, the embedded folding grooves dividing each foldable panel into a first leaf and a second leaf.

5. The modular shed structure of claim 4, wherein the second embedded folding groove enables the central roof panel to form a roof peak when the shed structure is installed.

6. The modular shed structure of claim 4, wherein each floor panel has the upward-opening strip groove with the plurality of T-shaped installation holes, and the plurality of T-shaped installation holes engage with the one or more T-shaped connectors.

7. The modular shed structure of claim 4, wherein the one or more T-shaped connectors are coupled with screws to connect the plurality of wall panels and the plurality of floor panels.

8. The modular shed structure of claim 4, further comprising a plurality of support columns positioned at each corner of the storage shed structure, wherein the plurality of support columns are formed by injection molding.

9. The modular shed structure of claim 4, further comprising a door lintel installed between the roof and the pair of door panels, wherein the door lintel comprises an upper edge to engage with a downward-facing slot on the roof.

10. The modular shed structure of claim 9, wherein the door lintel further comprises a position bump formed on top of the door lintel, and the position bump is embedded into a position recess formed on the roof.

11. The modular shed structure of claim 4, wherein each door panel further comprises a metal pivotable frame bracket encasing an edge of the door side panel and the door body.

12. The modular shed structure of claim 11, wherein the metal pivotable frame bracket comprises a pair of rotatable support members affixed to reinforce the door panel, and the door side panel and door body are constrained within corresponding U-shaped grooves on the pair of rotatable support members.

13. The modular shed structure of claim 12, wherein the side walls of the pair of rotatable support members have through holes, and corresponding mounting holes are provided on corresponding positions of the door side panel and door body.

14. The modular shed structure of claim 13, further comprising a plurality of fixation components configured to fix the metal pivotable frame brackets via the through holes and the corresponding mounting holes.

15. The modular shed structure of claim 4, wherein the roof further comprises a beam support frame configured to support the roof, wherein the beam support frame comprises at least one central beam column and a central crossbar positioned in a middle of the at least one central beam column.

16. The modular shed structure of claim 15, wherein the beam support frame further comprises a plurality of side crossbars in parallel to the central crossbar, and wherein the central crossbar and the plurality of side crossbars are distributed on the at least one central beam column at intervals.

17. The modular shed structure of claim 16, wherein the central crossbar is affixed to a door lintel and the plurality of side crossbars are affixed to the roof.

18. The modular shed structure of claim 16, wherein top surfaces of the central roof panel and the one or more side roof panels form a stepped structure that gradually descends from a center to sides thereof.

19. A configurable modular shed structure made of molded plastic panels, comprising:

a floor comprising a plurality of floor panels;

a plurality of wall panels coupled with the plurality of floor panels;

a pair of foldable door panels, each door panel comprising a door side panel connected to a door body via a first embedded folding groove;

a roof that comprises a central roof panel that is foldable via a second embedded folding groove and one or more side roof panels coupled to the central roof panel, the roof further comprises a beam support frame configured to support the roof; and a plurality of support columns positioned at each corner of the storage shed structure, wherein the first embedded folding groove and the second embedded folding groove are each defined by respective living hinges extending an entire length thereof, the embedded folding grooves dividing each foldable panel into a first leaf and a second leaf.

20. The configurable modular shed structure of claim 19, wherein the configurable modular shed structure is adjustable via numbers of the plurality of wall panels and the floor panels.

* * * * *